US012723838B2

(12) United States Patent
Underwood et al.

(10) Patent No.: US 12,723,838 B2
(45) Date of Patent: Sep. 1, 2026

(54) RETENTION SYSTEM FOR GRIP ATTACHMENT

(71) Applicant: AXTS INC, Redmond, OR (US)

(72) Inventors: Joshua A. Underwood, Redmond, OR (US); Anibal Salinas, Redmond, OR (US); Seth K. Peterson, Redmond, OR (US)

(73) Assignee: AXTS INC., Redmond, OR (US)

( * ) Notice: Subject to any disclaimer, the term of this patent is extended or adjusted under 35 U.S.C. 154(b) by 0 days.

(21) Appl. No.: 19/246,625

(22) Filed: Jun. 23, 2025

(65) Prior Publication Data

US 2025/0327639 A1 Oct. 23, 2025

Related U.S. Application Data

(63) Continuation-in-part of application No. 18/889,282, filed on Sep. 18, 2024, now Pat. No. 12,339,094.

(60) Provisional application No. 63/670,690, filed on Jul. 12, 2024, provisional application No. 63/592,519, filed on Oct. 23, 2023.

(51) Int. Cl.
*F41C 23/16* (2006.01)
*F41C 23/10* (2006.01)

(52) U.S. Cl.
CPC ..... *F41C 23/16* (2013.01); *F41C 23/10* (2013.01)

(58) Field of Classification Search
CPC ..... F41C 23/16; F41C 23/10
See application file for complete search history.

(56) References Cited

U.S. PATENT DOCUMENTS

| | | | | |
|---|---|---|---|---|
| 517,555 | A | 4/1894 | Reed | |
| 1,015,490 | A | 1/1912 | Harrington | |
| 2,034,632 | A * | 3/1936 | Rice | F41C 23/10 42/71.02 |
| 2,043,430 | A | 6/1936 | Doe | |
| 3,683,535 | A | 8/1972 | Lewis | |
| 3,710,496 | A | 1/1973 | Packmayr | |
| 3,739,515 | A | 6/1973 | Koon | |
| 4,023,914 | A | 5/1977 | Holmes | |

(Continued)

FOREIGN PATENT DOCUMENTS

| | | |
|---|---|---|
| AT | 15586 U1 | 2/2018 |
| AU | 676981 | 3/1997 |
| WO | 2023/249525 | 12/2023 |

OTHER PUBLICATIONS

Southwest Precision; Instagram; at least as early as Oct. 2, 2022.

(Continued)

*Primary Examiner* — Michelle Clement
(74) *Attorney, Agent, or Firm* — Schwabe Williamson & Wyatt

(57) ABSTRACT

In various embodiments, an apparatus to operate with a firearm grip is provided, in which the firearm grip includes two openings, including a magazine receptacle and an aftly-positioned additional opening, the openings partitioned by a wall, the apparatus comprising: a retention system insertable into the aftly-positioned additional opening, the retention system including: a drive section; and an expansion section, driven by the drive section, and configured to restrict expansion to direction(s) that are not toward the wall. Other embodiments are disclosed and/or claimed.

25 Claims, 50 Drawing Sheets

(56) References Cited

U.S. PATENT DOCUMENTS

| | | | | |
|---|---|---|---|---|
| 4,076,064 | A | 2/1978 | Holmes | |
| 4,199,887 | A * | 4/1980 | Hogue | F41C 23/10 42/71.02 |
| 4,242,826 | A | 1/1981 | Anschutz | |
| 4,271,623 | A | 6/1981 | Beretta | |
| 4,333,256 | A * | 6/1982 | Hogue | F41C 23/10 42/71.02 |
| 4,341,022 | A | 7/1982 | Santoro | |
| 4,342,170 | A * | 8/1982 | Hogue | F41C 23/10 42/71.02 |
| 4,501,071 | A | 2/1985 | Manske | |
| 4,520,585 | A | 6/1985 | Barrett | |
| 4,570,370 | A | 2/1986 | Smith | |
| 4,936,036 | A | 6/1990 | Sniezak | |
| 4,959,908 | A | 10/1990 | Weyrauch | |
| 5,050,329 | A * | 9/1991 | Hogue | F41C 23/10 42/71.02 |
| 5,231,237 | A | 7/1993 | Cupp | |
| 5,425,191 | A | 6/1995 | Taylor | |
| 5,438,783 | A | 8/1995 | Sniezak | |
| 5,467,552 | A | 11/1995 | Cupp | |
| 5,483,766 | A * | 1/1996 | Hochstrate | F41C 23/10 42/71.02 |
| 5,570,529 | A | 11/1996 | Amelino | |
| 5,621,995 | A | 4/1997 | Smith | |
| 5,979,098 | A | 11/1999 | Griggs | |
| 6,112,446 | A | 9/2000 | Forster | |
| 6,318,015 | B1 | 11/2001 | Baumann | |
| 6,487,807 | B1 | 12/2002 | Kopman | |
| 6,557,287 | B2 | 5/2003 | Wollmann | |
| 6,568,115 | B2 | 5/2003 | Beretta | |
| 6,874,266 | B1 | 4/2005 | Kong | |
| 7,117,622 | B2 | 10/2006 | Freed | |
| 7,121,034 | B2 | 10/2006 | Keng | |
| 7,191,556 | B2 | 3/2007 | Pikielny | |
| 7,467,489 | B2 | 12/2008 | Gussalli | |
| 7,490,429 | B2 | 2/2009 | Moody | |
| 7,506,469 | B2 | 3/2009 | Poulin | |
| 7,587,852 | B1 | 9/2009 | Harms | |
| 7,614,174 | B1 | 11/2009 | Beltz | |
| 7,743,542 | B1 | 6/2010 | Novak | |
| 7,748,153 | B2 | 7/2010 | Beretta | |
| 7,823,855 | B2 | 11/2010 | Faifer | |
| 7,937,874 | B2 | 5/2011 | Roth | |
| 8,156,676 | B1 | 4/2012 | Moody | |
| 8,365,456 | B1 | 2/2013 | Shepard | |
| 8,448,366 | B2 | 5/2013 | Faifer | |
| 8,448,562 | B2 | 5/2013 | Cottle | |
| 8,561,338 | B2 | 10/2013 | Chvala | |
| 8,590,202 | B2 | 11/2013 | Keng | |
| 8,806,791 | B2 | 8/2014 | Cottle | |
| 8,857,093 | B2 | 10/2014 | Hogue | |
| 8,898,949 | B1 | 12/2014 | Greenwood | |
| 9,038,305 | B2 | 5/2015 | Volfson | |
| 9,423,212 | B2 | 8/2016 | Campean | |
| 9,546,836 | B2 | 1/2017 | Cottle | |
| 9,612,083 | B2 | 4/2017 | Cottle | |
| 9,897,402 | B2 | 2/2018 | Pettit | |
| 10,024,628 | B2 | 7/2018 | Toner | |
| 10,066,885 | B2 | 9/2018 | Chen | |
| 10,101,105 | B1 | 10/2018 | Novak | |
| 10,101,110 | B2 | 10/2018 | Faifer | |
| 10,197,359 | B1 * | 2/2019 | Toole | F41G 1/35 |
| 10,203,177 | B2 * | 2/2019 | Chavez | F41C 23/10 |
| 10,228,213 | B1 | 3/2019 | Smith | |
| 10,415,919 | B1 | 9/2019 | Harrigan | |
| 10,684,100 | B2 | 6/2020 | Pniel | |
| 10,731,936 | B1 | 8/2020 | Sapio | |
| 10,782,099 | B2 | 9/2020 | Zimmer | |
| 10,845,138 | B2 | 11/2020 | Landis et al. | |
| 10,859,343 | B1 | 12/2020 | Glen | |
| 10,871,350 | B1 | 12/2020 | Thomas et al. | |
| 10,921,076 | B1 | 2/2021 | Thomas et al. | |
| 10,948,262 | B2 | 3/2021 | Curry | |
| 10,948,267 | B2 | 3/2021 | Zimmer | |
| 11,002,517 | B1 | 5/2021 | Holly | |
| 11,022,388 | B1 | 6/2021 | Noonan | |
| 11,073,351 | B2 | 7/2021 | Tai | |
| 11,079,189 | B2 | 8/2021 | Hsu | |
| 11,306,862 | B1 | 4/2022 | Ye | |
| 11,460,274 | B2 | 10/2022 | Dawson | |
| 11,473,862 | B2 | 10/2022 | Oh | |
| 11,480,414 | B2 | 10/2022 | Salinas et al. | |
| 11,543,194 | B2 | 1/2023 | Berger | |
| 11,644,257 | B1 | 5/2023 | Roe | |
| 11,747,100 | B2 | 9/2023 | Salinas et al. | |
| 11,788,818 | B2 | 10/2023 | Roth | |
| 11,852,427 | B2 | 12/2023 | Bachstein | |
| 11,959,727 | B1 | 4/2024 | Yedor | |
| 11,982,511 | B2 | 5/2024 | Melville | |
| 12,007,202 | B2 | 6/2024 | Stern | |
| 12,078,439 | B2 | 9/2024 | Curry | |
| 12,130,120 | B2 | 10/2024 | Langdon | |
| 12,163,763 | B2 | 12/2024 | Dawson, Jr. | |
| 12,235,078 | B2 | 2/2025 | Planck | |
| 12,253,334 | B2 | 3/2025 | Dawson, Jr. | |
| 12,281,877 | B2 | 4/2025 | Renaud | |
| 12,339,094 | B2 | 6/2025 | Underwood et al. | |
| 12,398,969 | B2 | 8/2025 | Toner | |
| 12,405,089 | B2 | 9/2025 | Underwood | |
| 2002/0088159 | A1 | 7/2002 | McMoore | |
| 2003/0074824 | A1 | 4/2003 | Arachequesne | |
| 2006/0064913 | A1 | 3/2006 | Gablowski | |
| 2006/0096147 | A1 | 5/2006 | Gussalli | |
| 2010/0071244 | A1 | 3/2010 | Fitzpatrick | |
| 2010/0212202 | A1 | 8/2010 | Roth | |
| 2012/0222342 | A1 | 9/2012 | Chvala | |
| 2013/0139426 | A1 | 6/2013 | Baxley | |
| 2015/0121738 | A1 | 5/2015 | Zajk | |
| 2015/0268002 | A1 | 9/2015 | Jeung | |
| 2017/0059277 | A1 | 3/2017 | Justice | |
| 2019/0107348 | A1 | 4/2019 | Harrigan | |
| 2019/0170480 | A1 * | 6/2019 | Toole | F41G 1/35 |
| 2020/0025472 | A1 | 1/2020 | Landis | |
| 2020/0025520 | A1 | 1/2020 | Niswander | |
| 2021/0088310 | A1 | 3/2021 | Planck | |
| 2021/0172691 | A1 | 6/2021 | Hsu | |
| 2021/0231399 | A1 | 7/2021 | Salinas | |
| 2021/0270572 | A1 | 9/2021 | Dawson, Jr. | |
| 2021/0341236 | A1 | 11/2021 | Hsu | |
| 2022/0042773 | A1 | 2/2022 | Kincel | |
| 2022/0268553 | A1 | 8/2022 | Roth | |
| 2023/0392898 | A1 | 12/2023 | Hughes | |
| 2023/0400271 | A1 | 12/2023 | Underwood | |
| 2024/0110759 | A1 | 4/2024 | Underwood | |
| 2024/0110767 | A1 | 4/2024 | Underwood | |
| 2024/0110769 | A1 | 4/2024 | Underwood et al. | |
| 2024/0118053 | A1 | 4/2024 | Moretti | |
| 2024/0200906 | A1 | 6/2024 | Johnson | |
| 2024/0288113 | A1 | 8/2024 | Johnson | |
| 2024/0302117 | A1 | 9/2024 | Strechinski | |
| 2024/0302137 | A1 | 9/2024 | Johnson | |
| 2024/0410673 | A1 | 12/2024 | Robertson | |
| 2025/0102279 | A1 | 3/2025 | Dawson, Jr. | |
| 2025/0123079 | A1 | 4/2025 | Dawson, Jr. | |
| 2025/0130011 | A1 | 4/2025 | Underwood et al. | |
| 2025/0314451 | A1 | 10/2025 | Underwood et al. | |
| 2025/0377187 | A1 | 12/2025 | Underwood | |

OTHER PUBLICATIONS

Shadow Systems; Patented Multi-Footprint Optic Cut; Optic Fit; https://shadowsystemscorp.com/opticcut/; at least as early as Oct. 2, 2022.

Next Gen Tooling; Technical Support Blog, "Use Guide Pins to Assist in Loading of Fixtures to Protect Your Investment" https://www.nextgentooling.com/technical/category/tolerance/2#:~:text=Locking%20tapers%20%2D%20These%20can%20be, Dec. 14, 2016.

Fortis; "K1 System (Tapered) Castle Nut—LETM Lightweight Enhanced AR15 End Plate" https://fortismfg.com/k1systemcastlenut-lightweightenhancedar15endplate; at least as early as Oct. 2, 2022.

(56) References Cited

OTHER PUBLICATIONS

Emuge-Franken, SME, "Securing Fasteners in Safety Critical Aerospace and Defense Applications" https://www.sme.org/technologies/articles/2022/december/securing-fasteners-in-safety-critical-aerospace-and-defense-applications/ Dec. 6, 2022.
Walther, Walther PDP Optic Plate Mounting System (Second Generation); https://waltherarms.com/blog/walther-pdp-optic-plate-mounting-system-2; at least as early as Oct. 2, 2022.
Nomad Defense Co., Nomad 9F Magwell Extension and Backstrap Combo-Compact/Standard; https://www.nomaddefenseco.com/nomad-9f-magwell-extension-and-backstrap-combo-compact-standard/ ; at least as early as Oct. 26, 2022; pp. 1-5.
LokGrips; Walther PDP F-Series Magwell Brass, https://lokgrips.com/walther/walther-pdp/walther-pdp-f-series-magwell-brass/ ; at least as early as Oct. 26, 2022; pp. 1-5.
Floyds Custom Shop; "FCS Hellcat Pro Magwell and Extensions Install", https://www.youtube.com/watch?v=7KJgzaG2a9Y&t=253s; See: 0:55 minutes; Dec. 27, 2023.

* cited by examiner

1630

2011

2200

2829

2829

2829

RETENTION SYSTEM FOR GRIP ATTACHMENT

RELATED APPLICATIONS

This non-provisional application is a continuation-in-part of U.S. Non-provisional application Ser. No. 18/889,282, filed on Sep. 18, 2024, which claims benefit of U.S. Provisional Application Nos. 63/670,690 (filed on Jul. 12, 2024) and 63/592,519 (filed on Oct. 23, 2023), all of which are incorporated by reference herein.

BACKGROUND

Some firearms have modular grip assemblies. In one example of a modular grip assembly, a backstrap attaches to the grip frame. A grip characteristic of the firearm (e.g., grip size or grip profile/shape) may be changed by using the same grip frame in combination with a different backstrap.

DETAILED DESCRIPTION

Modular Firearm Grip Assembly

In firearms with modular grip assemblies, a backstrap may attach to a back of the grip frame using a rotatably-driven fastener. However, in recoil environments, recoil forces may cause the backstrap to loosen over time, as recoil forces are transmitted into the grip frame as well as into other components of the grip assembly. While it may be possible to still use a firearm with a grip having some "play," any play in the grip is undesirable and highly noticeable (given that an operator's hand is in contact with it). To re-tighten the rotatably driven fastener, the operator of course needs to have a rotatable driving tool (e.g., a screwdriver) available.

To reduce loosening, an operator may install a threaded rotatably driven fastener with an adhesive, such as Loctite®. However, this approach may be undesirable for reasons explained in U.S. patent application Ser. No. 18/480,451, filed on Oct. 3, 2023, which is herein incorporated by reference.

Besides the possibility of loosening from recoil, each fastener or its fastener hole may create a discontinuity in a surface of the grip assembly. For example, a fastener to attach the backstrap (or its fastener opening if it is countersunk) may create a discontinuity on a grip surface of the backstrap. This discontinuity may affect grip effectiveness (which may be impactful in, say, wet conditions), grip comfort, accumulation of debris, and/or appearance (a manufacturer may be constrained in the kind of aesthetic grip designs it can develop, when there is a requirement for a discontinuity in the grip surface). The discontinuity may have the most negative impact when it is located at a mid-back position of a backstrap, which many are as this location may enable use of only one fastener for the backstrap.

Any of the problems explained above with regard to a backstrap can affect other grip parts, such as magwells. A magwell (e.g., a flared detachable magwell) may couple to a bottom of a grip frame, and may act as a guide for loading a magazine into the magazine well of the firearm. A magwell (e.g., a flared detachable magwell) may increase the entry area of the magazine well.

Figure 7:
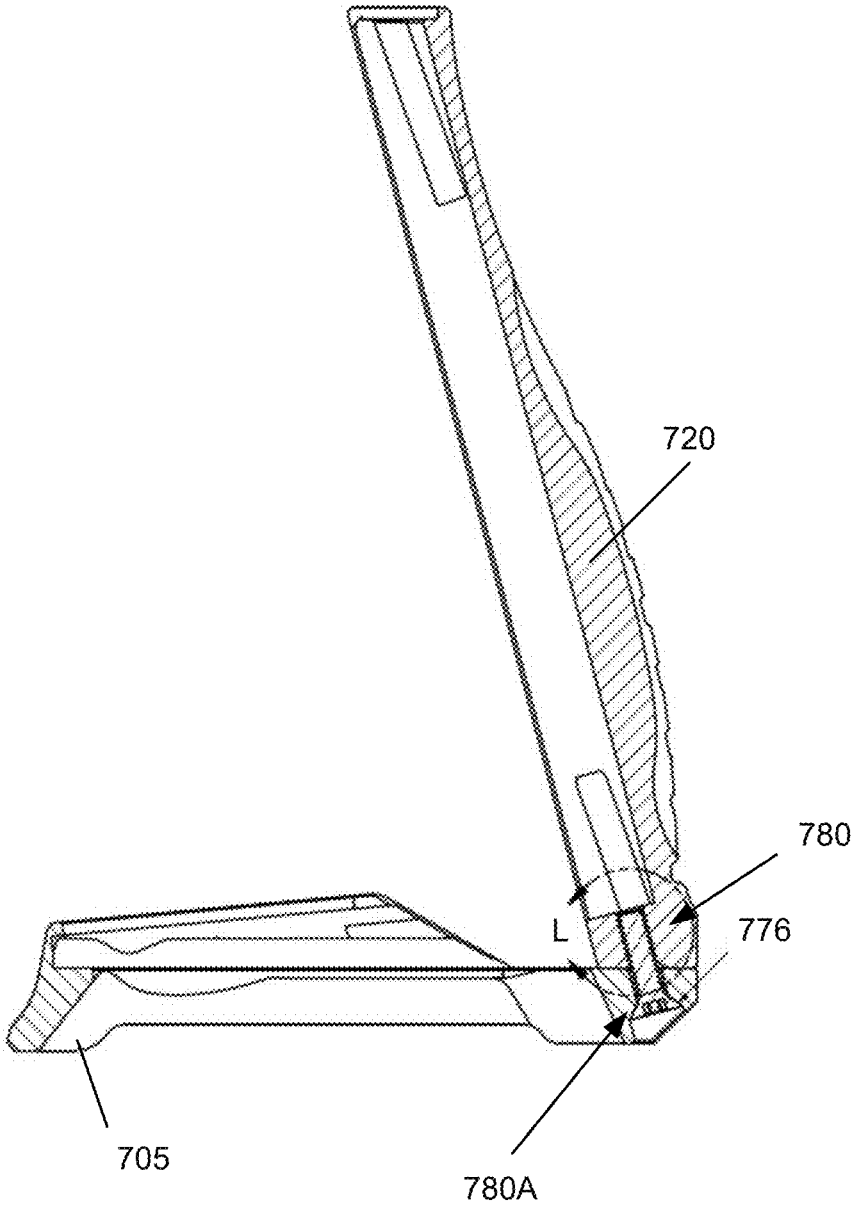
FIG. 7 illustrates a sectional view of another grip accessory assembly, according to various embodiments.

FIG. 7 illustrates a sectional view of the grip frame assembly described in more detail in U.S. patent application Ser. No. 18/480,451, filed on Oct. 3, 2023, which is herein incorporated by reference. The grip frame assembly includes a grip part 720 mountable to a modular grip assembly of a firearm (not shown), and another part 705 (e.g., a magwell in this example) coupled to different part of the grip frame. A threaded hole 780 for a rotatably-driven fastener 780A extends through magwell 705 and into backstrap 720.

The rotatably-driven fastener 780A may have features to prevent loosening due to recoil forces, e.g., self-locking threads along its length and/or a tapered head 776, as described in more detail in the '451 application. However, other advantages of this arrangement over the known arrangements that use a threaded rotatably driven fastener will be apparent to one of ordinary skill in the art (for example, the entire back surface of the separable grip may be free of discontinuities such as fastener heads or counter openings, which may provide a better grip for an operator of the firearm and allow a manufacturer to make a more unique/desirable appearance of the grip assembly).

The various advantages of the grip frame assembly described by the '451 application notwithstanding, it may still be desirable to provide some further grip assembly arrangements in which there is no requirement for a discontinuity on the part of the grip assembly to make contact with the operator's hand when operating the firearm.

Figure 1:
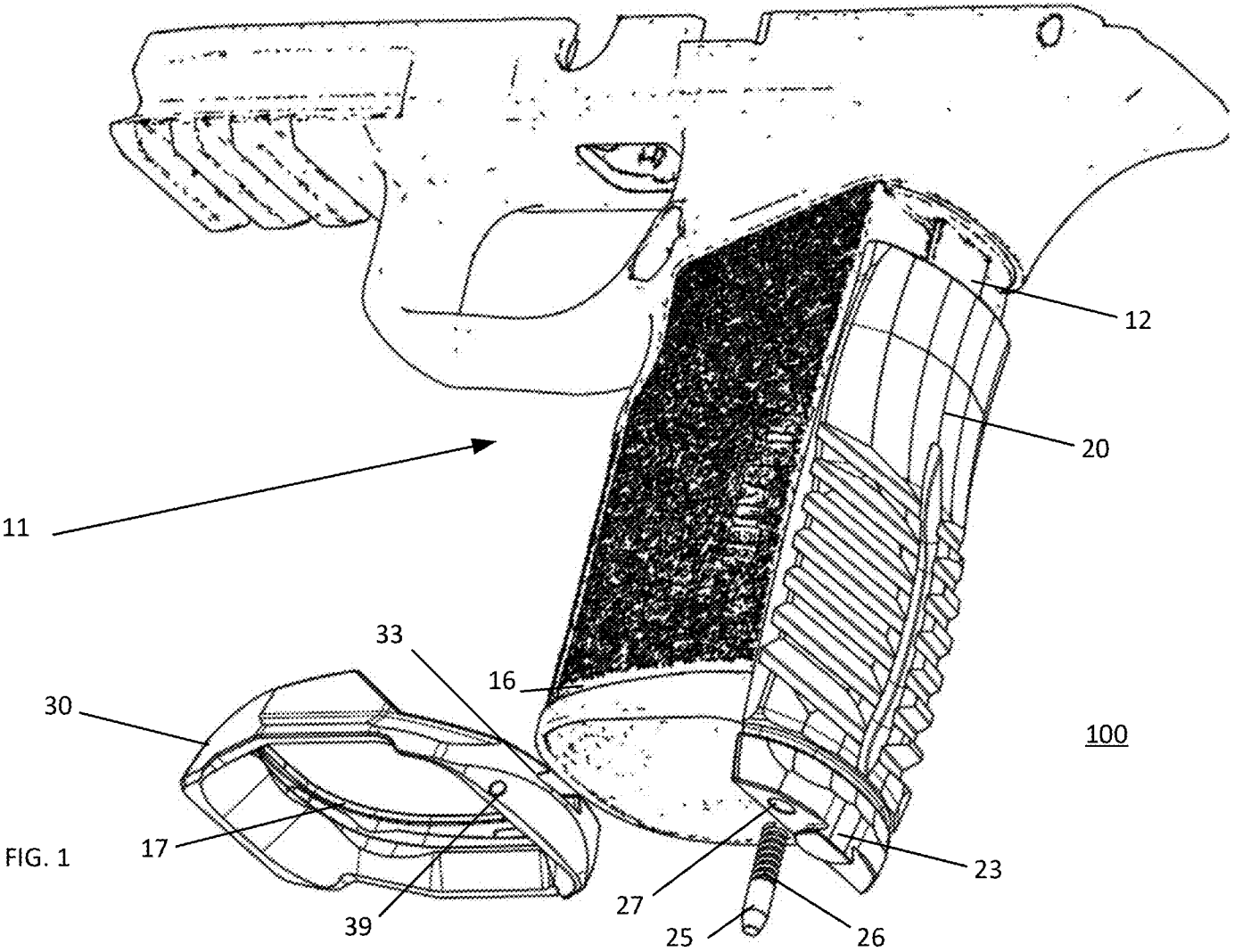
FIG. 1 illustrates an exploded isometric view of a frame assembly for a firearm, according to various embodiments.
Figure 2B:
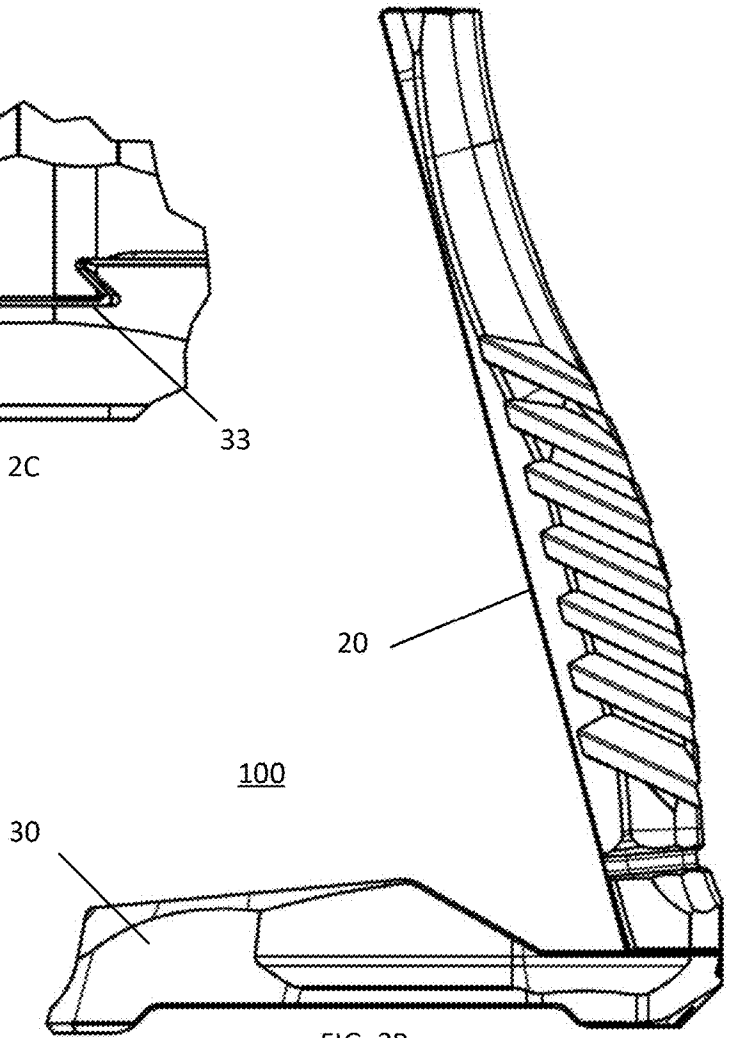
FIG. 2B illustrates a side view of the grip accessory assembly of FIG. 2A.
Figure 2C:
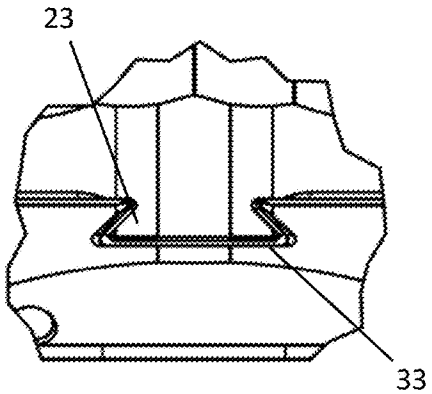
FIG. 2C illustrates a detail J of the grip accessory assembly of FIG. 2A.
Figure 2A:
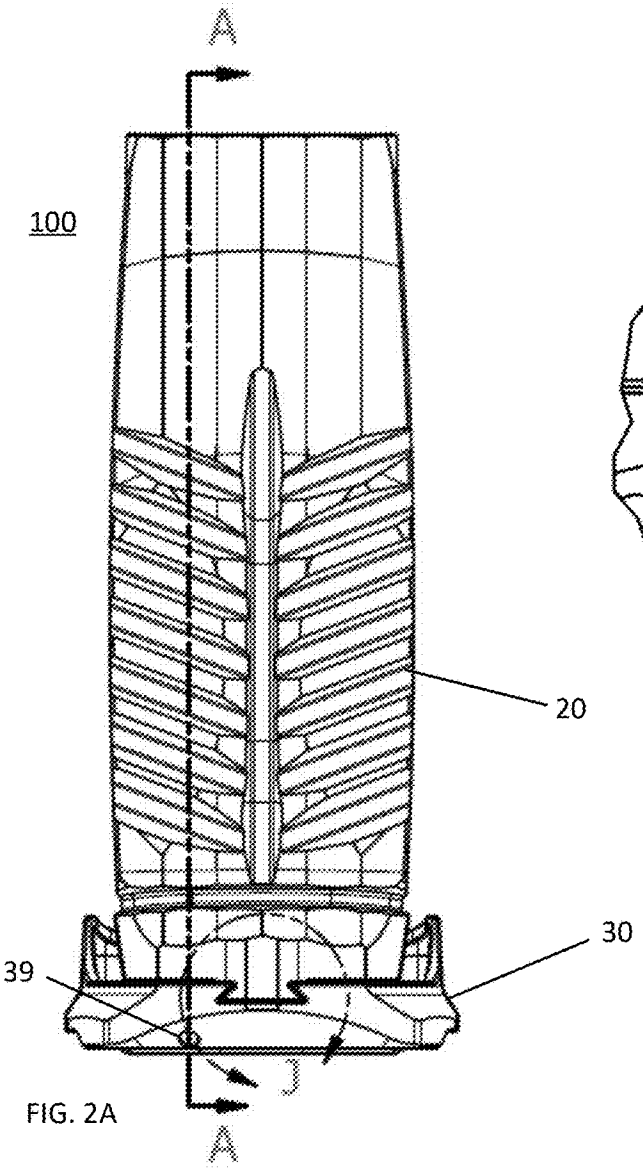
FIG. 2A illustrate a front view of a grip accessory assembly of FIG. 1, in an assembled state.

FIG. 1 illustrates an exploded isometric view of a frame assembly 100 for a firearm, according to various embodiments. The frame assembly 100 includes a grip frame 11, a first separable part 20 (e.g., a grip part, such as a backstrap), a second separable part (e.g., a grip accessory such as a magwell), and a plunger assembly (e.g., plunger 25 and spring 26).

The grip surface of the separable part 20 (e.g., the back exterior surface) does not have any fastener discontinuities for attachment features (e.g., no fastener or fastener opening on the back exterior surface). This may improve grip when operating the firearm, such as in wet conditions.

Regarding the magwell 30, instead of a fastener or fastener opening discontinuity, it has a push tool access port 39, which may have a diameter that is smaller than the head of a typical fastener used in a grip assembly 100. This push tool port 39 may receive a push tool, as opposed to a rotatable driving tool that may be required to install rotatably driven fasteners. One example of a push tool usable with the port 39 may be a paper clip or small wire.

The backstrap 20 may be backwards compatible with known grip frames, and may be mounted to the grip frame 11 in place of an original backstrap (not shown). The backstrap 20 may have an interface (e.g., one or more channels) to mate with the extrusions 12 of the grip frame 11. In various embodiments, the backstrap 20 may have other interface features to mate with known grip frames, such as a retention pin hole (not shown) to receive a retention pin (not shown) of the frame 11. In these embodiments, the backstrap 20 may define a retention pin hole (not shown) to receive a retention pin of the interface of the grip frame. The backstrap 20 may be mounted to the grip frame 11 in place of an original backstrap (not shown) using the same retention pin.

Similarly, the magwell 30 may be backwards compatible with known grip frames. For example, the backstrap 20 may have an interface 17 (e.g., a lip) to slidingly mount onto a groove 16 of the grip frame 11.

In various embodiments, the backstrap 20 may have any interface to mate with any grip frame interface now known (e.g., used on known grip frames), or later developed. The interface on the back of the grip frame may be an attachment interface (such as one or more channels) to mate with the interface of the grip frame 11 (e.g., the extrusion 12).

Figure 4A:
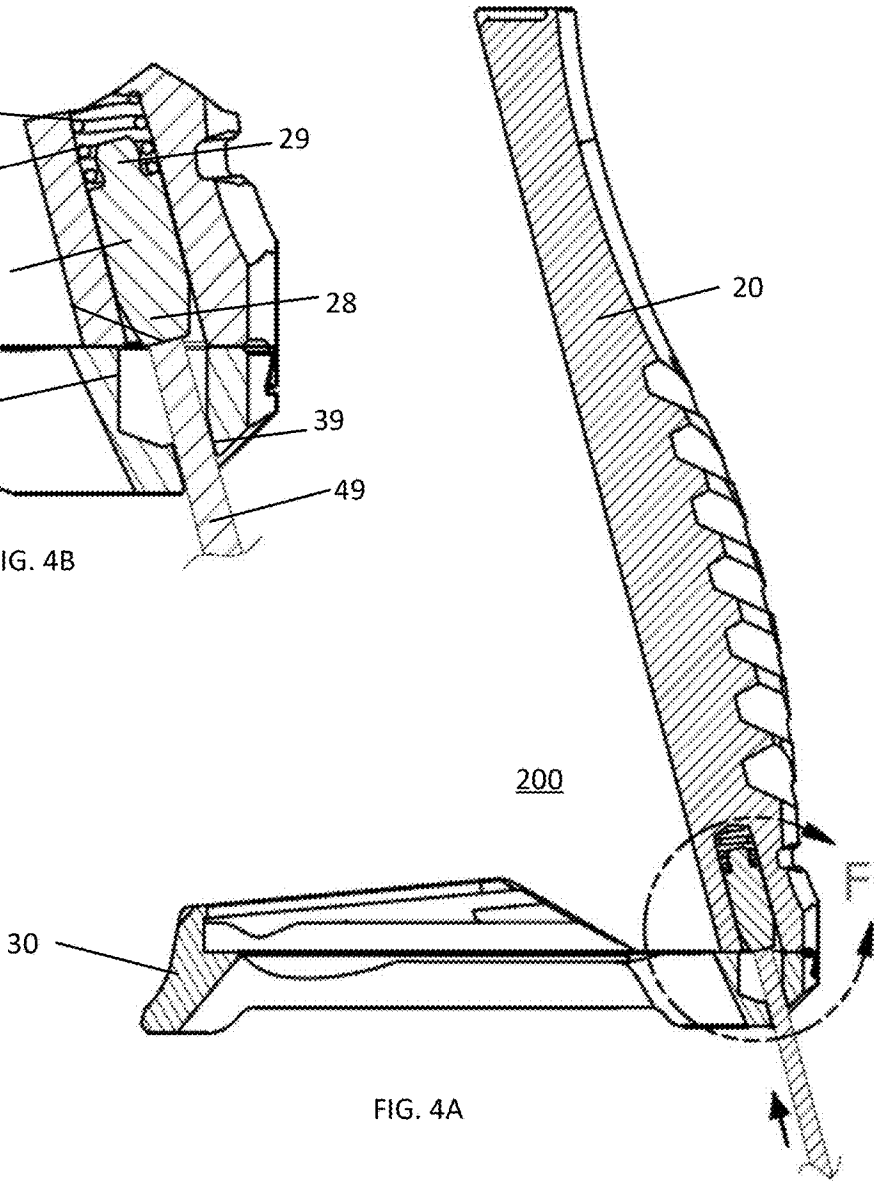
FIG. 4A illustrates a section view of the grip accessory assembly of FIG. 2A, during a first stage of disassembly, taken along section line A-A.
Figure 4B:
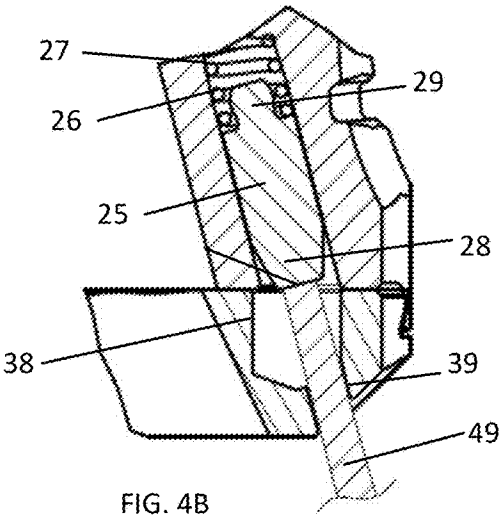
FIG. 4B illustrates a detail F of the grip accessory assembly of FIG. 4A during the first stage of disassembly.

Referring now to FIGS. 4A and 4B, a user may wish to remove the backstrap 20 for a number of reasons. For example, the grip assembly may not properly fit the hand of an intended operator. A backstrap of a different size (e.g., smaller, larger, differently shaped, etc.) may produce a better overall grip for the intended operator. Alternatively, a user may wish to replace the backstrap 20 for any other reasons such as a different material backstrap, a different atheistic design, an alternative textured pattern, or the like, or combinations thereof.

The backstrap 20 may be easily removed from the frame assembly 100 by an operator, using the plunger assembly. In a first stage of disassembly, a user may insert a push tool 49 into the port 39 to at least partially collapse the spring 26, as illustrated in FIGS. 4A and 4B. The push tool 49 may be any tool that fits into the port 39, such as an improvised tool (in some embodiments, a paper clip may be used as a tool to at least partially collapse the spring 26).

Figures 5A, 5B:
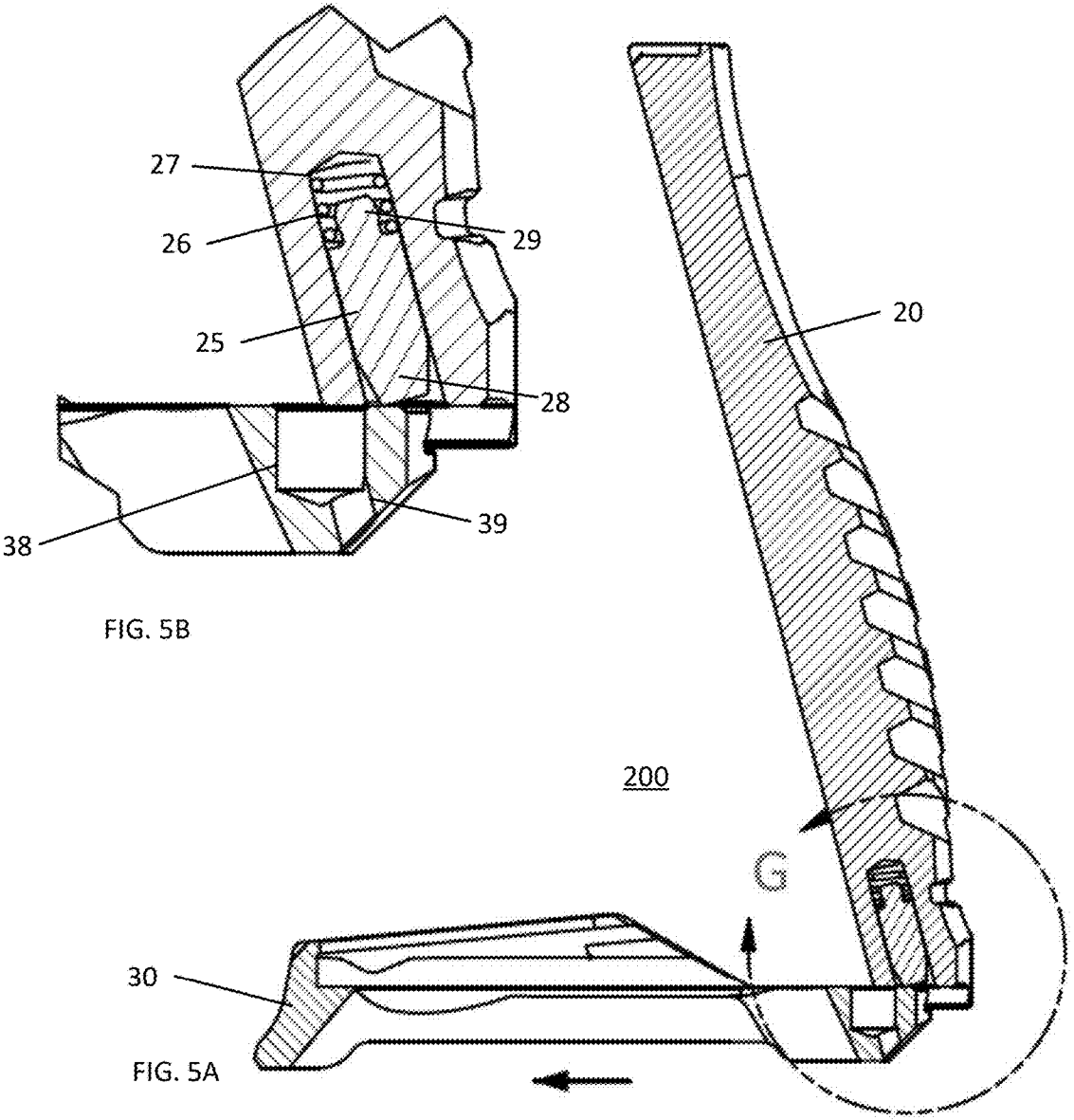
FIG. 5A illustrates a section view of the grip accessory assembly of FIG. 2A, during a second stage of disassembly, taken along section line A-A.
FIG. 5B illustrates a detail G of the grip accessory assembly of FIG. 5A, during the second stage of disassembly.

With the spring 26 partially collapsed, referring to FIGS. 5A-B the magwell 30 may be moved slidingly forward relative to the backstrap 20. This forward sliding may cause the interfaces 16 and 17 of FIG. 1 to be slidingly released from one another. The forward movement may also cause a protrusion on one or the backstrap 20 and the magwell 30 to be removed from a corresponding opening on the other of the backstrap 20 and the magwell 30. Referring to FIG. 1, in this example the opening 33 is defined by the magwell 30 and the protrusion 23 is defined by the backstrap 20. It may be possible and practical to reverse this arrangement in other embodiments (with a protrusion defined by a magwell). Also, in this embodiment the opening 33 is an undercut opening (e.g., a dovetail groove to receive a dovetail), but in other examples an opening may be some other kind of undercut opening to receive some other kind of protrusion (e.g., a T-slot).

Figure 6A:
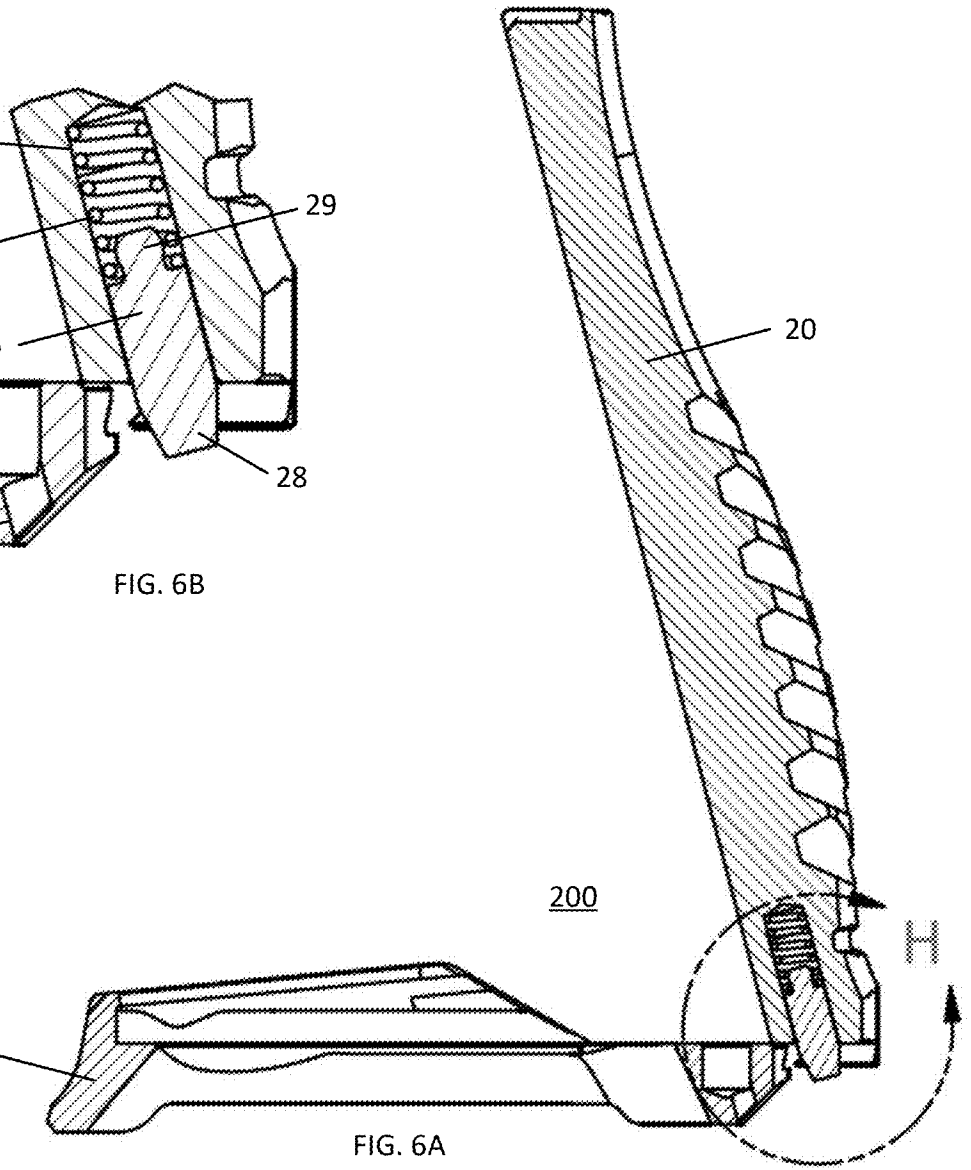
FIG. 6A illustrates a section view of the grip accessory assembly of FIG. 2A, during a third stage of disassembly, taken along section line A-A.
Figure 6B:
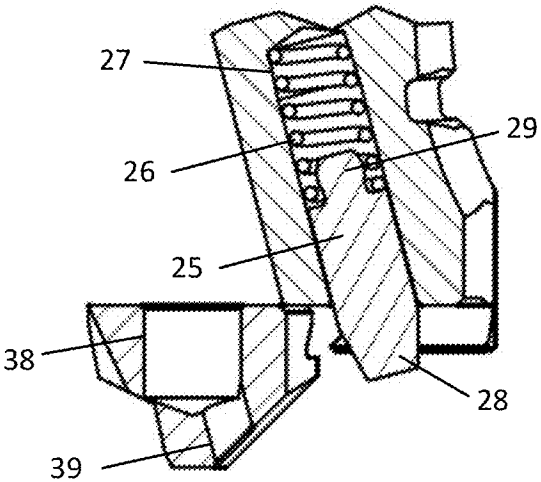
FIG. 6B illustrates a detail H of the grip accessory assembly of FIG. 6A, during the third stage of disassembly.

Referring to now FIGS. 6A-B, with the magwell 30 positioned from the forward movement described previously, the plunger assembly may be removed from the plunger assembly opening 27 (e.g., the plunger 25 and spring 26 may be removed). The user may then remove the backstrap 20 from the grip frame 11 (FIG. 1), such by moving the backstrap 20 downward to slidingly release it from the grip frame 11.

With the backstrap 20 removed, a user may then attach some other separable part that may have a same mounting interface as backstrap 20 to the grip frame 11 (FIG. 1). For example, the user may install a different backstrap that may be larger or smaller than the backstrap 20.

To install the different backstrap, the user may mount it on the grip frame 11 (FIG. 1) by, say a sliding upward movement. The user then may install the same plunger assembly into a plunger assembly opening on the different backstrap. The user may then slidingly move the interface 17 (FIG. 1) of the magwell 30 into the interface 16 of the grip frame 11.

While a typical reason to remove the magwell 30 and backstrap 20 may be to use a different backstrap, it should be appreciated that one may remove the magwell 30 regardless of whether the backstrap 20 is removed. It may be possible to provide another grip accessory, such as a magwell with a different well geometry or some other grip accessory having an attachment interface similar to the magwell 30. As one example, a glass breaker accessory may be provided with the same attachment interface as the magwell 30. The magwell 30 may be replaced with the glass breaker accessory, and the glass breaker accessory could retain the backstrap 20 in a similar way that the magwell 30 retains the backstrap 20. Any grip accessory or other grip part, now known or later developed, may include an attachment interface similar in various respects as the described attachment interface of the magwell 30.

Figure 3A:
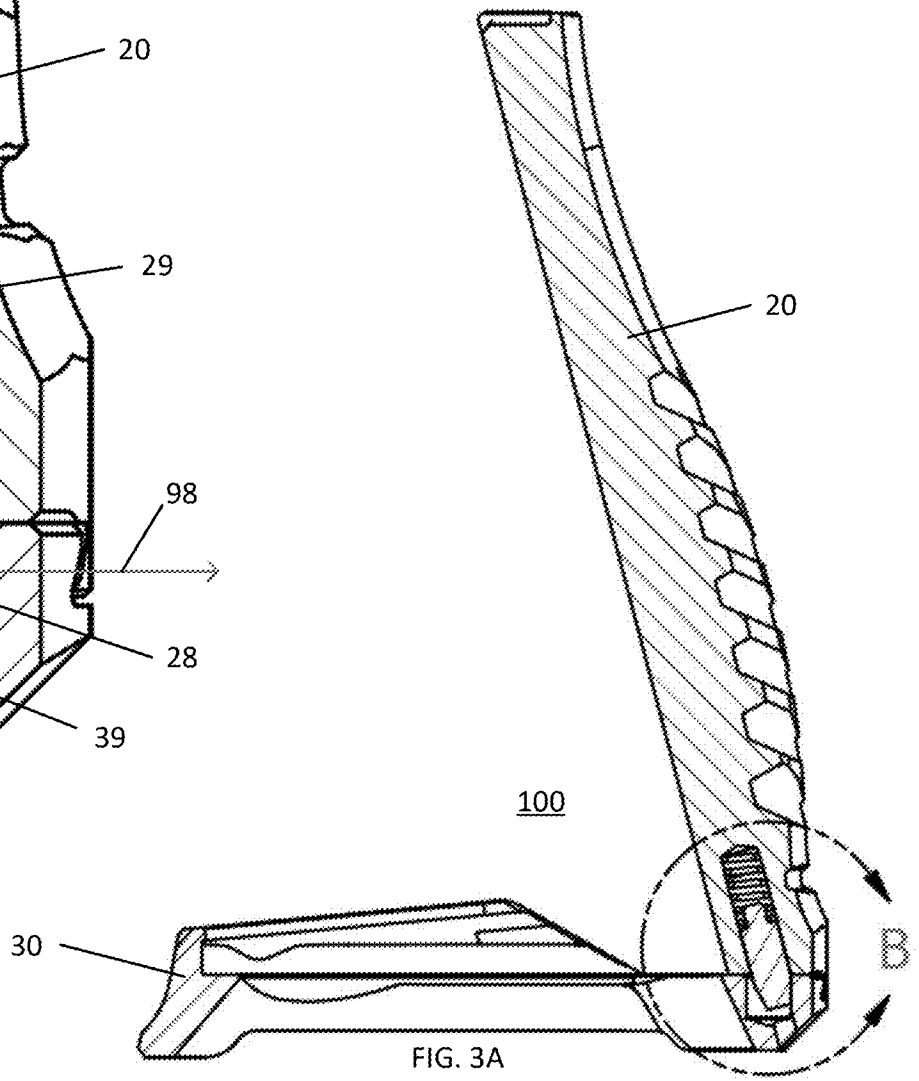
FIG. 3A illustrates a section view of the grip accessory assembly of FIG. 2A, in an assembled state, taken section line A-A.
Figure 3B:
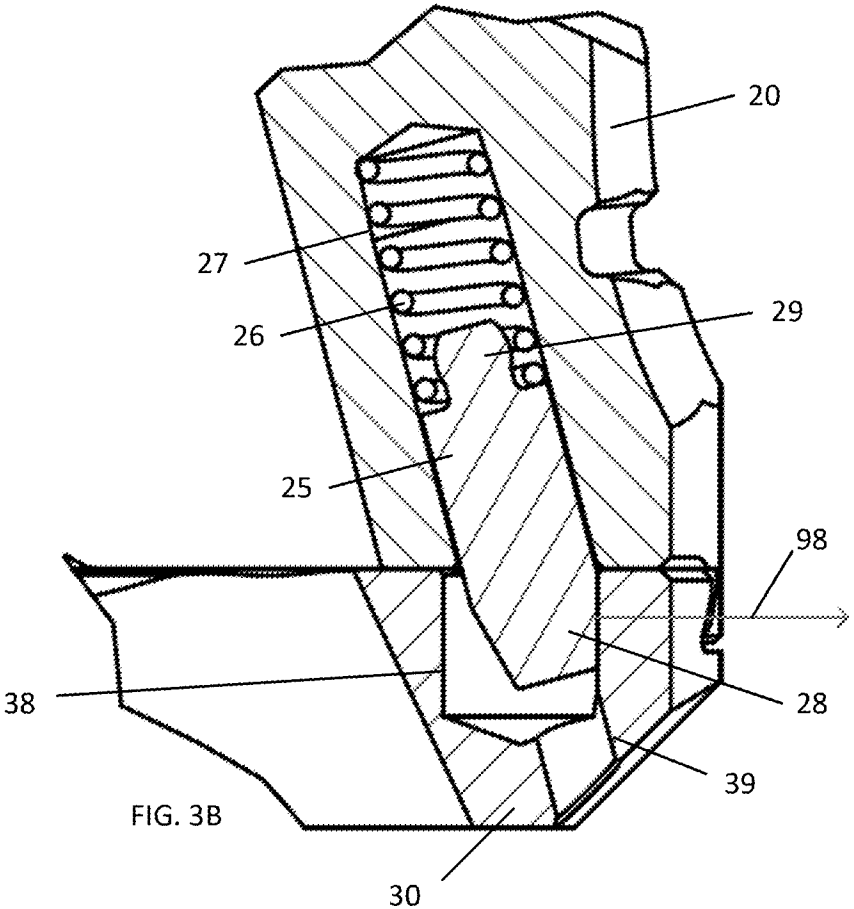
FIG. 3B illustrates a detail B of the grip accessory assembly of FIG. 3A.

Referring now to FIGS. 3A and 3B, when the spring 26 is in a default state (e.g., a state that is less collapsed than the partial collapsing needed to move the magwell 30 forward relative to the backstrap 20), part of the plunger 25 may be located in the hole 38. The hole 38 may be a bore having a vertical sidewall, but this is not required (in other examples, a hole 38 could be a faceted hole with plural flat faces, a hole having a sloped sidewall(s), etc.)

The part of the plunger 25 located in the hole 38 may include a tapered nose 28. An entire length of the taper to make contact with a sidewall of the hole 38, in some embodiments. In the illustrated embodiment, a slope of the taper may be similar to a slope of the hole 27 to provide this contact. In this example, the end of the taper nose is flat; however, this is not required (in one example, the end of the plunger 25 may have a dimple or other depression to receive a push tool inserted into the port 39). Another part of the plunger 25, e.g., an opposite end 29 of the plunger as illustrated, may have an outer diameter that is less than an inner diameter of the spring 26.

The illustrated embodiment of a firearm grip accessory assembly (e.g., magwell 30 and backstrap 20) is compatible with an original SIG P365® X MACRO® grip frame. However, other embodiments of a firearm grip accessory assembly including a magwell having an interface to mate with a corresponding interface of a backstrap may be made compatible with grip frames of any other firearm.

In the illustrated embodiment of an accessory assembly, the separable part of the modular grip assembly is a backstrap. However, in other embodiments, an accessory assembly may include any separable part, now known or later developed, that is mountable with a grip frame of a modular grip assembly.

Although the grip accessory in the illustrated embodiments is a magwell, in other embodiments any grip accessory mounting interface described herein may be used to attach any kind of grip accessory, now known or later developed, to attach to firearm grip.

In the illustrated embodiment, the spring of the plunger assembly is a metal spring. However, this is not required. In various embodiments any type of spring, now known or later developed, may be used in place of the illustrated metal spring. A spring may include any object to generate a spring force, such as any elastic object that stores mechanical energy. Also, any retention device described herein (e.g., a plunger) may be a part that is separable from a spring or may be integrally formed with the spring.

In some embodiments, a grip accessory may retain a separable part on a grip frame (e.g., prevent the separable part from sliding off the grip frame). However, this is not required. The plunger assembly described herein and/or the undercut attachment structures, or any other feature(s) described herein, can be used with a self-retaining separable part (e.g., a separable part retained on the grip frame using its own one or more rotatably driven fasteners). In self-retaining embodiments, it may be possible for the any retention system described herein to retain a grip accessory and/or redundantly retain the separable grip part.

In the illustrated embodiment modular grip assembly includes two separable parts; however, this is not required. In other embodiments, a retention system (e.g., including a spring and a plunger) may be used to retain a single part. In one example, the grip surface of the backstraps described herein may be an integral part of a grip frame. In these embodiments, the protrusion 23 (FIG. 1) and/or the hole 27 may be defined by the grip frame. A separable part having any features of any magwell described herein may be used in combination with such a grip part. This may allow a manufacturer to produce, say, a magwell that is usable with a wide variety of grip frames (e.g., grip frames that have a separable part such as a backstrap, and grip frames in which the grip surface is integrally formed on the grip frame).

Canted Retention System

Some known plunger assemblies are non-canted. For example, U.S. Pat. No. 11,747,100, granted on Sep. 5, 2023 (which is incorporated by reference herein) describes a spring loaded plunger described with respect to FIG. 4B of the '100 patent in which a center axis of the spring and/or the stud is at a right angle with an axis along with the retained part that is slidingly removed (e.g., a center axis of the removable cap described with respect to FIG. 4B of the '100 patent).

Referring again to FIG. 3B of the present application, a canted retention system is used. As illustrated in FIG. 3B, a center axis of the retention system including the spring 26 and the retention device 25 forms an oblique angle with an axis along which at least one of the retained parts (e.g., magwell 30) is slidingly removed. Stated another way, in FIG. 3 the magwell 30 moves along a horizontal axis of the illustration, whereas the plunger assembly moves along an axis that is tilted with respect to a vertical axis of the illustration. A center axis of the hole 27 is also at an oblique angle relative to a center axis of the opening 38 that receives the tapered nose 28.

The tapered nose 28 may have a shape of a truncated cone. As the retained part (e.g., the magwell 30) is pushed along its axis of movement (e.g., along a horizontal axis in this embodiment) by an operator's force, the truncated cone shaped section of the retention device is urged by the spring force into the hole 38. However, the hole 38 has a non-sloped sidewall (e.g., a shape of a cylinder), so the truncated cone shaped section moves downwardly until line contact is provided between the sloped surface of the truncated cone and the non-sloped sidewall of the hole 38 (e.g., a cylindrically shaped bore in this example).

The line contact urged by the canted spring force in turn provides a rearward contact force that urges the retained part (e.g., magwell 30) in a rearward direction (e.g., orthogonal to the center axis of the bore 38, as shown by arrow 98). Furthermore, since the only contact is on a single side (e.g., a rearward sidewall) of the opening 38, all the contact force is in one direction (e.g., a rearward direction in this example). Essentially, once a user pushes the retained part 30 into the illustrated position, the retained part 30 is locked into place. Referring to FIG. 1, this locates the front part of the lip 17 in the front part of the groove 16. This may eliminate the highly noticeable slight "play" that is present in other retention arrangements used in recoil environments (in which a front part of lip on the separable part may not completely locate within a front part of a mating groove on the grip frame even when other parts of the lip are completely located in the mating groove).

Even if the user does not push the retained part 30 all the way (e.g., a few thousands of an inch short), any forward force applied to the separable part will not move the separable part relative to the base due to the plunger. Optimally, any rearward force applied to the separable part during operation or carry will allow the plunger 35 to be urged further into the opening 38, further engaging the retention system and thus further seating a front part of the lip 17 into a front part of the groove 16.

A groove and lip are not required to use the canted retention system described herein. In other embodiments, a base part (e.g., a grip frame) may have a flared section where the separable part may have a ledge to mate with the flared section. The canted retention system may be used in combination with any interface (e.g., an interface for sliding coupling parts), now known or later developed.

A retention system including at least the features of the tapered retention device and the canted spring force described above can be used in any recoil environment to retain one part to another part without requiring a threaded rotatably driven fastener.

Grip Attachment Usable in Modular and Non-Modular Firearm Assemblies

When a firearm provides a modular grip assembly, such as a firearm including a backstrap described with reference to FIG. 1, a threadless region for attaching a grip attachment thereon may be provided on the modular attachment. For example, in the embodiment described in FIG. 1, a slideable attachment interface is provided on the modular attachment (e.g., a protrusion 23 is provided on the backstrap 20, in the illustrated embodiment). A grip attachment (e.g., magwell 30) can then be used in combination with the existing frame (which may be an original frame or an aftermarket frame that is similar to the original frame).

One approach for providing a grip attachment usable with "non-modular" frame would be to replace the existing frame with a new design that incorporates a slideable attachment interface. For instance, it may be possible and practical to provide a new frame that includes a slideable attachment interface similar to the slideable attachment interface of the backstrap 20 of FIG. 1. However, it may be desirable to allow users to utilize a grip attachment in combination with their original frame.

Some embodiments described herein provide a grip attachment that may be used with a wide variety of grip assemblies (e.g., usable with a non-modular frame and any other type of non-modular firearm part). In this approach, a kit of parts may be provided, which allows a user to utilize a grip attachment in combination with an existing frame (even in cases where the existing frame does not have modular features).

Figure 13B:
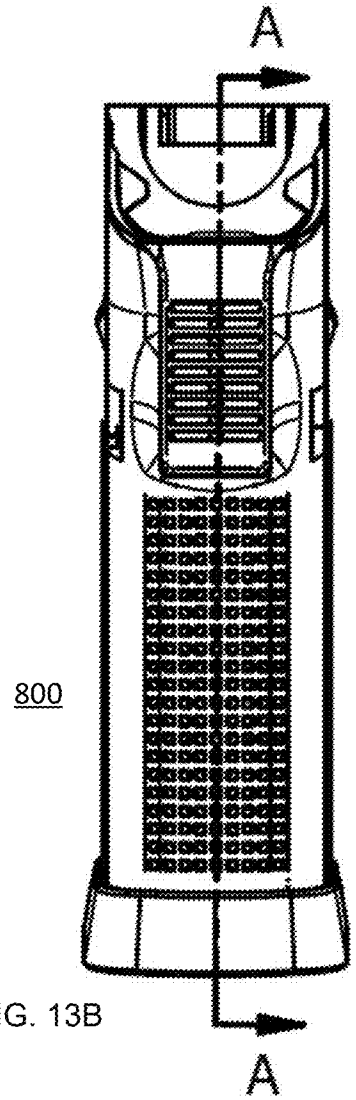
FIGS. 13A and 13B illustrate, respectively, side and rear views of the assembly of FIG. 8A.
Figure 13A:
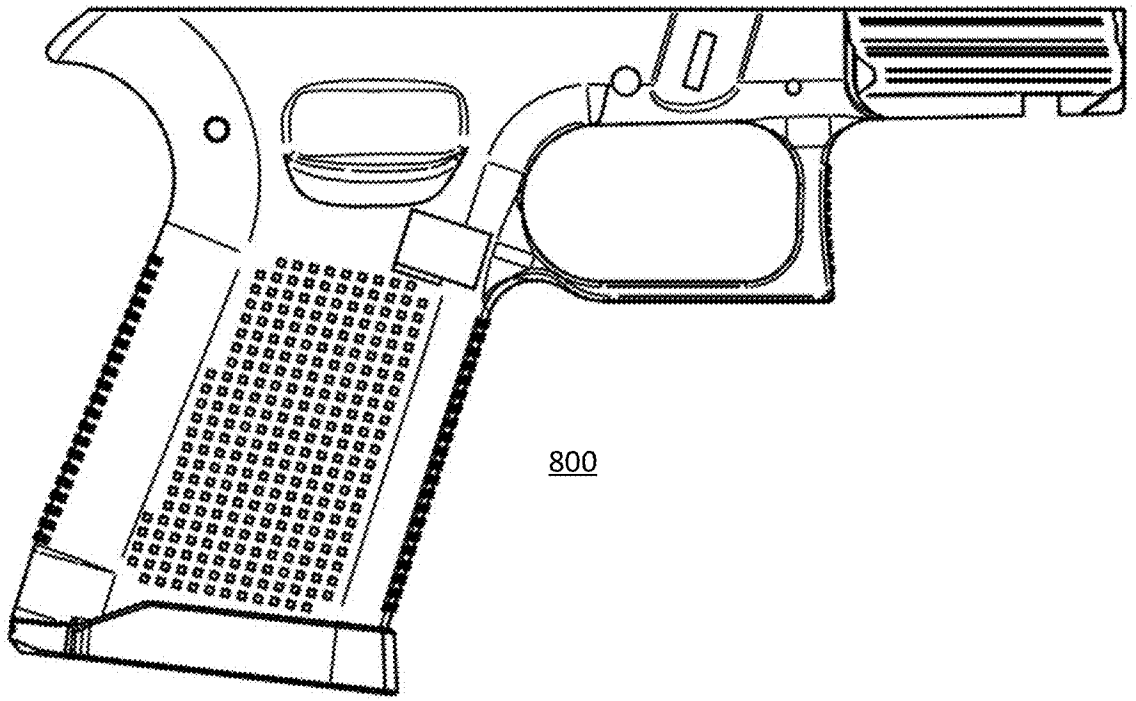
Figure 13C:
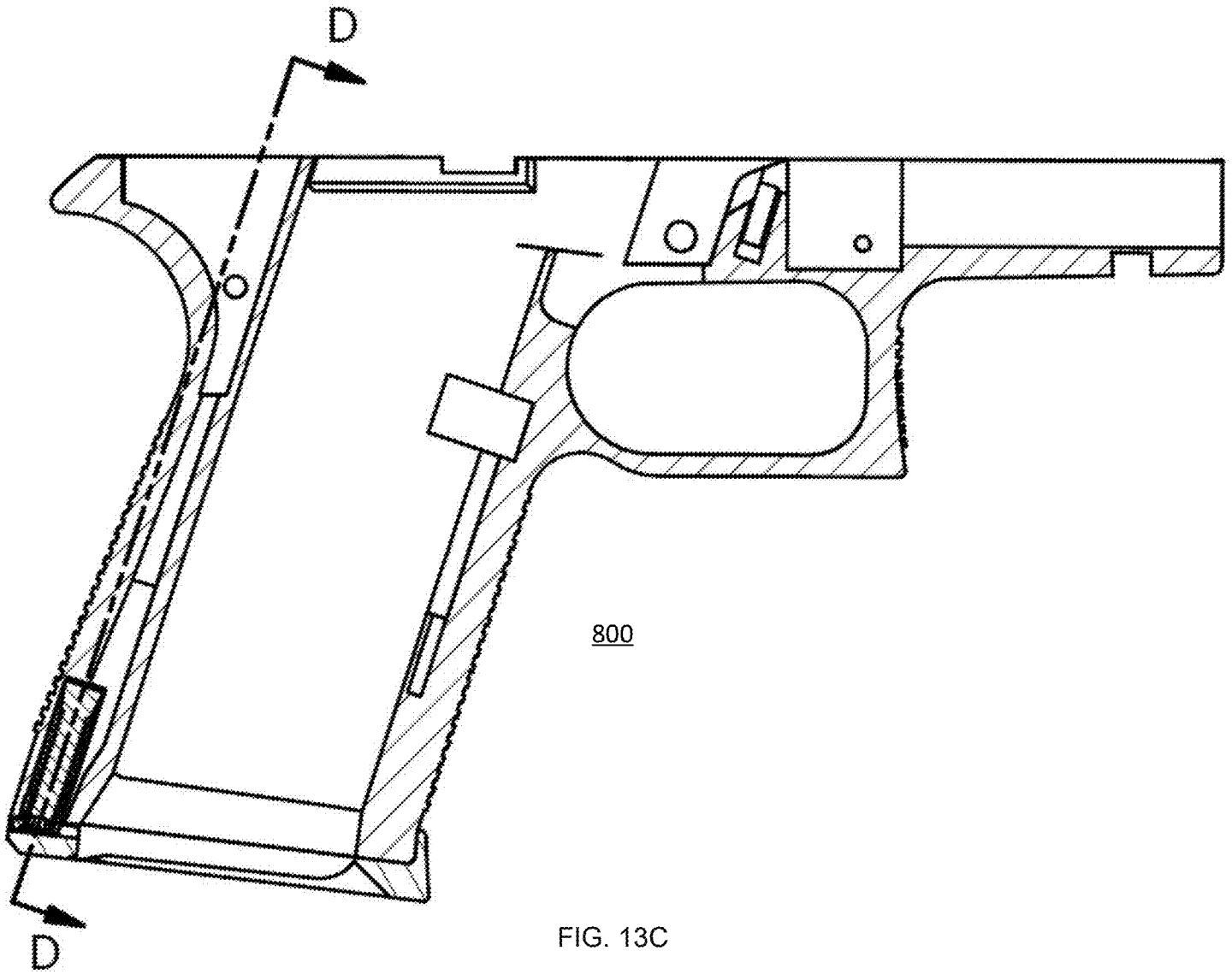
FIG. 13C illustrates a section view taken along section line D-D of FIG. 13B.
Figure 13E:
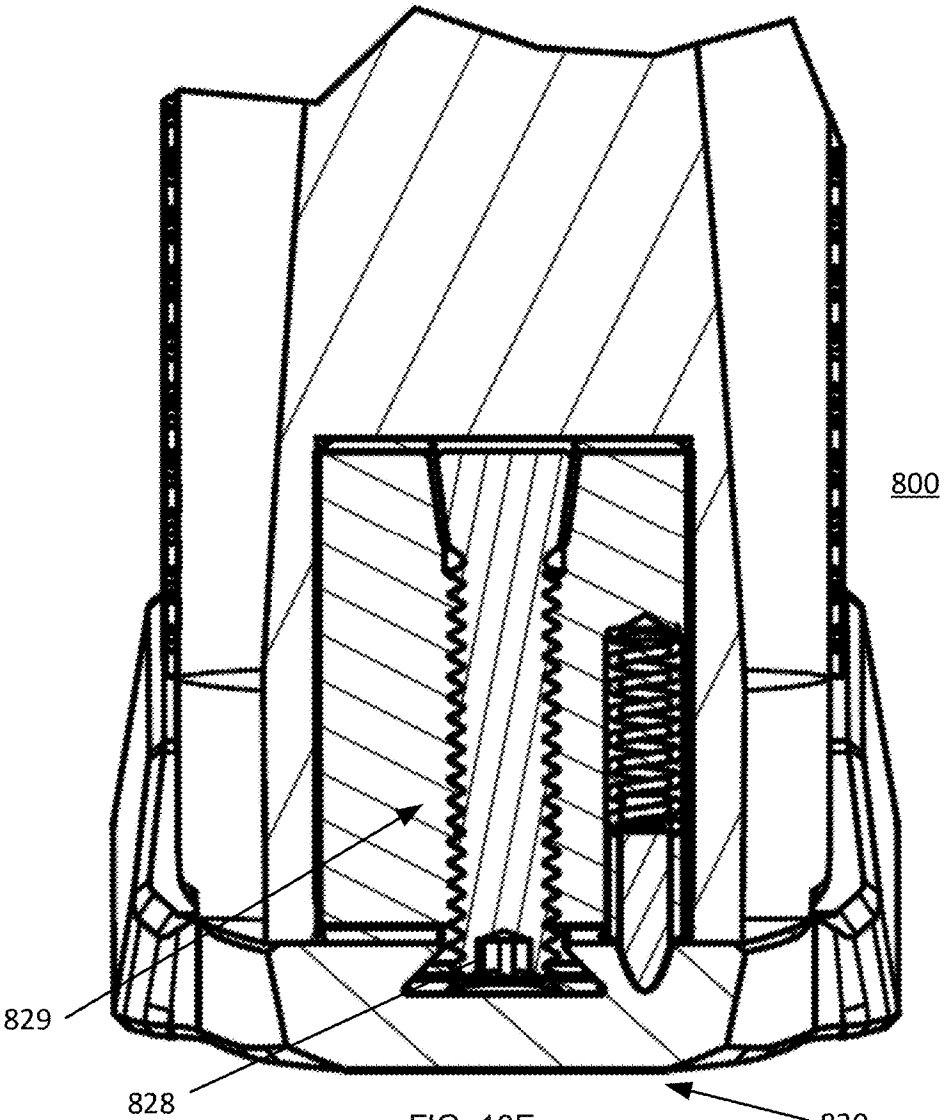
FIG. 13E illustrates a detail E of the section view of FIG. 13D.

Referring briefly to FIG. 13E, a frame without modular features has been retrofitted to include a slideable attachment interface, similar to the slideable attachment interface on the backstrap 20 of FIG. 1. In various embodiments described herein, this retrofit can be completed without drilling, damaging, or otherwise altering the existing frame. Also, in various embodiments a part including the slideable attachment interface may be removably coupled to the existing frame, e.g., a user can couple and uncouple the part including the slideable attachment interface without adhesives, without damaging the existing frame, and/or without damaging the that includes the slideable attachment interface.

It is known that molding, casting, and other manufacturing techniques used to form parts, have various process requirements to ensure a well-formed part (e.g., a well-formed molded part, a well-formed casted part, etc.) These process requirements may include a maximum thickness of material. For example, if a manufacturer attempts to manufacture a frame using molding, the manufacturer ought to provide design features that avoid thick volumes of material. Typically, this is accomplished by providing a hollow. Also, generally speaking, a part that is formed may have one or more other process artifacts of the formation process, such as tool openings to remove manufacturing tooling (e.g., an opening through which the core is pulled out during manufacturing).

It is known that many existing frames typically include at least one of these process artifacts. For instance, looking at the bottom of some frames, one will see, rearward of the magazine well, a D-shaped opening, and a thin wall of material between the D-shaped opening and the magazine well. This "hollow" was provided by the manufacturer's original design to address molding process requirements, and as such it may be referred to herein as a molding process artifact.

Various embodiments described herein provide a kit of parts, which include an expandable body to wedgingly install in a hollow or other process artifact of an existing part such as a frame. This expandable body may provide a point of attachment for a slideable attachment interface, such as a female dovetail or corresponding male feature, a female T-slot or corresponding male feature, or some other undercut opening or corresponding male feature.

The frame having the expandable body installed therein may have one or more threadless regions, including the expandable body's threadless region having the slideable attachment interface. These one or more threadless regions may be used to couple a grip attachment, such as a magwell having a threadless region, to the frame. Due to the use of the threadless regions, like other embodiments described herein, the grip attachment (e.g., the magwell) may remain fixably attached over time (e.g., may not loosen over time as recoil forces are transmitted into the grip frame as well as into other components of the grip assembly, as is observable with some known magwells).

Figure 8A:
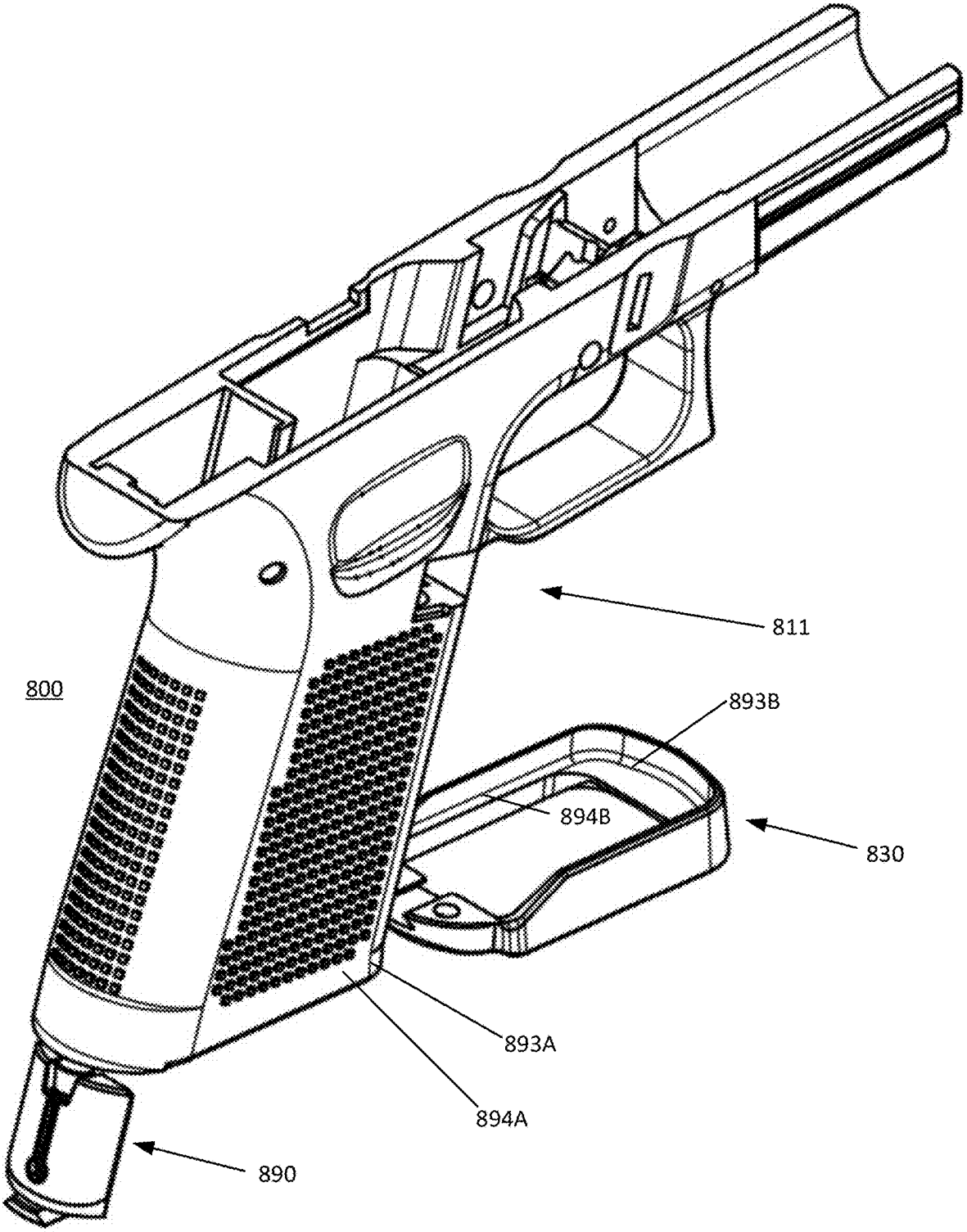
FIG. 8A illustrates an exploded isometric view of another assembly, including a grip attachment (e.g., a magwell) and an expandable body, according to various embodiments.
Figure 8B:
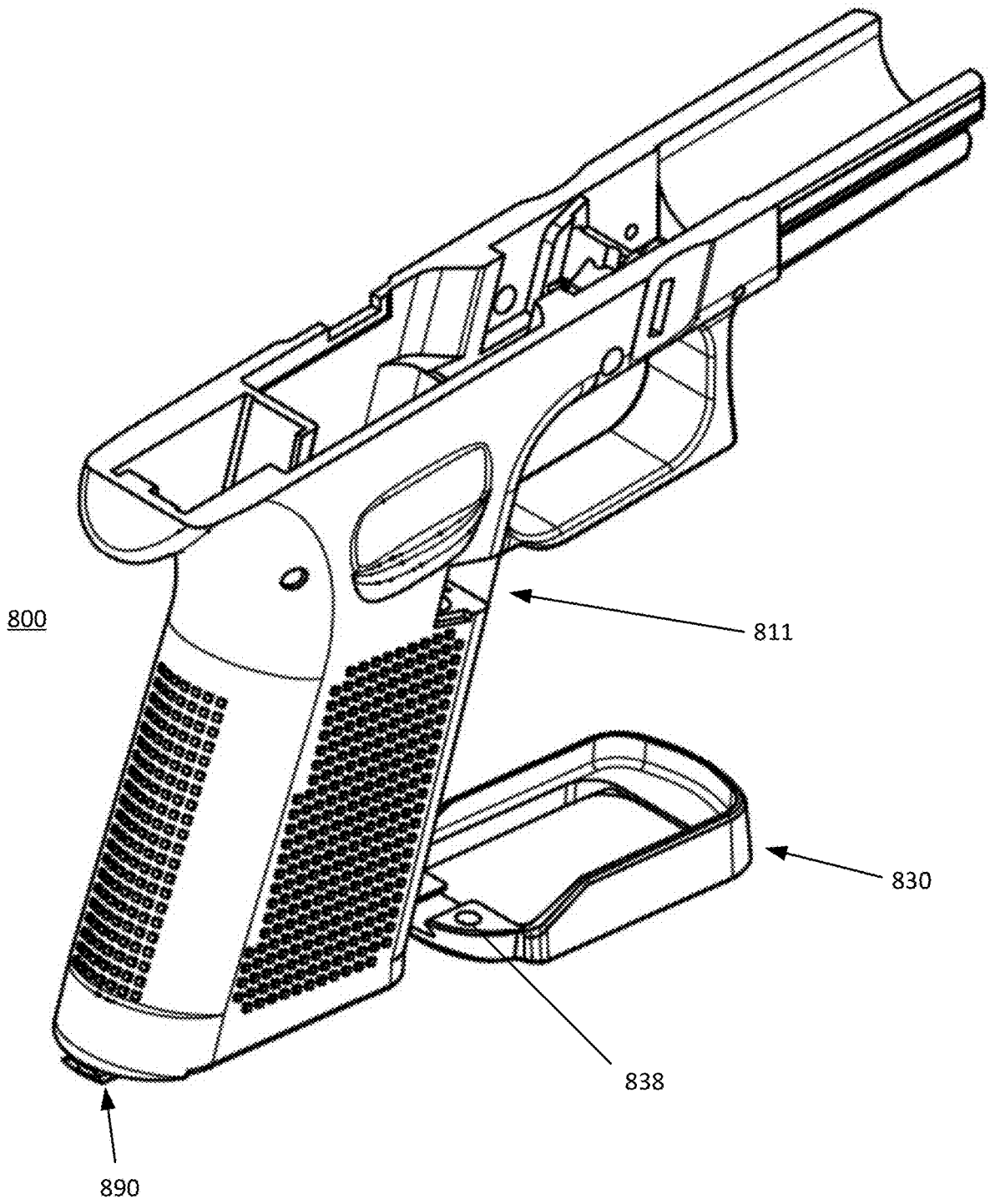
FIG. 8B illustrates an isometric view of the assembly of FIG. 8A, with the grip attachment separated therefrom.

In the embodiment illustrated in FIGS. 8A and 8B, the assembly 800 includes a grip attachment 830 (e.g., a magwell) retained on a grip part 811 using an expandable body 890 (FIG. 8A illustrates an exploded isometric view of the assembly 800, and FIG. 8B illustrates an isometric view of the assembly 800 with the grip attachment 830 separated therefrom).

Figure 9:
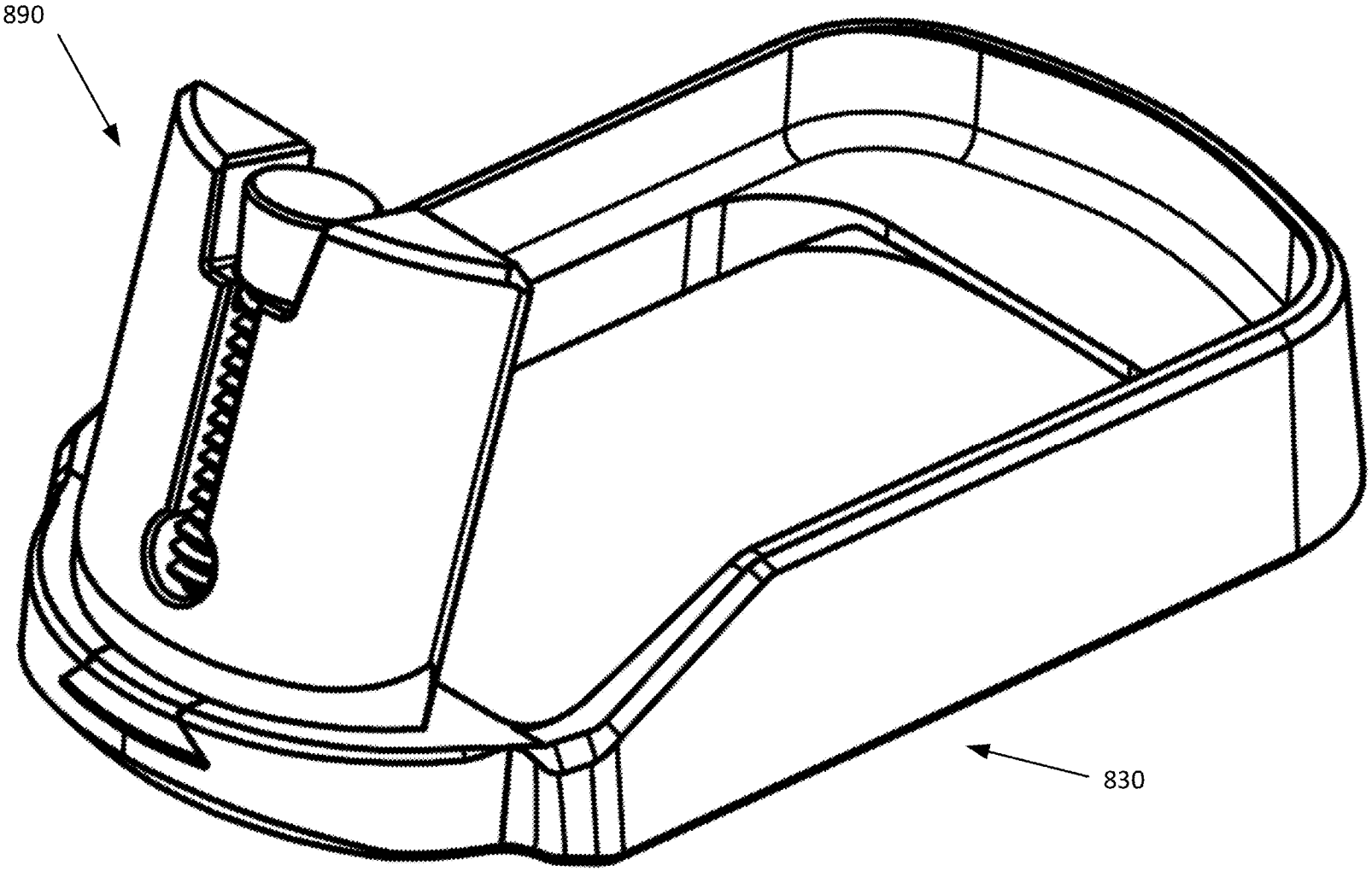
FIG. 9 illustrates an isometric view of the grip attachment of FIG. 8A, with the expandable body removably coupled thereto.

Referring to FIG. 8B, to attach the grip attachment 830 (e.g., the magwell) to the frame 811, an operator/installer may removably couple the expandable body 890 to the frame 811. Then, the operator/installer may slide the grip attachment 830 onto the frame 811 (the frame 811 and the grip attachment 830 may have a sliding attachment interfaces similar to any sliding attachment interfaces described herein). Once the grip attachment 830 is slid on (e.g., into a predefined position), a plunger similar in any respect to any plunger described herein may drop into the plunger into a plunger engagement hole 838 defined by the grip attachment 830. FIG. 9 illustrates an isometric view of the assembly of FIG. 8 in an assembled state without showing the frame 811 (FIG. 8B) for case of illustration.

To remove the grip attachment 830 (e.g., the magwell), an operator/installer may insert a tool into a tool port (which may be similar to the tool port described with reference to FIG. 3B herein, but is not visible in the views of FIGS. 8A-B), which allows the operator/installer to slidably remove the grip attachment 830 off the frame 811. The operator/installer may also uninstall the expandable body 890 from the cavity, if desired, using opposite steps as installation.

Figure 10A:
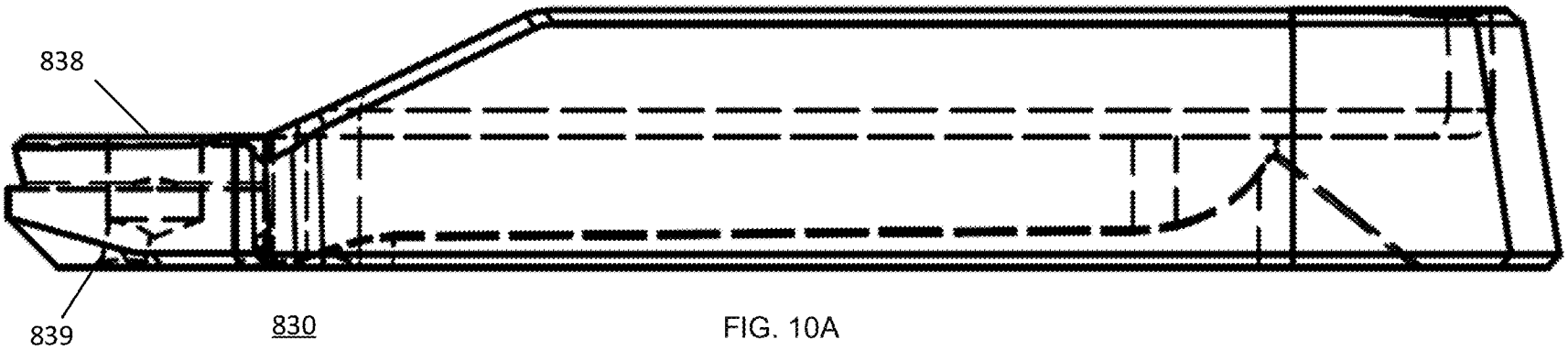
FIG. 10A illustrates a side view of the grip attachment of FIG. 8A.
Figure 10B:
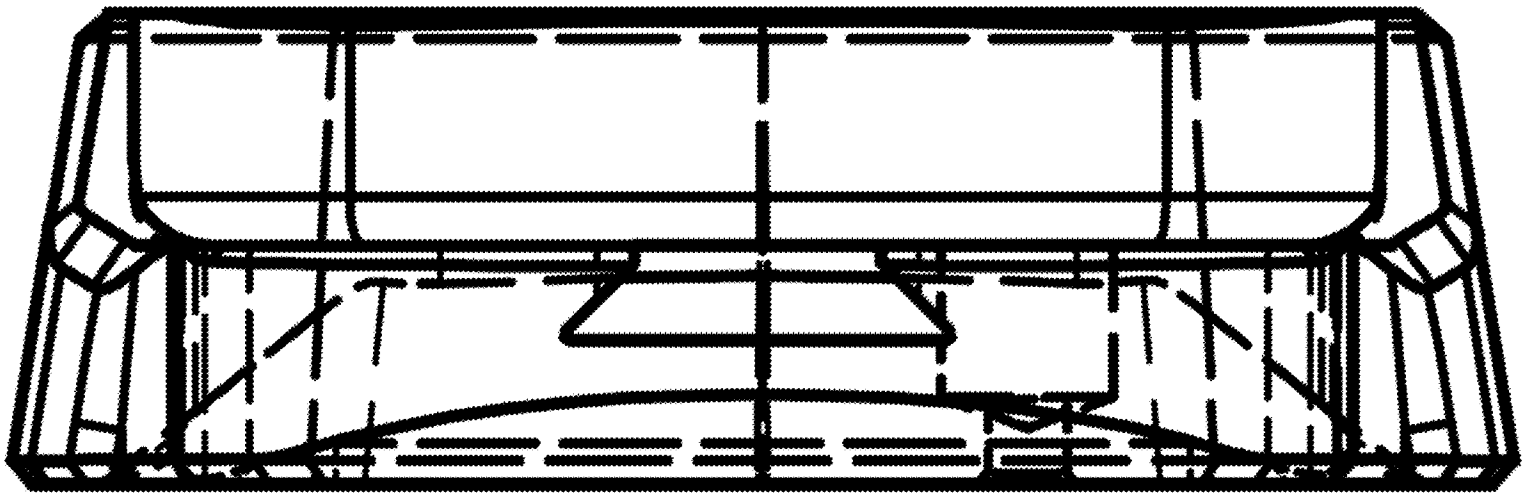
FIG. 10B illustrates a rear end view of the grip attachment of FIG. 8A.

FIG. 10A illustrates a side view of the grip attachment 830 of FIG. 8A. FIG. 10B illustrates a rear end view of the grip attachment 830 of FIG. 8A. The tool access port 839 is illustrated in FIG. 10A. In this example, the tool access port 839 is canted at an angle similar to a cant of any canted retention system described herein. However, the tool access port 839 may be canted in a different amount, or not canted, in other examples.

Figure 11A:
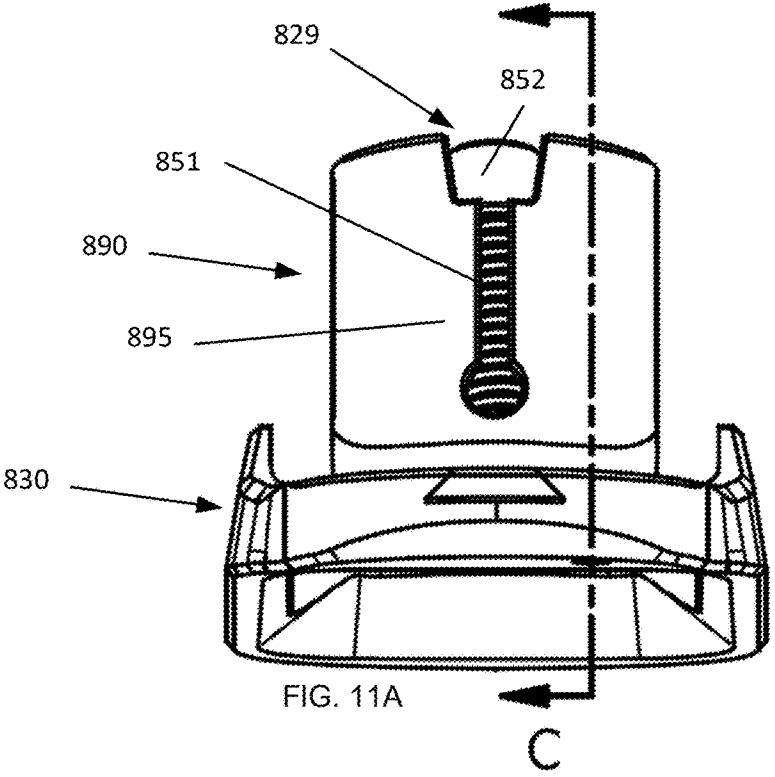
FIG. 11A illustrates a rear end view of the grip attachment illustrated in FIG. 9, in which the expandable body is coupled thereto.
Figure 11B:
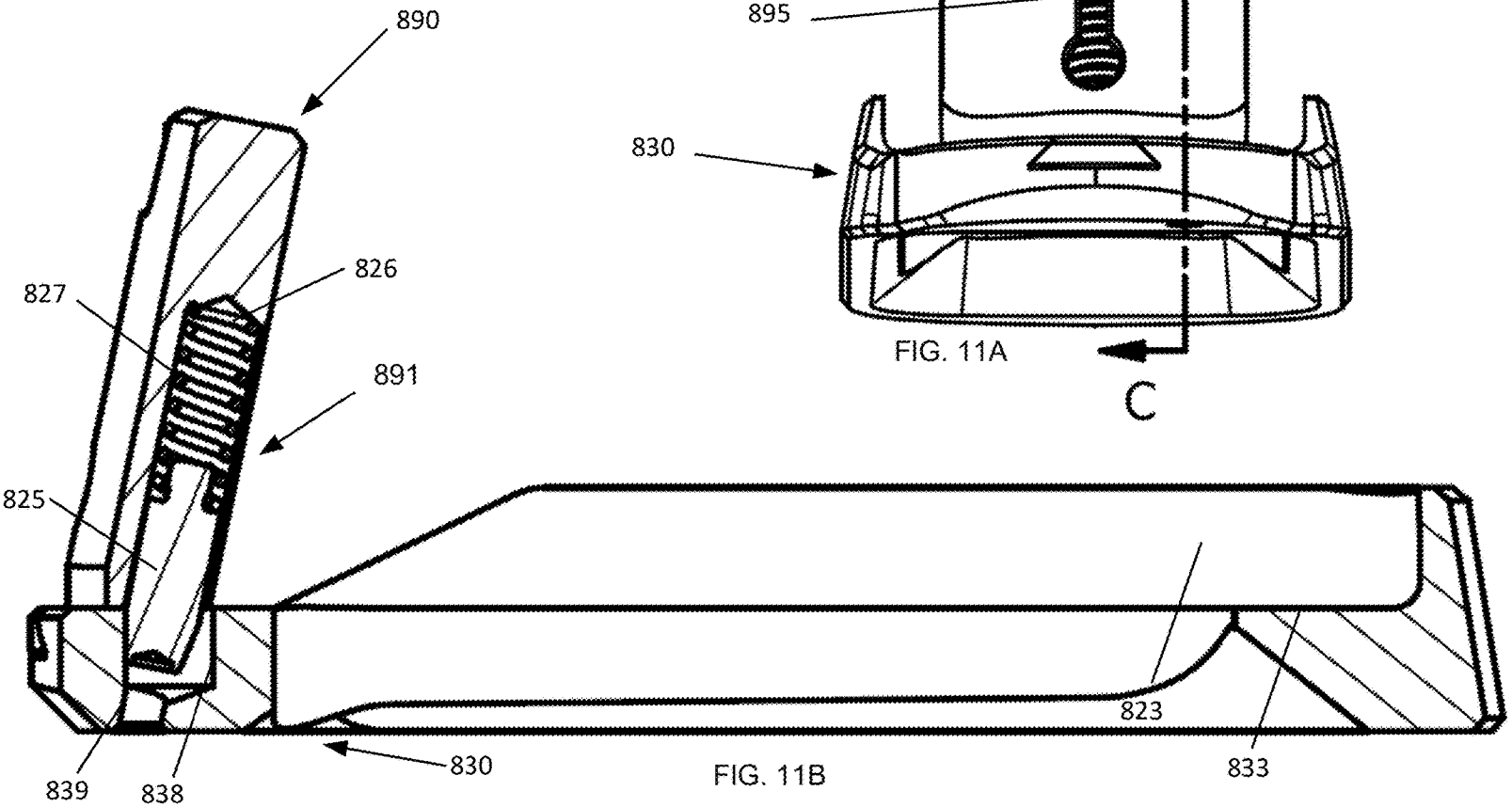
FIG. 11B illustrates a section view taken along section line C-C of FIG. 11A.
Figure 12B:
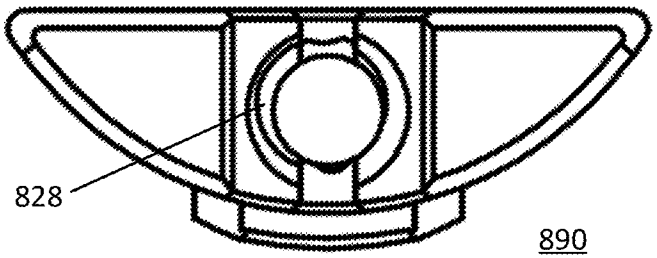
FIGS. 12B and 12C illustrate, respectively, top and bottom views the expandable body of FIG. 12A in isolation.
Figure 12C:
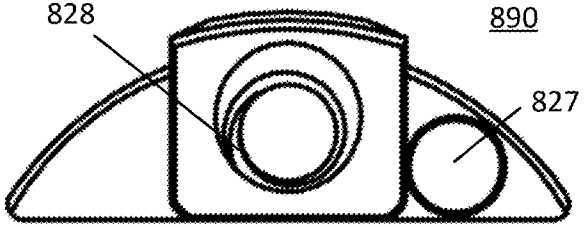
Figure 12A:
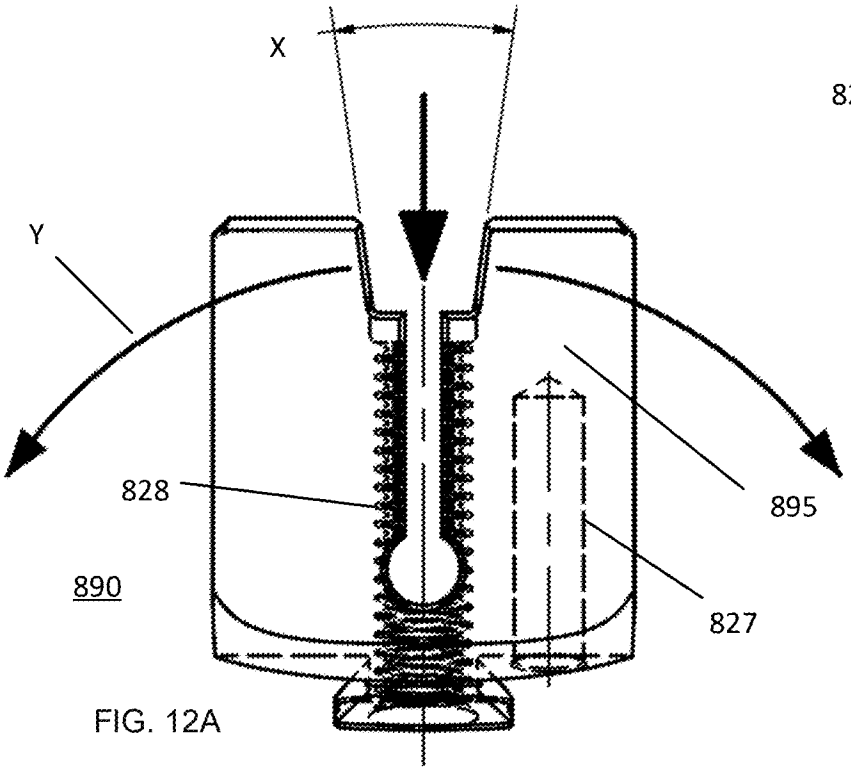
FIG. 12A illustrates a back side view of a body of the expandable body of FIG. 8A.

FIG. 11B illustrates a section view taken along section line C-C of FIG. 11A. FIG. 12A illustrates a back side view of the expandable body 890 of FIG. 8A. In this illustration, a canted retention system 891 is shown. This canted retention system 891 may be similar in any respect to any canted retention system described herein, and may include retention system cavity 826 for the spring 827 and the plunger 825. An engagement section of the plunger 825 may be located in the retention engagement hole 839 when the grip attachment 830 is installed onto the frame (not shown). The entire plunger 825 may be located in the retention system cavity 826 before the grip attachment 830 is slide into the predefined position.

Referring now to FIG. 11A, the expandable body 890 may carry a rotatably threaded retention part 829 having a threaded section 851 and a wedge section 852 to open up an expanding part 895 of the expandable body 890 when the rotatably threaded retention part 829 is tightened. In this embodiment, the wedge section 852 is in the form of a head. A drive section (not shown) of the rotatably driven part 829 may be on an opposite end of the rotatably threaded retention part 829 as the wedge section 852. The rotatably threaded retention part 829 is shown in more detail in FIGS. 14A and 14B, where it can be seen that a drive section 828

(e.g., a socket for a socket tool) is located on a bottom of the rotatably threaded retention part 829 (opposite the wedge section 852).

The tapered head 852 provides a self-locking function, besides providing the wedging function. As described in more detail in the '451 application, a tapered head of a rotatably-driven retention part (e.g., a screw) may prevent the rotatably-driven part from backing out over time due to recoil forces. Although the tapered head 852 may be sufficient to prevent the threaded length 852 from backing out over time to recoil forces, it may be possible and practical to also utilize additional self-locking features, such as the self-locking threads described in the '451 application, instead of, or in addition to, a tapered head.

With reference again to FIG. 8A, often frames include one or more contour features, such as flare out at the bottom and/or a front lip, for reasons that may be entirely separate from attaching a grip attachment. In various embodiments, at least one of these contour features may be utilized as one of the threadless regions. In this illustration, the one or more contour features include the front lip 893A and the side flares 894A (only one of the side flares 894A is observable in this view). The grip attachment 830 (e.g., the magwell) includes an interior sections 893B and 894B (e.g., channels, pockets, or the like) to receive the front lip 893A and the side flares 894A, respectively, when the grip attachment 830 is in the predefined position (where the plunger engagement occurs). This additional attachment interface does not utilize any threads, does not require a new frame, and contributes to retention of the grip attachment 830 on the frame 811 (e.g., operates with the dovetail, T-slot, or other undercut interface to retain the grip attachment 830 on the frame 811).

FIG. 12A illustrates a back side view of a body 895 of the expandable body of FIG. 8A, in isolation. FIGS. 12B and 12C illustrate, respectively, top and bottom views of the expandable body of FIG. 12A, in isolation. In these views, one can observe a threaded through opening 828 to receive the threaded section of the rotatably driven part 829, and a tapered opening to receive the wedge section 852 of the rotatably driven part 829. In this example, the value 'X' may be 16 degrees, but in other embodiments the value X may be any value to provide loosening resistance from recoil, or any other value.

The arrows Y illustrate how the expanding section 895 may open up (by flexing) as the tapered head 852 is driven into the tapered opening. A control feature (e.g., the illustrated circular opening and/or the illustrated elongated opening) may allow the expanding section 895 to expand with less total force, and/or may restrict or prevent another section of the expandable body 890 from expanding.

Figure 13D:
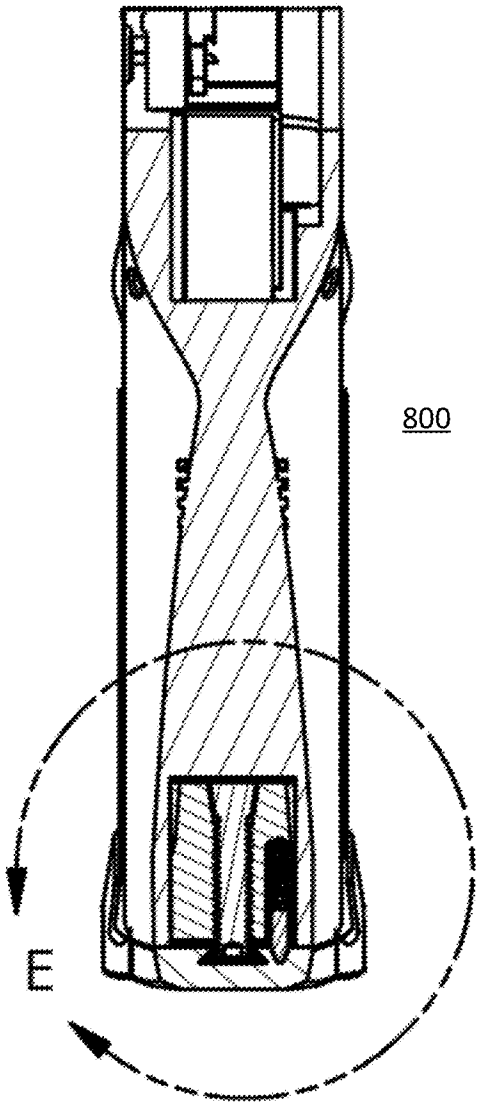
FIG. 13D illustrates a section view taking along section line E-E of FIG. 13C.
Figure 14B:
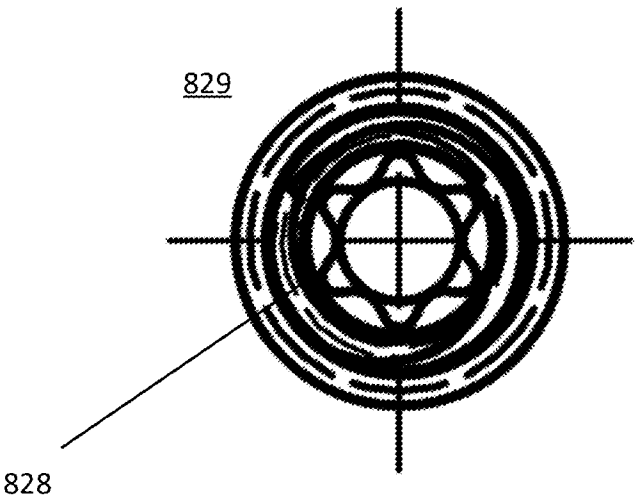
FIGS. 14A and 14B illustrate, respectively, side and bottom views of the retaining part of FIG. 8A.
Figure 14A:
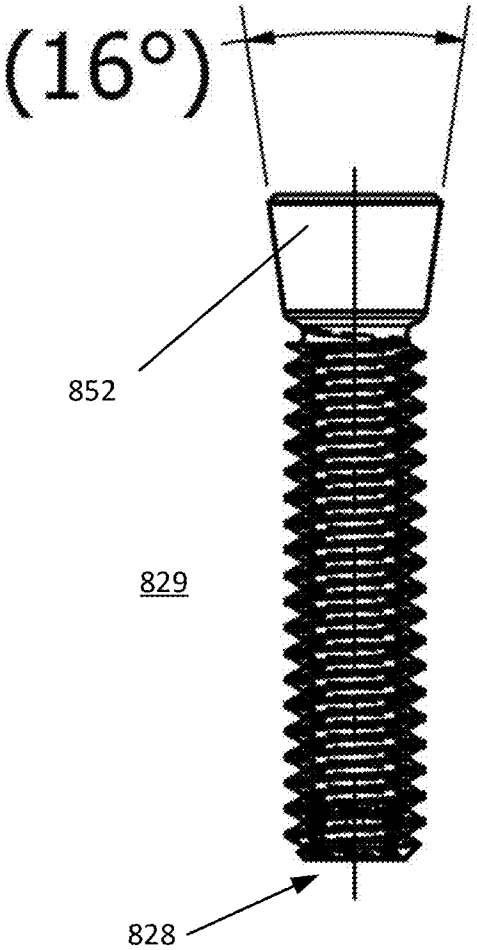

FIGS. 13A and 13B illustrate, respectively, side and rear views of the assembly 800 of FIG. 8A. FIG. 13C illustrates a section view taken along section line D-D of FIG. 13B. FIG. 13D illustrates a section view taking along section line E-E of FIG. 13C. FIG. 13E illustrates a detail E of the section view of FIG. 13D. FIGS. 14A and 14B illustrate, respectively, side and bottom views of the retaining part 829 of FIG. 8A.

Referring to FIG. 13E, unlike some known grip assemblies in which an end (e.g., a driving end) of at least one rotatably driven fasteners is exposed (e.g., at least one screw head is exposed), restricting where grip features may be placed by a designer (if the designer does not want to accept the discomfort of co-locating grip features and exposed rotatably driven fastener surfaces), the ends of the rotatably driven fastener 829 are not exposed. In particular, a driving feature 828 corresponding to a drive section of the rotatably driven (e.g., a socket opposite the head end of the rotatably driven fastener 829) is not exposed. In this example, the grip attachment 830 covers the rotatably driven fastener 829 (e.g., covers the driving feature 828).

Referring to FIG. 14A, the rotatably driven fastener 829 is shown in isolation. It includes the wedge section 852, and the drive section 828. In this embodiment, the threaded length of the rotatably driven fastener 82 is located between the wedge and drive sections 852 and 828, but this may not be required in other embodiments.

Figure 15:
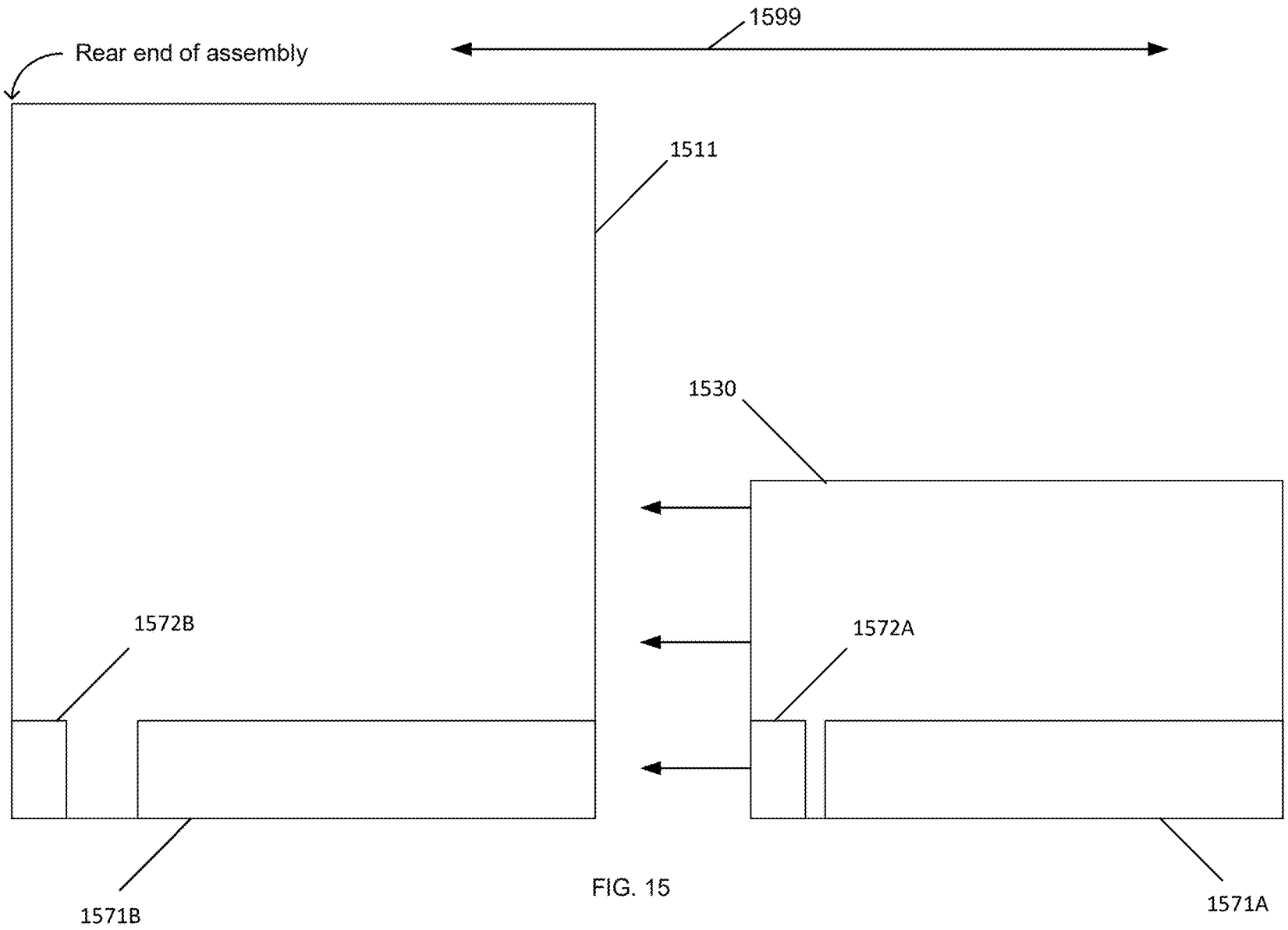
FIG. 15 is a schematic diagram illustrating an attachment for a recoil environment (e.g., a grip attachment) having a slideable attachment interface to restrict coupling movement of the attachment to longitudinal movement (e.g., fore/aft movement) and an additional interface to restrict a longitudinal position (e.g., fore/aft position) of the attachment, according to various embodiments.

FIG. 15 is a schematic diagram illustrating an attachment 1530 for a recoil environment (e.g., a grip attachment, an optic adapter, an optic sight, etc.) having a slideable attachment interface 1571A to restrict coupling movement of the attachment 1530 to longitudinal movement (e.g., fore/aft movement and/or axial movement) and at least one additional interface 1572A to restrict a longitudinal position (e.g., fore/aft position and/or an axial position) of the attachment 1530, according to various embodiments.

The attachment 1530 may be similar in any respects to any attachment described herein (e.g., any magwell described herein, any optic adapter described herein, any optic sight described herein, etc.) The device 1511 may be any part to operate in a recoil environment, such as:

- An assembly having modular grip features, for example, with reference to FIG. 1: the assembly of the frame 11, a modular grip part (e.g., the backstrap 20), etc.;
- An assembly including an existing frame, which may be non-modular or modular, retrofitted using a kit of parts, such as one including an expandable body similar in any respect to any expandable body described herein, or some other kit of parts for retrofitting an existing frame;

One or more parts with or without modular grip features, for example, a new frame having a slideable attachment interface similar to any slideable attachment interface described herein, in which the slideable attachment interface is integrally formed on the new frame, removably coupled to the new frame, non-removably coupled to the new frame, or the like;

- An assembly including a part to receive an optic sight, such as a slide or other part of a firearm (the slide may be deeply recessed as described herein, but this is not required); and/or
- Some other assembly or part, now known or later developed, to operate in a recoil environment.

The attachment 1530 may include a slideable attachment interface 1571A and at least one additional interface 1572A. The slideable attachment interface 1571A may restrict a coupling movement of the attachment 1530 relative to the device 1511, to longitudinal movement (e.g., fore/aft movement). For instance, an axis 1599 may be a bore axis of a firearm, which of course may extend from a muzzle end of the firearm to an opposite end of the firearm. The longitudinal movement may be parallel to axis 1599, and in the illustrated embodiments the attachment 1511 may be slid rearwardly for attachment and forwardly for removal (such as with a magwell), or slid forwardly for attachment and rearwardly for removal (such as with an optic adapter or an optic sight). In other embodiments, the longitudinal movement may be along an axis that may be not parallel with the bore axis, for example, an axis along any plane.

The at least one additional interface 1572A may restrict a longitudinal position (e.g., a fore/aft positon or other axial position) of the attachment 1530 relative to the device 1511. The at least one additional interface 1572 may include part of any retention system described herein.

In some examples, the retention system may be a canted retention system similar in any to the canted retention systems described herein, or some other retention system similar to any retention system described herein. In these examples, the canted retention system, or other retention system, may include a plunger or other retaining and a spring to urge the plunger or retaining part into hole and/or or against an engagement feature. The plunger or other retaining part may travel along a path of movement that is at an oblique angle with respect to the plane and/or the longitudinal movement of the attachment 1530. When the longitudinal movement of the attachment 1530 is parallel with the axis 1599, the path of movement may also be at an oblique angle with respect to the axis 1599.

The device 1511 may have a slideable attachment interface 1571B operable with the slideable attachment interface 1571A. In various examples, one of these interfaces 1571A-B may include an undercut opening (e.g., a female dovetail, T-slot, or other undercut opening now known or later developed) and the other of these interfaces 1571A-B may include a protrusion receivable by the undercut opening (e.g., a male dovetail, T-slot, or other male feature receivable by the undercut opening).

The device 1511 may have an additional interface 1572B operable with the slideable attachment interface 1572A. In various examples, one of these interfaces 1572A-B may include a retention system cavity to hold any retention system described herein, and the other of these interfaces 1571A-B may include a hole or other engagement feature that a plunger or other retaining part of the retention system may engage to restrict a longitudinal position or other axial position of the attachment 1530 relative to the device 1511. Although it is not shown in this schematic illustration, the attachment 1530 of course may have any other additional interface described herein, such as the openings (e.g., channels or pockets) to receive one or more contour features, or some other part, of the device 1511. The one or more contour features may be original features of the device 1511. A spring-biased part (e.g., a plunger) is not required—other embodiments may use some other part such as a threaded part (e.g., a bolt, a nut, or the like).

In some examples, the device 1511 may be a part of a firearm without modular features (e.g., without modular grip features), such as a frame, or may be an assembly of a firearm with modular grip features, such as an assembly of a frame and a backstrap. When the device 1511 includes an expandable body (removably or otherwise attached thereto, for retrofitting the frame or some other reason) a rotatably driven part with threading may drive expansion of an expanding section of the expandable body. However, a drive section of that rotatably driven part may be covered by the attachment. Also, the rotatably driven part may be include a tapered head, or some other tapered section, to prevent the rotatably driven part from loosening due to recoil forces (and/or may include self-locking threading)

When the device 1511 includes modular features, it may be preferable to retrofit by providing a new modular part that defines the retention system cavity or hole/engagement feature. For instance, referring to the embodiment illustrated in FIG. 1A, the frame 11 may be provided with the backstrap 20, which provides a retention system cavity 27 or hole/engagement feature. This enables the original based component (e.g., the frame 11) to be retained in the firearm. However, this is not required—in various examples any expandable body described herein may be used in combination with a modular grip assembly in order to keep a preexisting modular part (such as a preexisting backstrap).

As mentioned previously, when the device 1511 does not include modular features, there may be no modular part. It may of course be possible to simply replace the original frame to provide a retention system cavity or hole/engagement feature integrally formed, or otherwise include on a new frame. However, when the original frame is manufactured by molding or casting, it may be possible to retain the original frame. For instance, some frames include a magazine well and a D-shaped hole, separated by a thin wall (e.g., part of the magazine well may be defined by a forward side of the thin wall and part of the D-shaped hole may be defined by a rear side of the thin wall). The frame 811 illustrated in FIG. 8A is one such example (one or ordinary skill in the art would be familiar with this D-shaped hole, even though it is not shown in this view). This D-shaped hole is an artifact (e.g., a molding process artifact) because its existence is driven by molding process requirements (the D-shaped hole's original purpose was to avoid molding defects).

This molding artifact may be enable utilization of the attachment 1530 in combination with the original frame. In particular, a body defining a retention system cavity or hole/engagement feature may be mounted into this D-shaped hole. In the embodiment illustrated in FIG. 8A, the body 890 is wedgably couple to the frame 811 by inserting the body 890 in the D-shaped hole and then expanding the body (the expansion is indicated in FIG. 12A). This effectively retrofits an original frame to be operable with the attachment 1530. Of course, a similar approach can be used to with an aftermarket frame having its own process artifact (e.g., a molding process artifact or a casting process artifact).

It may be preferable to retrofit a modular frame by providing a new modular part that defines the retention system cavity or hole/engagement feature. For instance, referring to the embodiment illustrated in FIG. 1A, the frame 11 may be provided with the backstrap 20, which provides a retention system cavity 27 or hole/engagement feature. This enables the original based component (e.g., the frame) to be retained in the firearm, in combination with the new modular part, and the attachment 830.

It should be understood that a firearm assembly may include both a modular part, such as a backstrap, and any expandable body described herein. This may allow a user to retain their original backstrap and original frame, in combination with new attachment such as a magwell.

Optic Sight Attachment

Figure 16A:
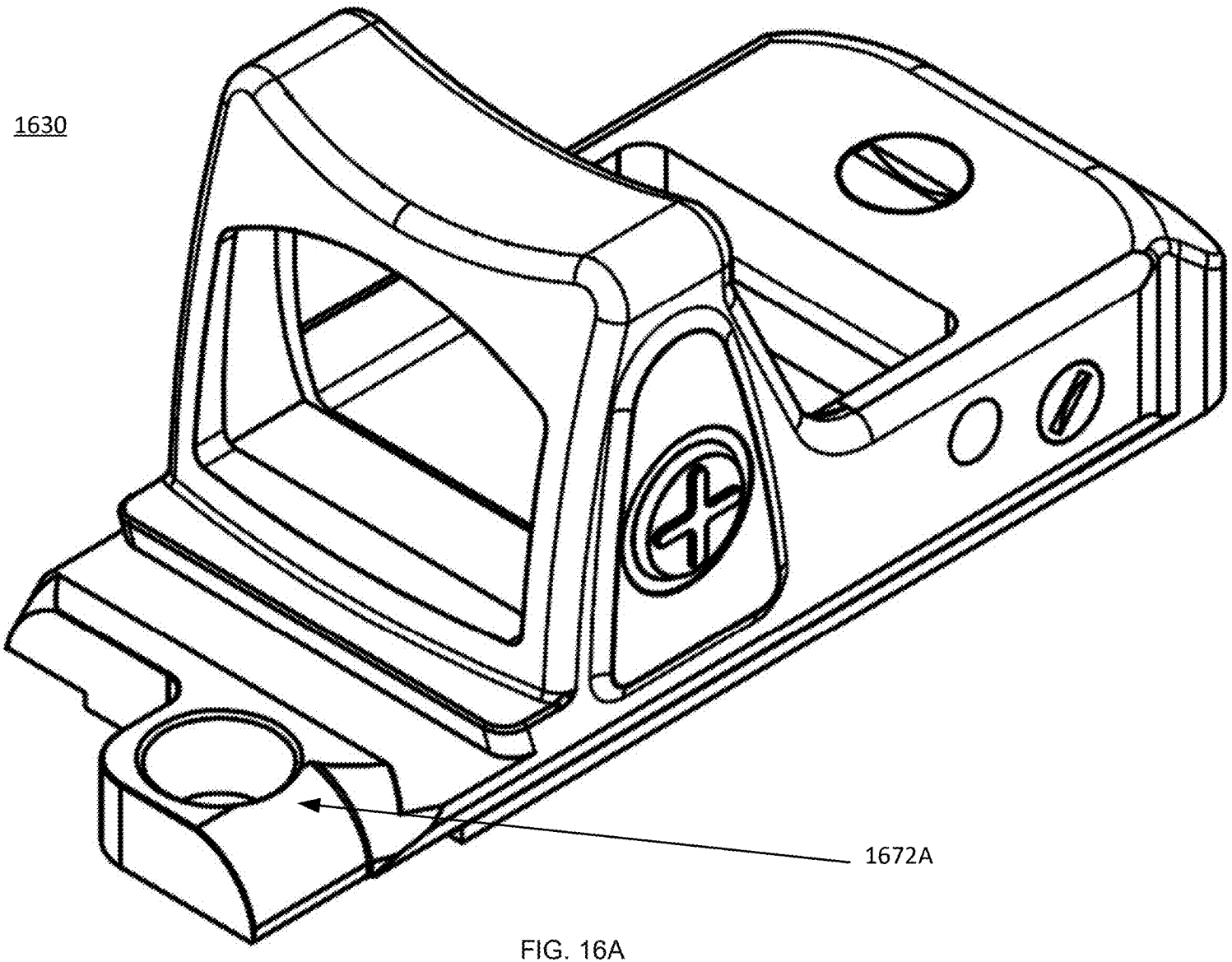
FIG. 16A illustrates an isometric view of another attachment for a recoil environment (e.g., an optic sight) having a slideable attachment interface to restrict coupling movement of the attachment to longitudinal movement (e.g., fore/aft movement) and an additional interface to restrict a longitudinal position (e.g., a fore/aft position) of the attachment, according to various embodiments.
Figure 16B:
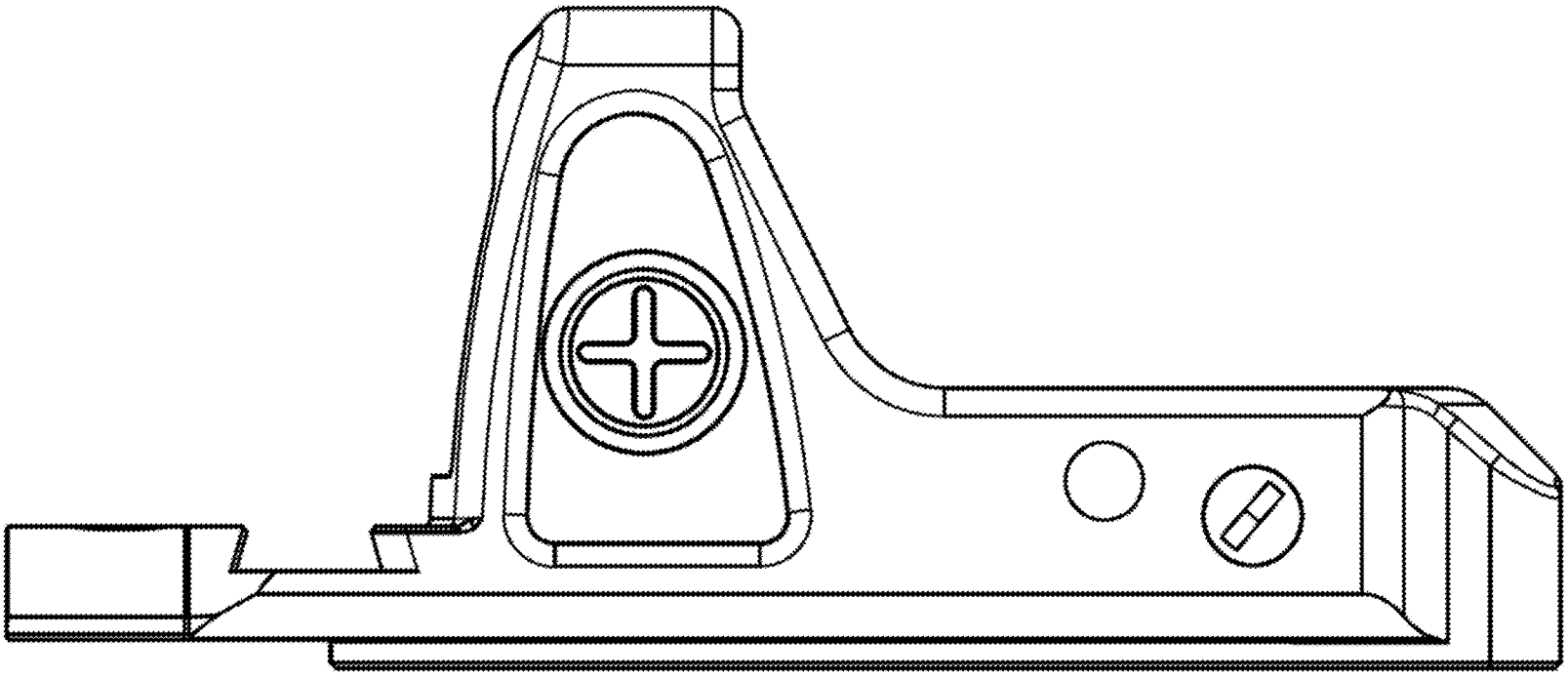
FIG. 16B illustrates a side view of the attachment of FIG. 16A (e.g., the optic sight).
Figure 16C:
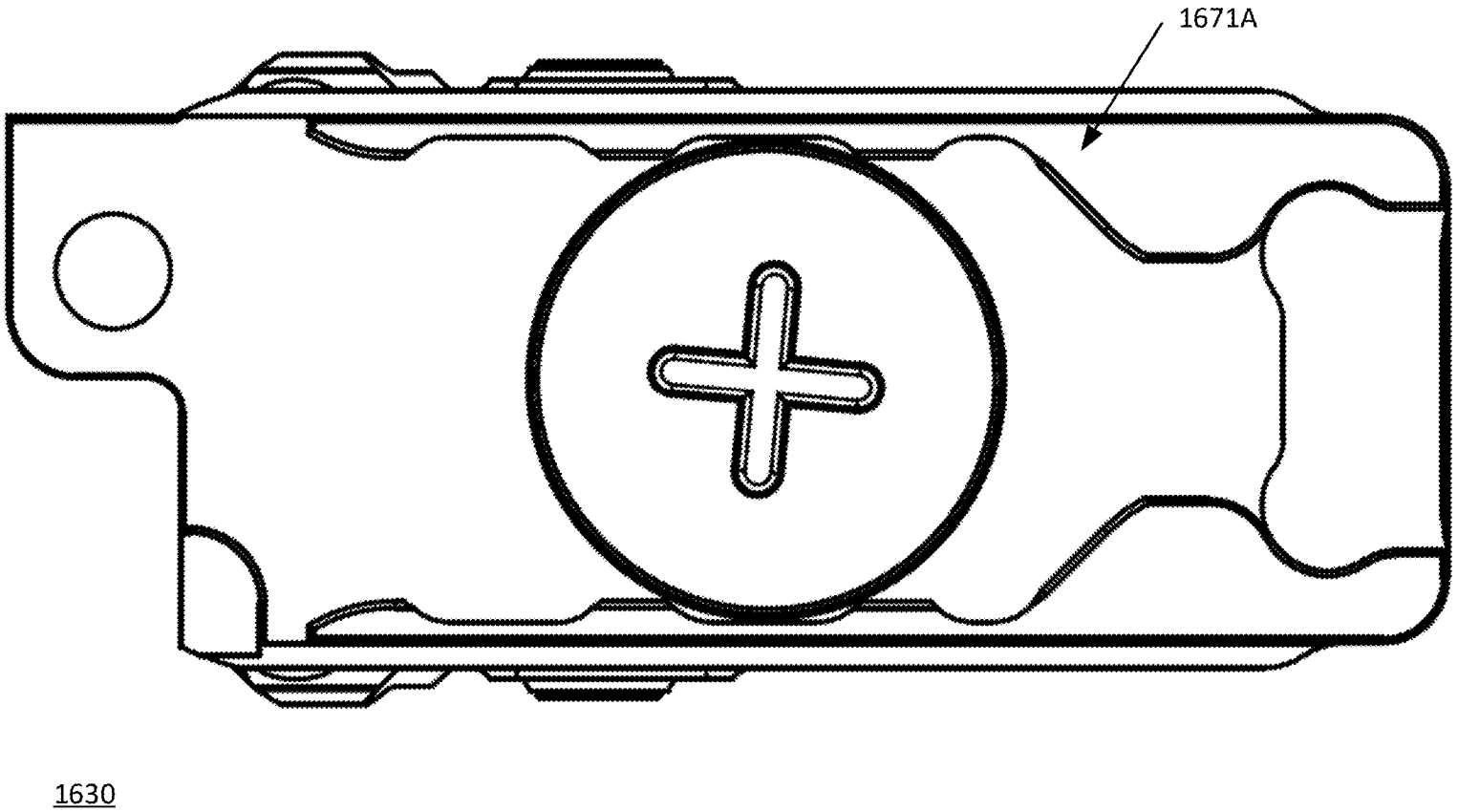
FIG. 16C illustrates a bottom view of the attachment of FIG. 16A (e.g., the optic sight).

FIGS. 16A, 16B, and 16C illustrate, respectively, an isometric view, a side view, and a bottom view of another attachment for a recoil environment (e.g., an optic sight) having a slideable attachment interface 1671A (FIG. 16C) to restrict coupling movement of the attachment to longitudinal movement (e.g., fore/aft movement) and an additional interface 1672A to restrict a longitudinal position (e.g., a fore/aft position) of the attachment 1630, according to various embodiments.

The illustrated attachment 1630 (e.g., an optic sight) is configured to repeatedly locate in the same position directly on a firearm part, such as a slide. Therefore, a user can separate the illustrated attachment 1630 from the firearm, and then re-attach it without having to re-zero the firearm, again. In addition to eliminating the requirement to re-zero a firearm again, the illustrated attachment 1630 may include other differences as compared to some known firearms, given the case of removal and reattachment, such as the illustrated battery access port (shown in FIG. 16C—the battery access port will be described in more detail later with reference to FIG. 16C).

Referring now to FIG. 16C, the slideable attachment interface 1671A may be similar in any respect to the slideable attachment interface 1571A (FIG. 15). For instance, the slideable attachment interface 1671A may restrict a coupling movement of the attachment 1630 relative to a firearm part (e.g., a slide, not shown) to longitudinal movement (e.g., fore/aft movement). The longitudinal movement may be parallel to a bore axis, and in the illustrated embodiment the attachment 1630 may be slid forwardly for attachment and rearwardly for removal (in contrast various grip attachments described herein may slide in a rearward direction for attachment, and in a forward direction for removal).

Referring now to FIG. 16A, the additional interface 1672A may restrict a longitudinal position (e.g., a fore/aft position) of the attachment 1630 relative to the firearm part. Instead of a spring-biased part, such as a plunger as used with various grip attachments described herein, the additional interface 1672A may utilize a threaded fastener. In embodiments using a threaded fastener, the threaded fastener may be similar in any respect to the threaded fastener described in the U.S. patent application Ser. No. 18/480,451, which is incorporated by reference (hereinafter the '451 application).

The additional interface 1672A may be similar in any respect to any attachment interface described in the '451 application. For instance, the additional interface 1672A may include a tapered opening similar in any respect to the tapered opening 4185 described in the '451 application. In the '451 application, the tapered opening 4185 is part of an adapter 4105; however, in the embodiment illustrated in FIGS. 16A-C of the present application, a tapered opening may be part of an optic sight (e.g., may be included in a body of the attachment 1630).

The firearm part (e.g., a slide to receive the attachment 1630, not shown) may have a slideable attachment interface similar in any respect to the slideable attachment interface 1571B (FIG. 15) and/or the attachment interface used on any of the various slides described in the '451 application. For instance, the firearm part (e.g., a slide to receive the attachment 1630) may include a threaded opening similar in any respect to the threaded opening 4180B shown and described in the '451 application. In some embodiments, the attachment 1630 may be configured to attach to the slide 4101 described in the '451 application.

In various embodiments of a firearm assembly including the attachment 1630 and the firearm part, one of the slideable attachment interfaces may include an undercut opening (e.g., a female dovetail, T-slot, or other undercut opening now known or later developed). The other of these slideable attachment interfaces may include a protrusion receivable by the undercut opening (e.g., a male dovetail, T-slot, or other male feature receivable by the undercut opening).

The optic sight 1630 may sit lower on a slide than the optic sight 4100 of the '451 application, given the direct mount arrangement. For instance, an amount that the optic sight 1630 sits lower may be equal to a height of a mounting location of the adapter 4105 described in the '451 application (e.g., equal to plate thickness). A threaded fastener (not shown) to attach the optic sight 1630 to the firearm part that may be slightly shorter than the locating fastener 4180A in the '451 application, in some embodiments, but this is not required.

In various embodiments, the optic sight 1630 may include any of the adapter features and/or optic sight features described in the '451 application. For example, the illustrated dovetail groove in the body of the optic sight 1630 may be similar in any respects to the dovetail groove in the adapter 4105 (FIG. 7D of the '451 application). Also, a bottom of the optic sight 1630 may include the same features illustrated on the bottom of the adapter 4105 (FIG. 7B of the '451 application).

Referring now to FIG. 16C, the underside of the illustrated optic sight 1630 features a battery access port, as illustrated. Other known optic sights, without the various undercut and other features of the illustrated optic sight, which operate under the principle that a user installs the optic sight on a firearm and then does not remove it (to avoid the requirement to re-zero on re-install), may require battery modules that are accessible while the optic sight remains attached to the firearm. These battery modules have various downsides, including requiring profiles and dimensional requirements that may be undesirable for other aspects of the optic sight, aesthetics, and the like.

Figure 17A:
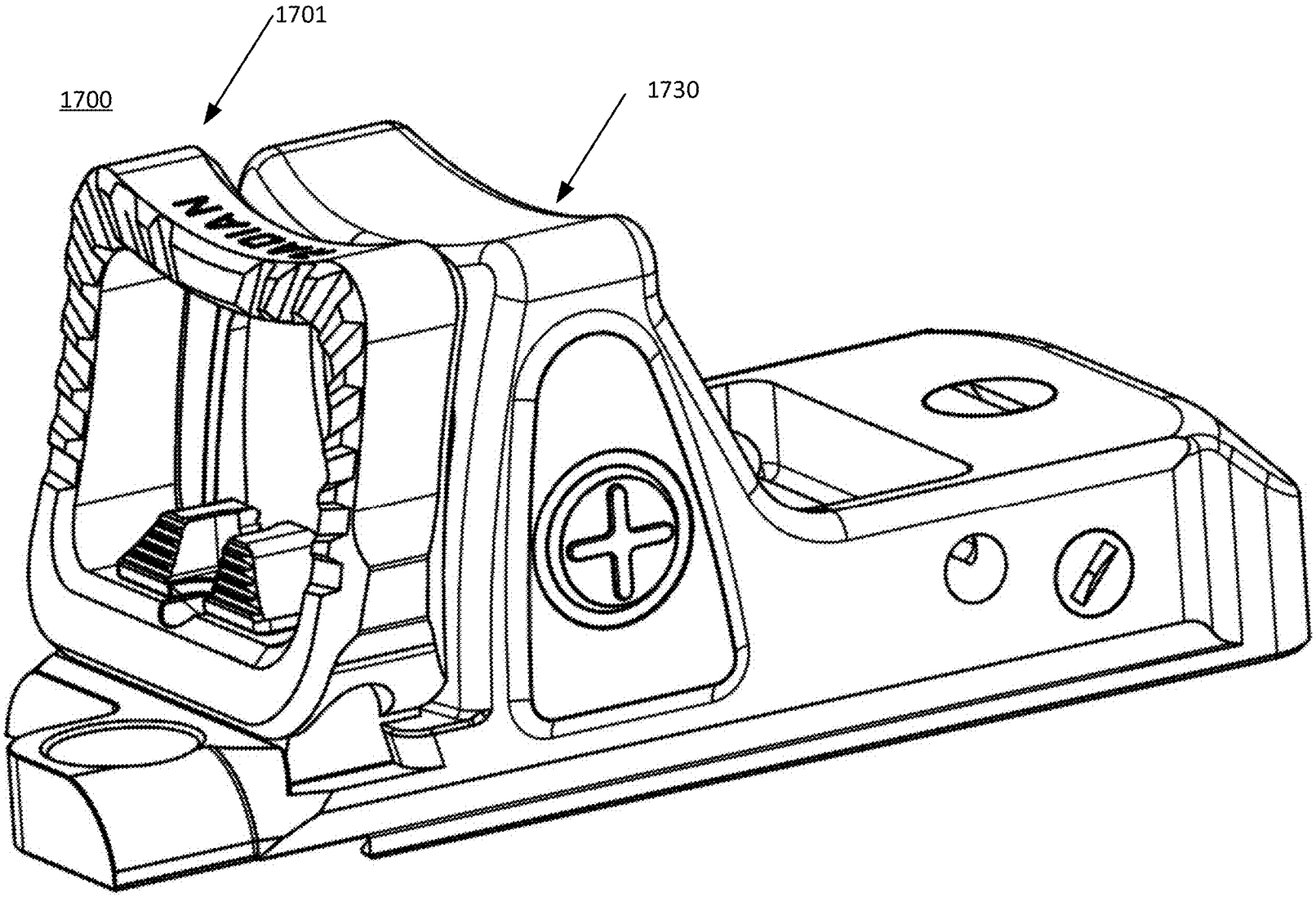
FIG. 17A illustrates an optic sight assembly including a plural-purpose accessory coupled to an optic sight similar in any respects to the attachment of FIGS. 16A-C, according to various embodiments.
Figure 17B:
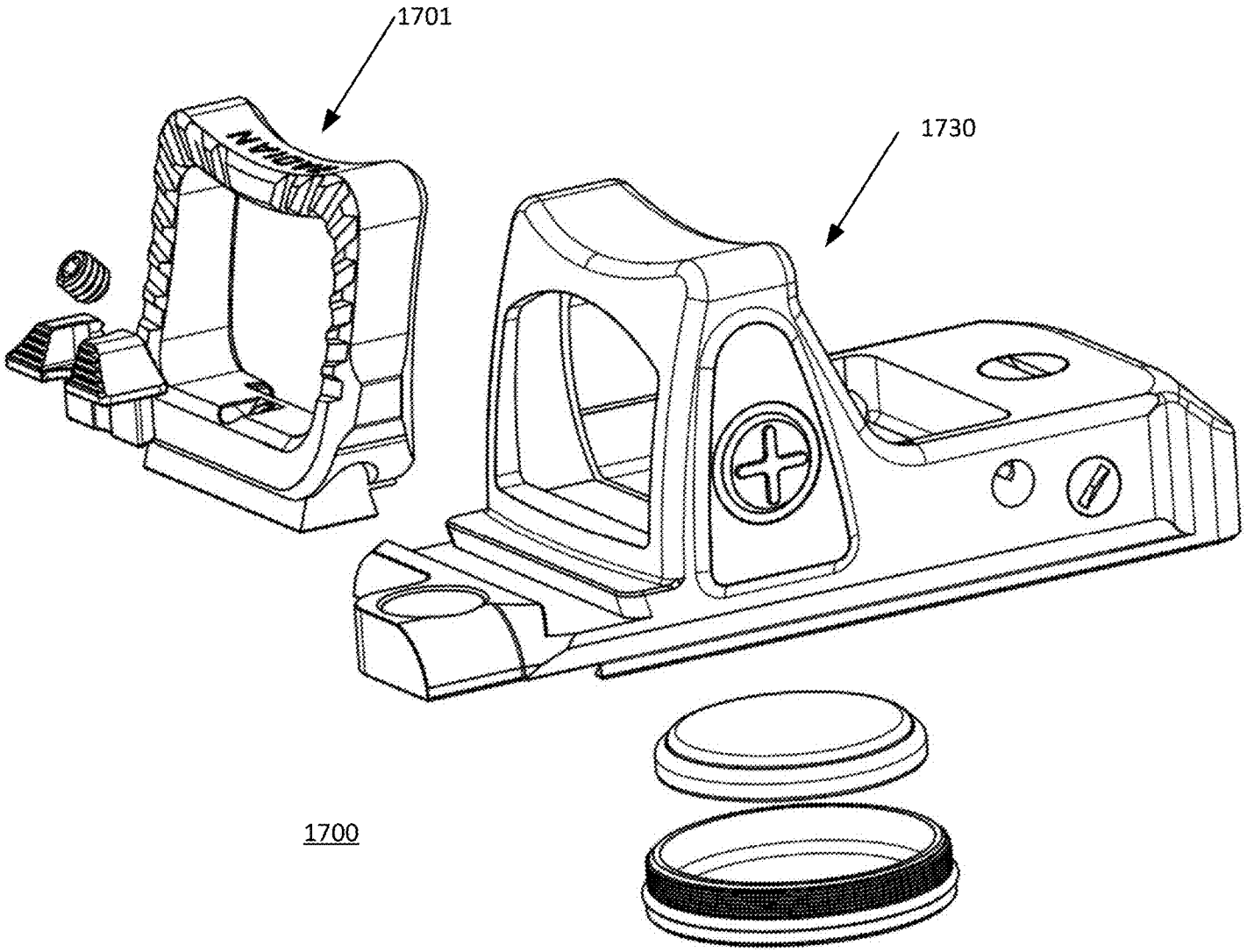
FIG. 17B illustrates an exploded isometric view of the optic sight assembly of FIG. 17A.

FIG. 17A illustrates an optic sight assembly 1700 including a plural-purpose accessory coupled to an optic sight 1730 similar in any respects to the attachment 1630 of FIGS. 16A-C, according to various embodiments. FIG. 17B illustrates an exploded isometric view of the optic sight assembly 1700 of FIG. 17A. The plural-purpose accessory 1701 includes a frame to protect the optic sight 1730 (the frame may be similar in any respect to the frame of the optic guard described in the '451 application).

In this embodiment, the plural-purpose accessory also includes a rear mechanical sight, as illustrated. As shown in FIG. 17B, this rear mechanical sight may be removably coupled to the frame; however, this is not required (in other examples, a rear mechanical sight may be integrally formed with a frame).

In the illustrated embodiment, the plural-purpose accessory includes a male dovetail to mate with the female dovetail of the optic sight 1730. In other embodiments, this may be reversed and/or some other interface may be used to removably attach a plural-purpose accessory to any optic sight described herein.

The battery access cover can be seen in FIG. 17B. Given that the optic sight 1730 can be removed and re-mounted identically (because of the attachment interface features described with reference to FIGS. 16A-C), there is no longer a need to make the battery compartment accessible while the optic sight 1730 is mounted on a firearm. As illustrated, the battery access may be located on an underside of the optic sight 1730 without requiring a re-zero of the firearm after accessing the battery compartment. Of course, any optic sight described herein may use any known battery features now known or later developed, whether accessible from the underside or some other side of an optic sight using any attachment features described herein.

Figure 18A:
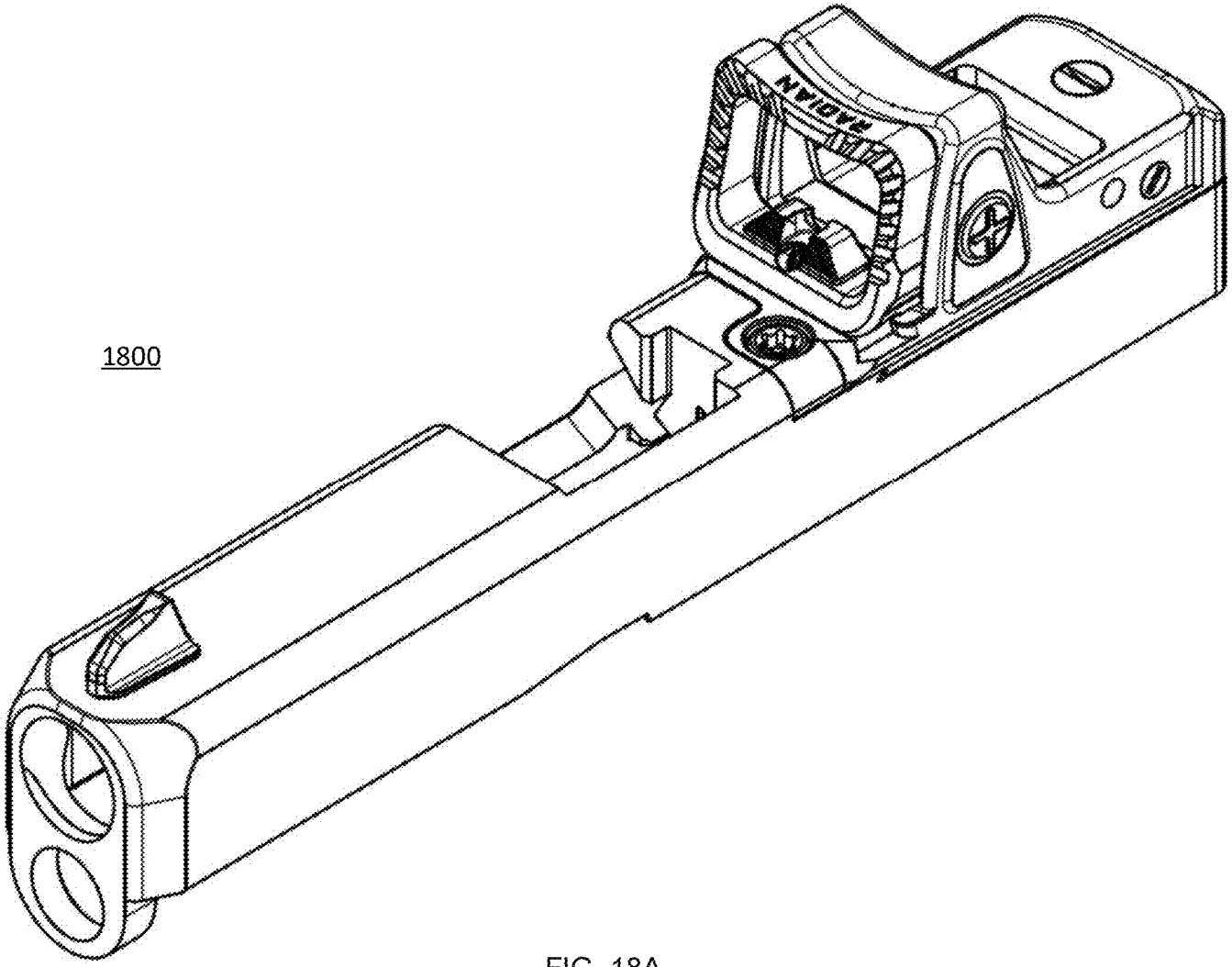
FIG. 18A illustrates an isometric view of a slide assembly including the optic sight assembly of FIG. 17, according to various embodiments.
Figure 18B:
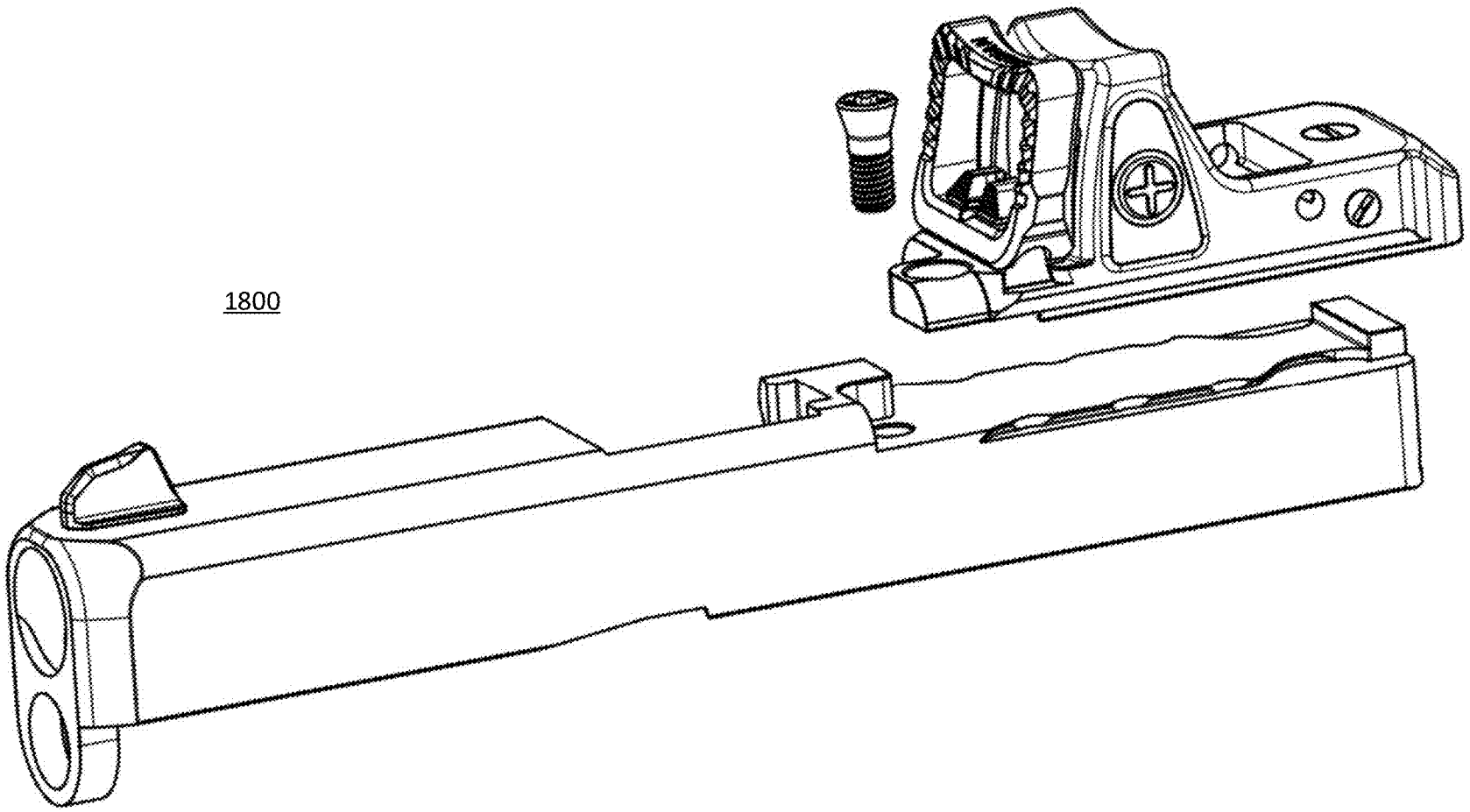
FIG. 18B illustrates an exploded isometric view of the slide assembly of FIG. 18A.

FIG. 18A illustrates an isometric view of a slide assembly 1800 including the optic sight assembly of FIG. 17, according to various embodiments. FIG. 18B illustrates an exploded isometric view of the slide assembly 1800 of FIG. 18A. As illustrated, the slide in the slide assembly 1800 may be similar in any respect to the slides described in the '451 application. For instance, the illustrated slide may be the same as the slide 4101 shown in FIG. 3A of the '451 application.

Figure 19:
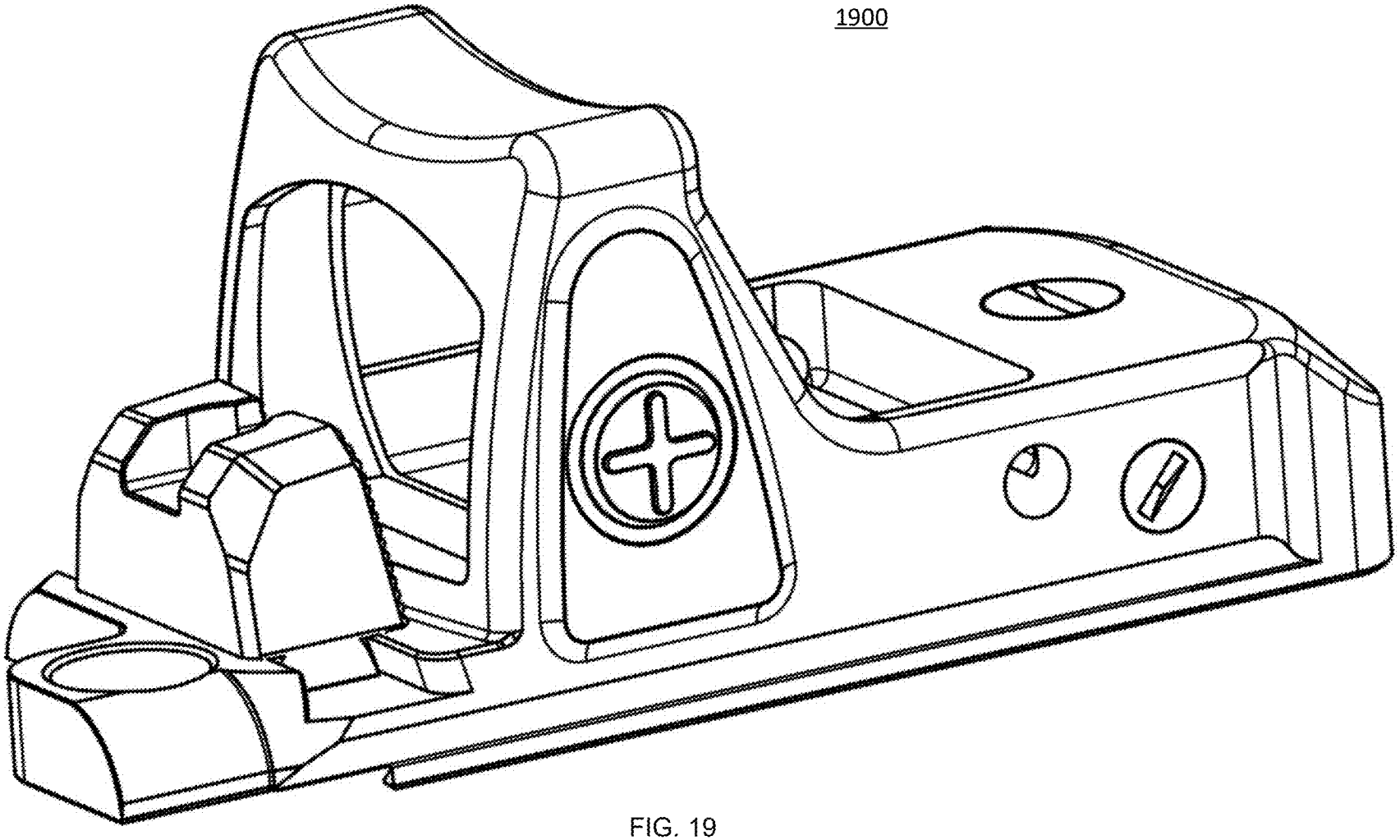
FIG. 19 illustrates an optic sight assembly including a rear mechanical sight coupled to an optic sight similar in any respects to the attachment of FIGS. 16A-C, according to various embodiments.

FIG. 19 illustrates an optic sight assembly 1900 including a rear mechanical sight coupled to an optic sight similar in any respects to the attachment 1630 of FIGS. 16A-C, according to various embodiments. In this embodiment, a rear mechanical sight accessory is installed in the dovetail groove (instead of the plural-purpose accessory described with reference to FIGS. 17A and 17B herein).

Internal Slide Structure on Optic Sight or Optic Adapter

Known slides may be recessed a relatively small amount, so that an optic sight sits as low as possible on a firearm. In known slide recessing, a depth of recessing was chosen to form a substantially continuous surface on the slide, with the only discontinuities being attachment features (e.g., threaded holes, mounting posts, an alignment rib, or the like). In some known slides, this substantially continuous surface on the slide may receive a corresponding substantially continuous surface on an underside of an optic adapter or optic sight, with the only discontinuities being attachment features (holes and/or openings corresponding to the slide's holes and/or mounting posts, an alignment channel corresponding to the alignment rib, or the like).

In low mount optics, some known slides and adapter plates may include the attachment features described above, and an additional discontinuity. For instance, the Walther™ PDP (performance duty pistol) optic plate mounting systems includes an opening in a receiving surface of the slide above the striker assembly (e.g., the striker assembly can be seen looking down into this slide opening). This slide opening in the receiving surface of the slide may be characterized in that it is viewable in a top view of the slide (when no other parts are attached to it), but it is not viewable in a rear view of the slide (when no other parts are attached to it), because the slide opening is terminated rearwardly by a portion of the slide body. This slide opening may also be referred to as "fully enclosed" (even when the back plate of the slide is removed), because the opening has a front wall, a rear wall, and side walls). An underside of the Walther adapter plate also has an underside discontinuity corresponding to the slide opening.

Various embodiments of low profile mounts described herein may feature slides including an opening above a striker assembly. However, unlike the slide opening in the Walther slide, the slide opening can be viewed in both top and rear views of the slide (when no other parts are attached to it). This characteristic may be best understood with reference to the illustration of FIG. 20F. It is immediately apparent from this illustration that the slide opening 2005 would be viewable in both top and rear views of the slide (when no other parts are attached to it, as shown in FIG. 20F). This slide opening 2005 in the receiving surface of the slide is contiguous with a rearwardly located opening 2006 (the rearwardly located opening 2006 includes a cover (e.g., a rear plate, a striker assembly stop plate, a firing pin stop plate, slide cover plate, etc.), in a fully assembly state in which a rear cover is installed—FIG. 20D illustrates a cover in the rearwardly located opening 2006).

Figure 20A:
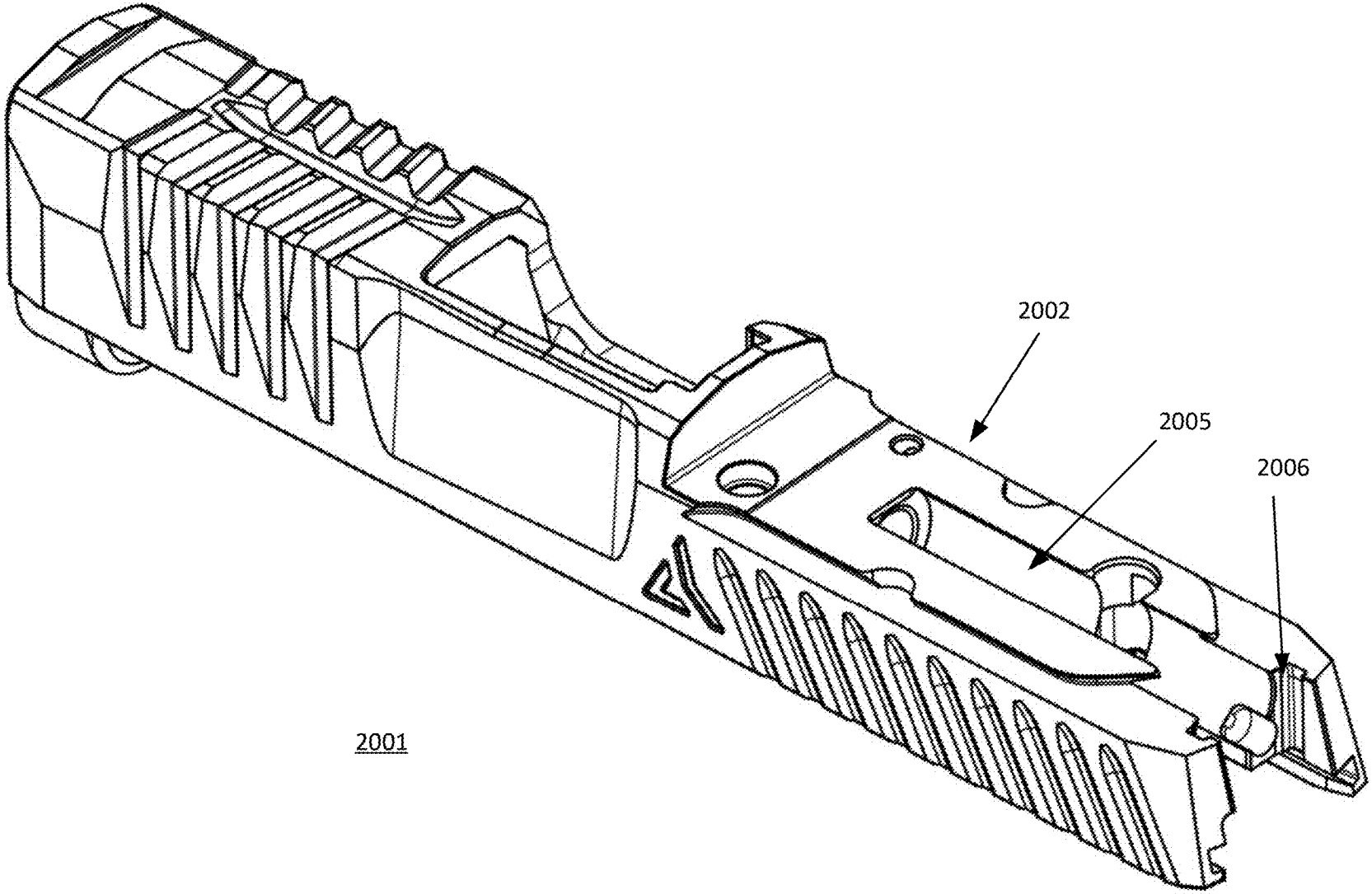
FIG. 20A illustrates an isometric view of a slide for a low profile optic mount, according to various embodiments.
Figure 20B:
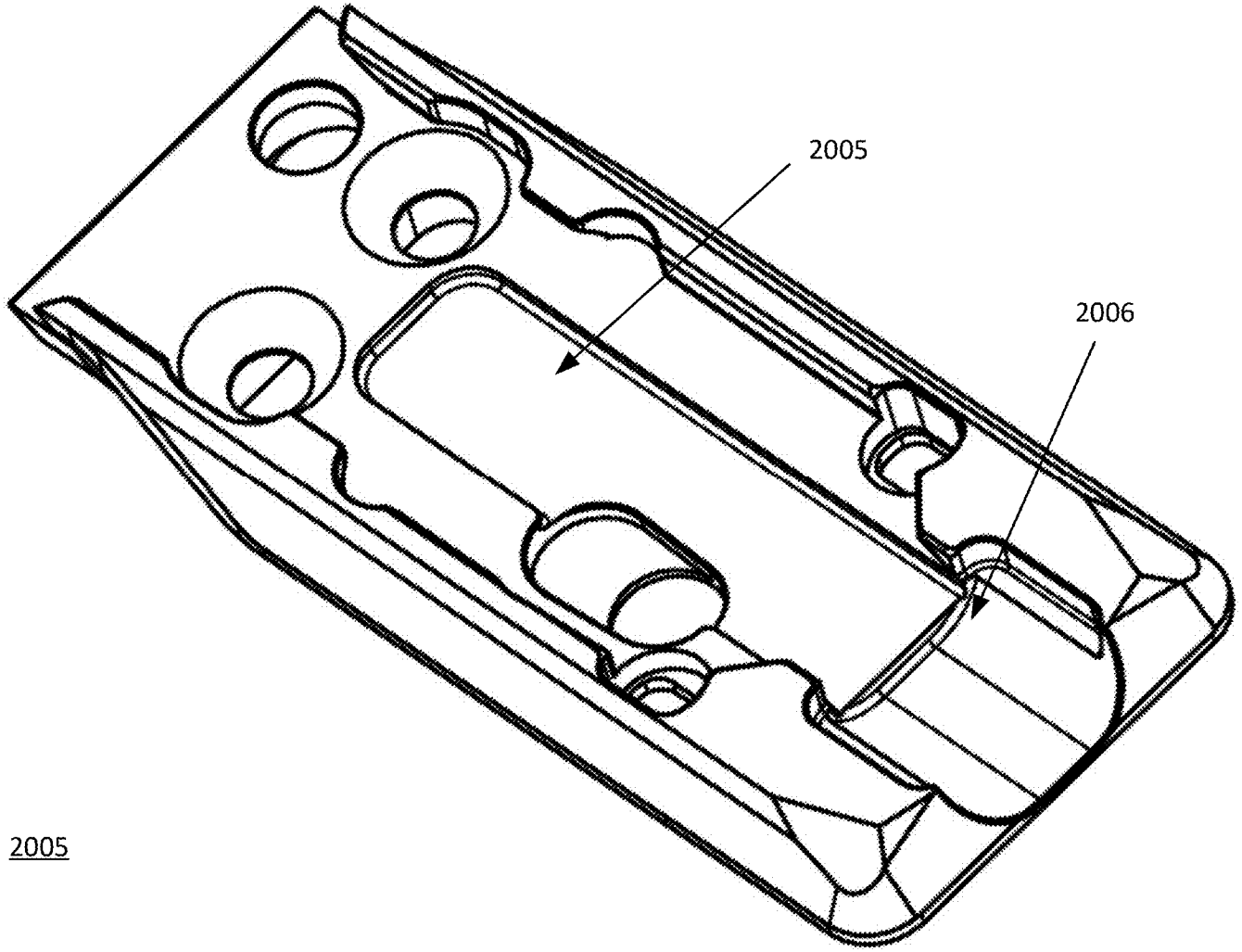
FIG. 20B illustrates a bottom isometric view of an optic adapter usable with the slide of FIG. 20A, according to various embodiments.
Figure 20C:
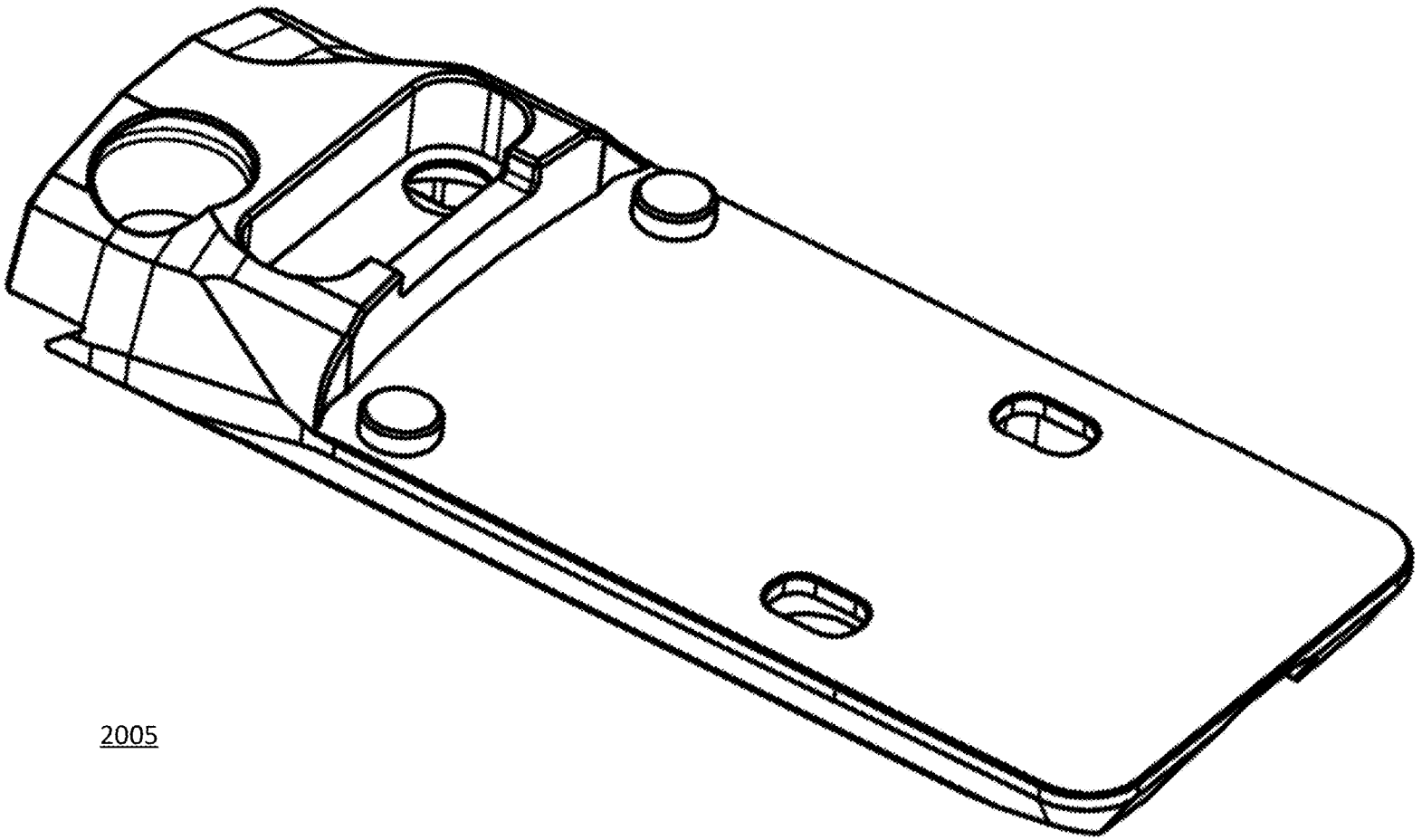
FIG. 20C illustrates a top isometric view of the optic adapter of FIG. 20B.

FIG. 20A illustrates an isometric view of a slide 2001 for a low profile optic mount, according to various embodiments. FIG. 20B illustrates a bottom isometric view of an optic adapter 2005 usable with the slide 2001 of FIG. 20A, according to various embodiments. FIG. 20C illustrates a top isometric view of the optic adapter 2005 of FIG. 20B. Immediately apparent from the illustration of FIG. 20A is that, unlike the substantially continuous surface on some known slides, a receiving surface 2002 of the slide 2001 includes a discontinuity 2005 (e.g., a slide opening in the receiving surface of the slide) that is not part of the attachment interface (e.g., an opening that is different than the threaded holes of known slides). The slide opening 2005 of the receiving surface 2002 is contiguous with a rearwardly located opening 2006 (the rearwardly located opening 2006 is shown without any cover installed therein).

Immediately apparent from the illustration of FIGS. 20B and 20C is that an optic adapter 2005 operable with the slide 2001 (FIG. 20A) includes a substantially three-dimensional underside (e.g., substantially non-planar underside), in contrast to the substantially planar undersides of various known optic plates. In particular, this underside includes a corresponding discontinuity 2006 that is not part of the attachment interface (e.g., an opening that is different than the fastener openings and/or mounting post openings of known adapters and/or known optic sights).

Referring now to FIGS. 20A, 20B, and 20C in combination, a portion of a known internal slide structure of known slides (e.g., a portion of a striker channel, extractor spring opening, or the like) is incorporated on an underside of the adapter 2005, as illustrated. When the adapter 2005 is precisely mounted on the receiving portion 2002 of the slide 2001, the two portions form a complete internal slide structure (e.g., a complete striker channel, extractor spring opening, or the like), which may operate similarly as any internal slide structure now known or later developed (e.g., may operate similar to a known striker channel, extractor spring opening, or the like).

Referring again to FIGS. 20B and 20C, besides the portion of the internal slide structure, the adapter 2005 may include any attachment features described herein. For example, the underside of the adapter 2005 may include a slideable attachment interface that may be similar to any slideable attachment interface similar in any respect to the slideable attachment interface 1671A (FIG. 16C), e.g., may include any of the adapter underside features described in the '451 application. Additionally, the adapter 2005 may include a tapered opening that may be similar in any respect to any tapered opening described herein and/or the tapered opening 4185 of FIG. 3A of the '451 application.

Similarly, the receiving portion 2002 of the slide 2001 may include any features of the slide 4101 of the '451 application. For example, the slide 2001 may include a threaded opening that may be similar in any respect to the threaded opening 4180B of FIG. 3A of the '451 application.

Figure 20E:
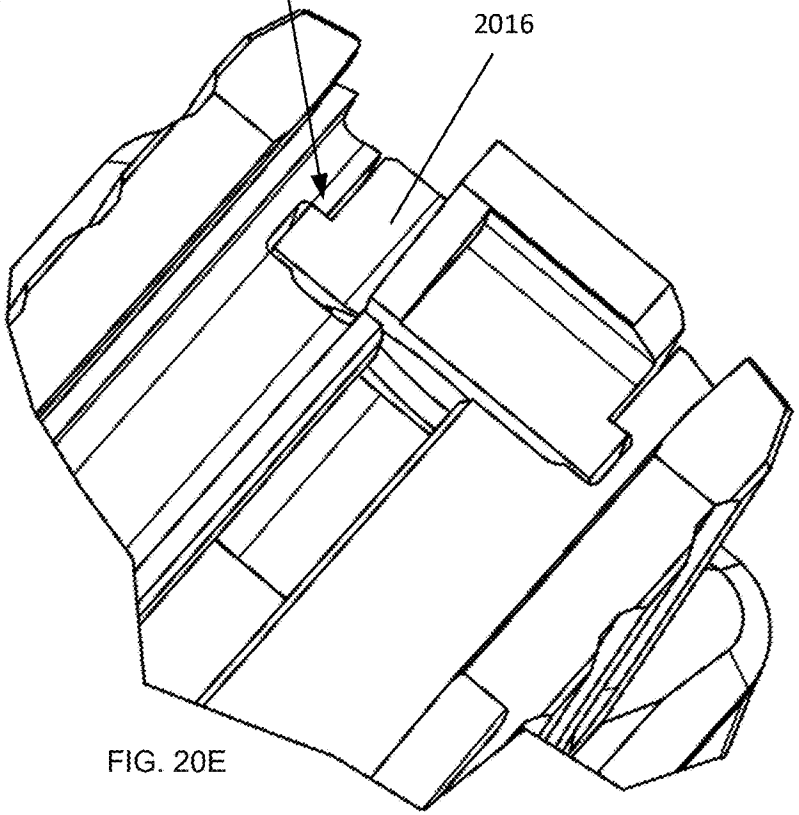
FIG. 20E illustrates a detail A of FIG. 20D.
Figure 20D:
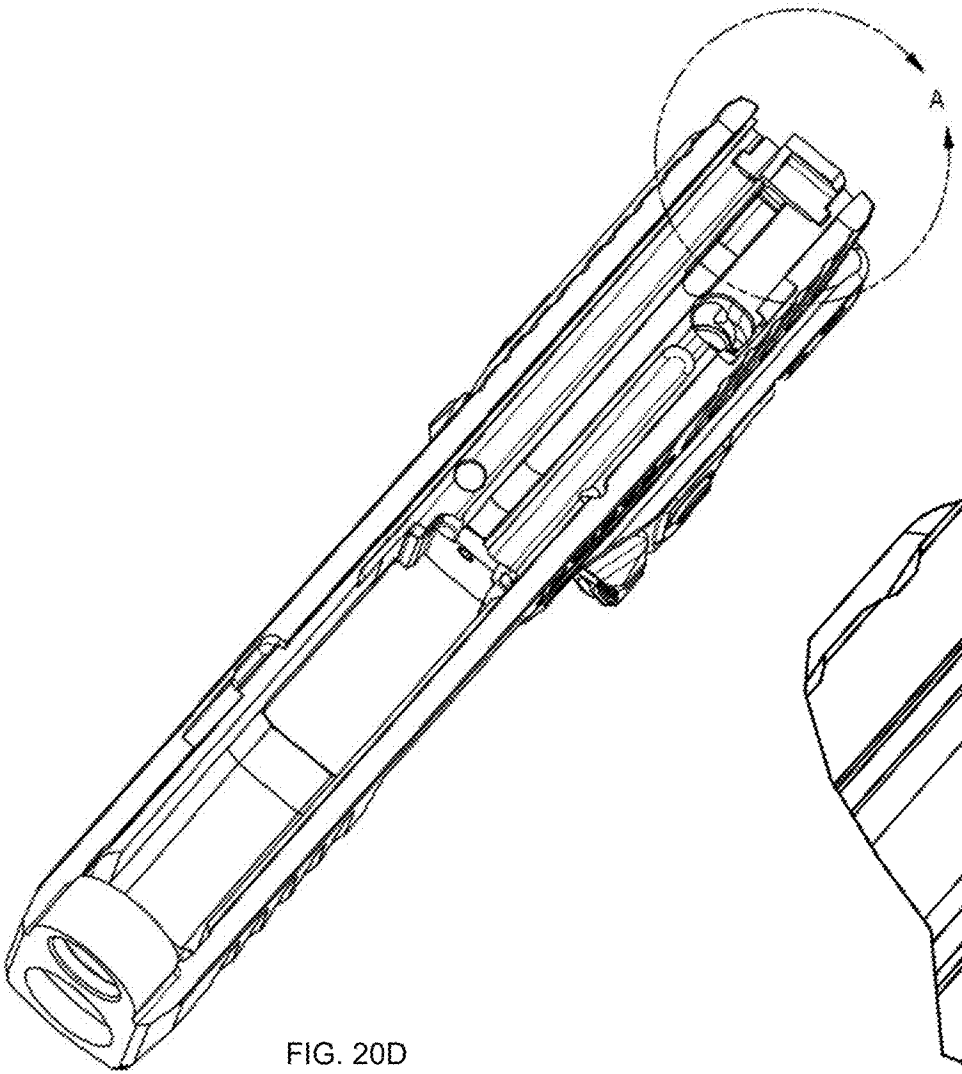
FIG. 20D illustrates a bottom view of the slide of FIG. 20A, with a back cover installed according to various embodiments.
Figure 20F:
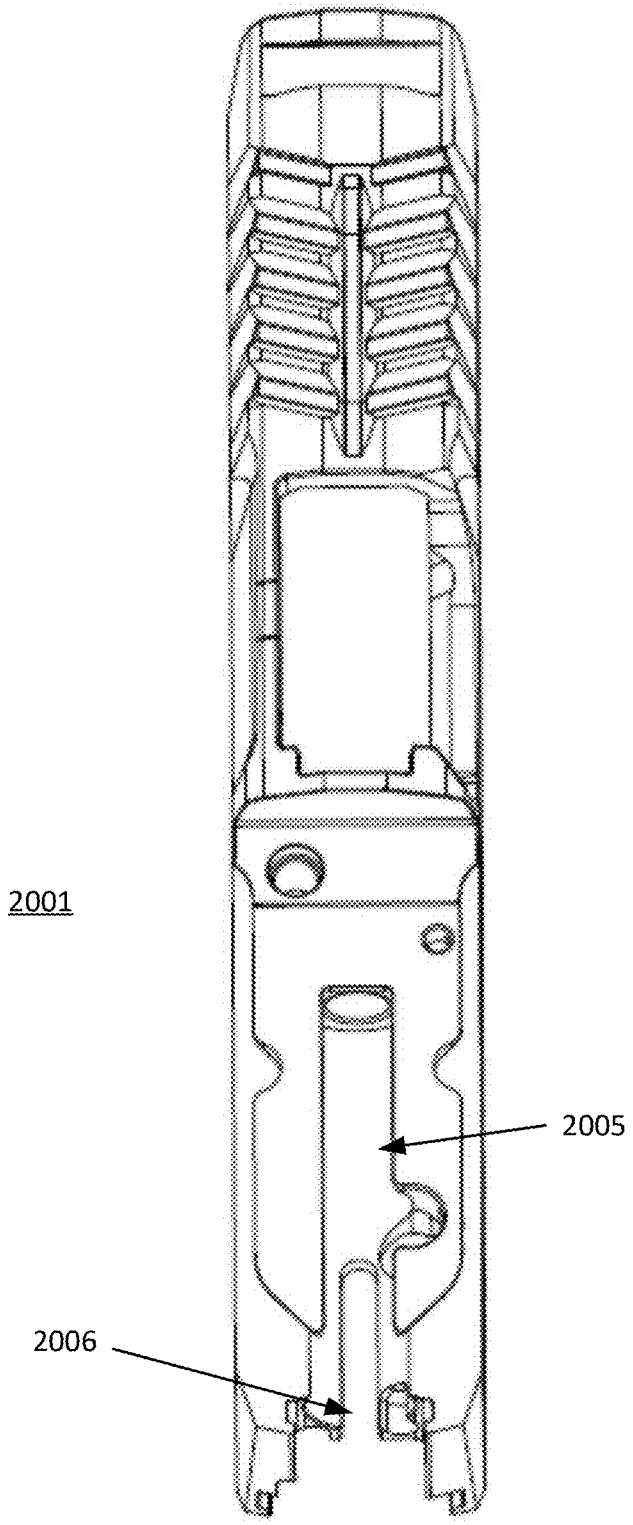
FIG. 20F illustrates rear isometric view of the slide of FIG. 20A.

FIG. 20D illustrates a bottom view of the slide of FIG. 20A, with a back cover installed according to various embodiments. FIG. 20E illustrates a detail A of FIG. 20D. FIG. 20F illustrates rear isometric view of the slide 2001 of FIG. 20A. Referring to FIG. 20E, a cover 2016 (e.g., a rear cover plate) is in the rear cover opening 2006.

Figure 21A:
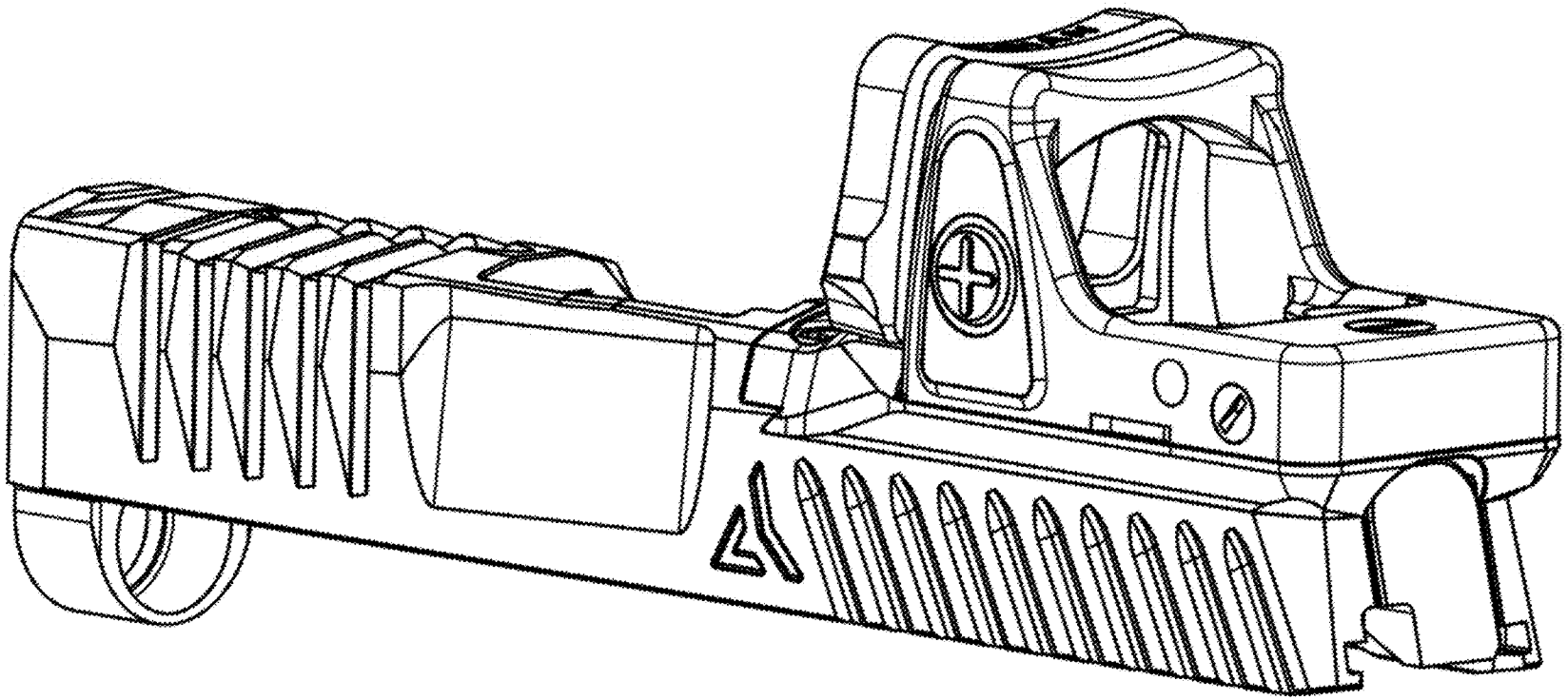
FIG. 21A illustrates an isometric view of a slide assembly with a low profile optic mount, according to various embodiments.

FIG. 21A illustrates an isometric view of a slide assembly 2011 with a low profile optic mount, according to various embodiments. The slide assembly 2011 may include:

A slide similar in any respect to slide 2001 (FIG. 20A),

An adapter similar in any respect to adapter 2005 (FIG. 20B),

An optic sight mounted on the adapter, and

A back cover (e.g., a back cover plate).

In this embodiment, the adapter of the slide assembly 2011 includes a frame to protect the optic sight, but this is not required. Also, in this embodiment, the adapter includes a rear mechanical sight, but this is not required.

In a direct mount implementation, a slide assembly may include the illustrated slide and a different optic sight (not shown). An underside of this different optic may be similar in any respect to the underside of the adapter of the slide assembly 2011.

Figure 21B:
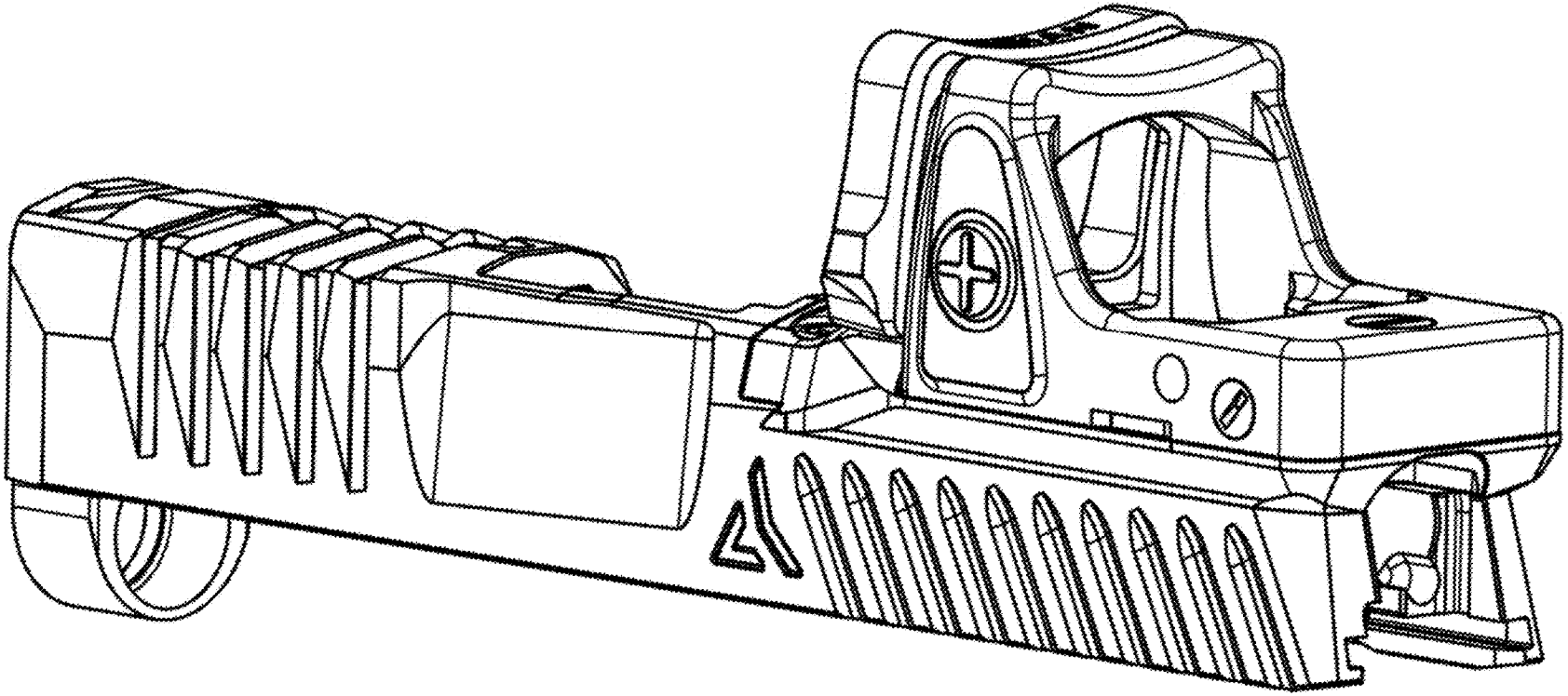
FIG. 21B illustrates an isometric view of the slide assembly of FIG. 21A, with the back cover omitted.
Figure 21C:
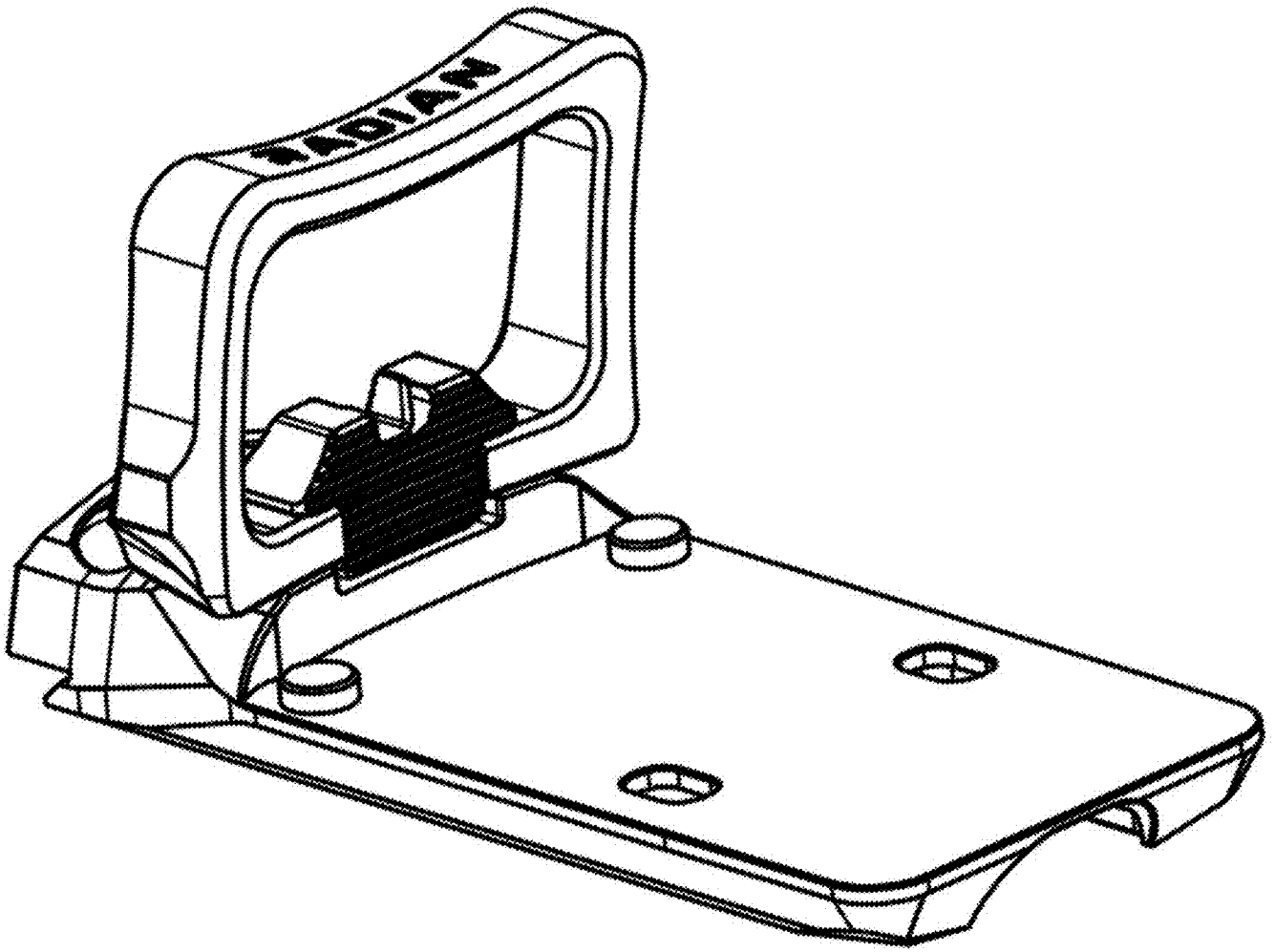
FIG. 21C illustrates an isometric view of an adapter of the slide assembly of FIG. 21A.
Figure 21D:
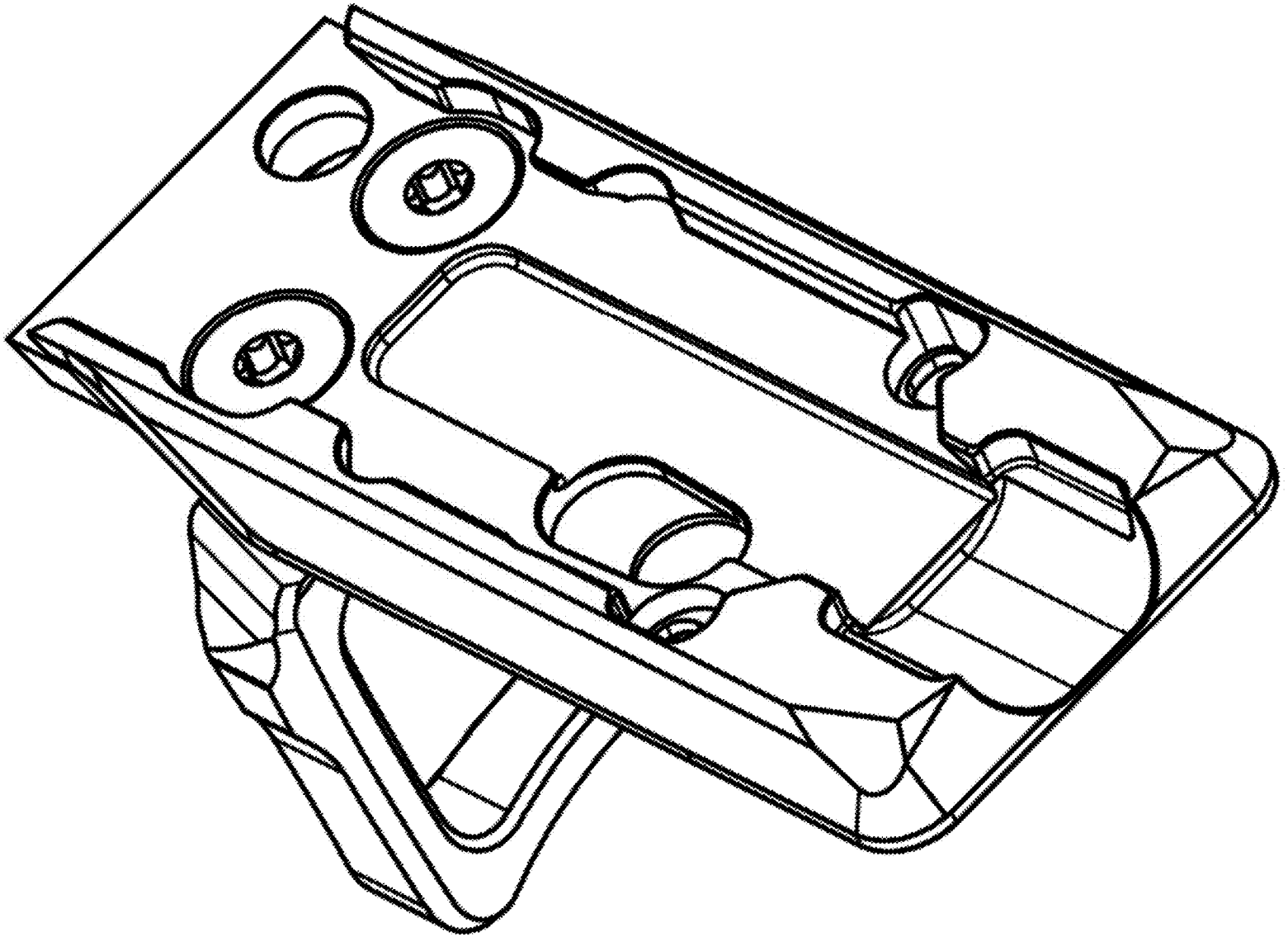
FIG. 21D illustrates a bottom isometric view of the adapter of the slide assembly of FIG. 21A.

FIG. 21B illustrates an isometric view of the slide assembly 2011 of FIG. 21A, with the back cover omitted. FIG. 21C illustrates an isometric view of an adapter of the slide assembly 2011 of FIG. 21A. FIG. 21D illustrates a bottom isometric view of the adapter of the slide assembly 2011 of FIG. 21A.

Referring to FIG. 21B, the internal slide structure is partially viewable given that the back cover is omitted. The internal slide structure is illustrated with a striker assembly omitted for ease of illustration. It should be understood that the slide of the slide assembly 2011 includes a receiving surface that is similar to the receiving surface illustrated in FIG. 20F, and that an installed striker assembly is viewable, through a slide opening of this receiving surface, when looking straight down on the receiving surface (when the adapter of the slide assembly 2011 is not attached to the receiving surface).

In other embodiments, an adapter including a portion of an internal slide structure may include any precise attachment features, such as the precise attachment features described in the '451 application and/or herein, or a later-developed alternative to the same (e.g., some other attachment feature that identically locates an optic adapter or optic sight on a firearm. It may be desirable to provide a portion of an internal structure of a slide on an underside of an adapter or optic sight in a slide assembly with a precisely-mountable adapter or optic sight, respectively, in order to provide a slide assembly including an optic sight mounted lower than known optic sight mountings.

In the illustrated example, the illustrated adapter and the slide, in combination, form an original internal structure that may perform a same function as known internal slide structure. However, this is not required. In some embodiments, it may be possible or practical to provide improved functionality relative to the original internal structure of the slide.

In the illustrated example, an adapter is illustrated. In other embodiments, it may be possible and practical to provide an optic sight to direct mount to the illustrated slide. In these embodiments, an underside of the optic sight's body may include any of the structures illustrated on the bottom of the adapter.

In the illustrated examples, a particular discontinuity (e.g., internal slide structure portion) is shown on the underside of the adapter 2005. It should be understand that, in other embodiments within the scope of this disclosure, any other discontinuity (e.g., internal slide structure portion), or any other slide structure portion, may be included on an underside of a precisely-mountable adapter or optic sight.

In various embodiments, a slide includes a continuous opening from a back end of the slide to a receiving surface of the slide. This continuous opening may be enclosed by 1) an optic adapter or direct mount optic in its fore portion and 2) any cover described herein in its aft portion.

In the illustrated embodiment, an underside of the attachment includes a portion of an internal slide structure corresponding to the slide opening in the receiving surface of the slide. However, this may not be required. In other embodiments, in may be possible and practical to omit any recessing from an underside of an optic adapter and/or direct mount optic. In these embodiments, the non-recessed portion of the underside optic adapter or direct mount optic may enclose the slide opening (with a rear cover enclosing a contiguous additional opening). Even in embodiments in which the underside of the optic adapter or direct mount embodiment, a lower optic mount may be achieved as compared to some various known slide recessing which attempts to preserve a wall between the underside of the optic adapter and a topmost part of a cavity of an internal slide structure.

Grip Surface

Various embodiments described herein use a separable part (e.g., a plunger or a threaded part in various examples) to bias an attachment surface (e.g., a surface of a grip attachment, a surface of an optic adapter, or a surface an optic sight, or the like) against a surface of the firearm part (e.g., against a surface of a grip, a surface of a slide, etc.) We have described that there may be at least two interfaces utilized for such an attachment, e.g., 1) any previously described slideable attachment interface to restrict a coupling movement of the attachment relative to the firearm part, in which the coupling movement is along a plane and 2) any previously described additional interface to further restrict movement (e.g., restrict movement along an axis along said plane).

In some embodiments, as already explained herein in the description of FIG. 1, it may be advantageous to provide yet another additional interface, operable in combination with the slideable attachment interface and the additional interface, to retain the attachment on the firearm part. For instance, in FIG. 1, a yet another interface 17 may operate in combination with the slideable attachment interface and the plunger-operated interface to retain the attachment 30 on the grip 16.

Figure 22A:
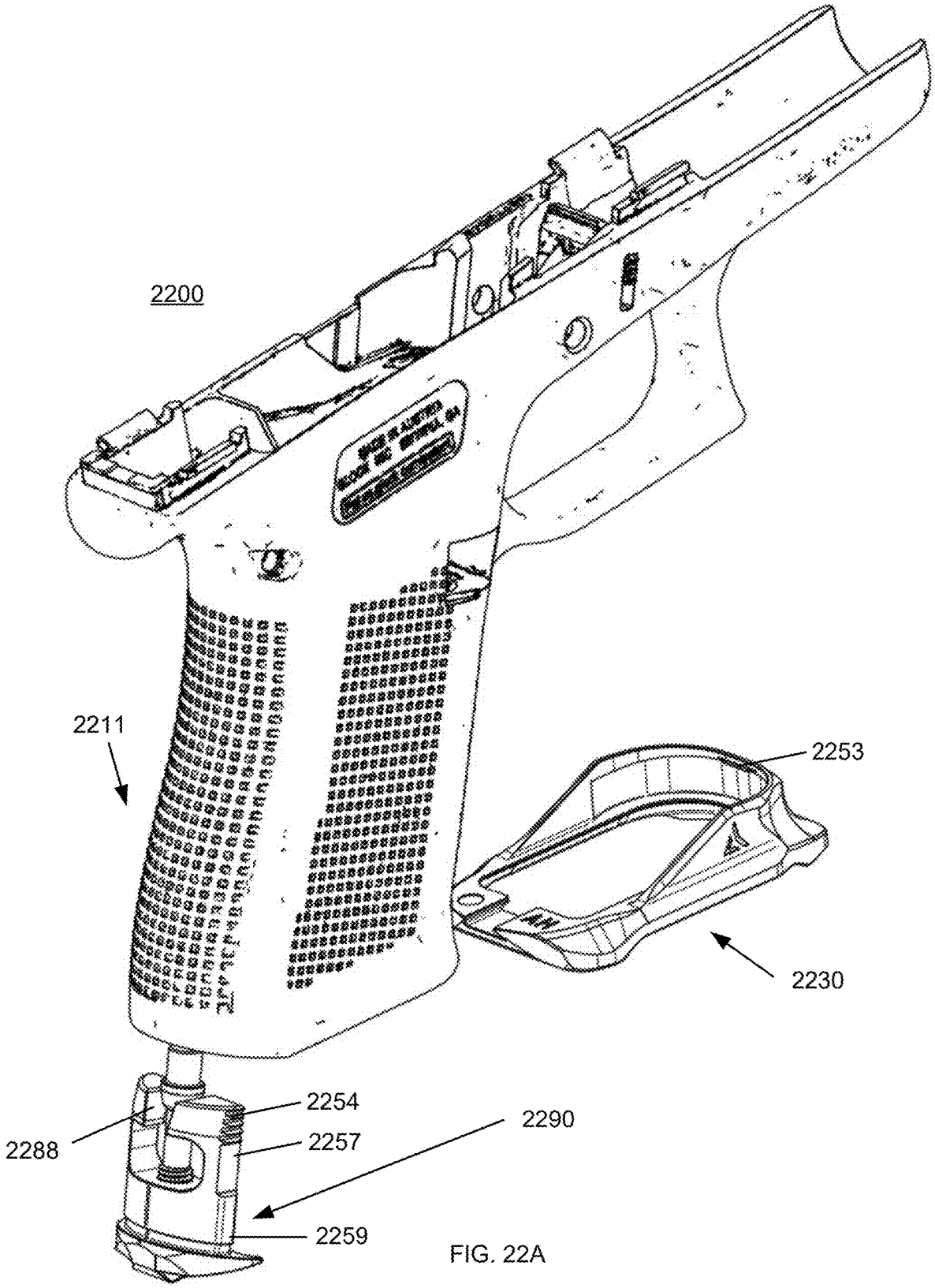
FIG. 22A illustrates an exploded isometric view of an assembly, including an attachment (e.g., a magwell) and a retention system utilizing an expandable body, according to various embodiments.

In various embodiments, the "third" interface may employ a grip surface, such as the grip surface on attachment 2230 (FIG. 22A). In some embodiments, the grip surface may be provided on the surface of the attachment that is driven against the corresponding surface of the firearm part. In other embodiments, it may be possible and practical to provide the grip surface on the other surface (e.g., the corresponding surface of the firearm part).

Figure 22B:
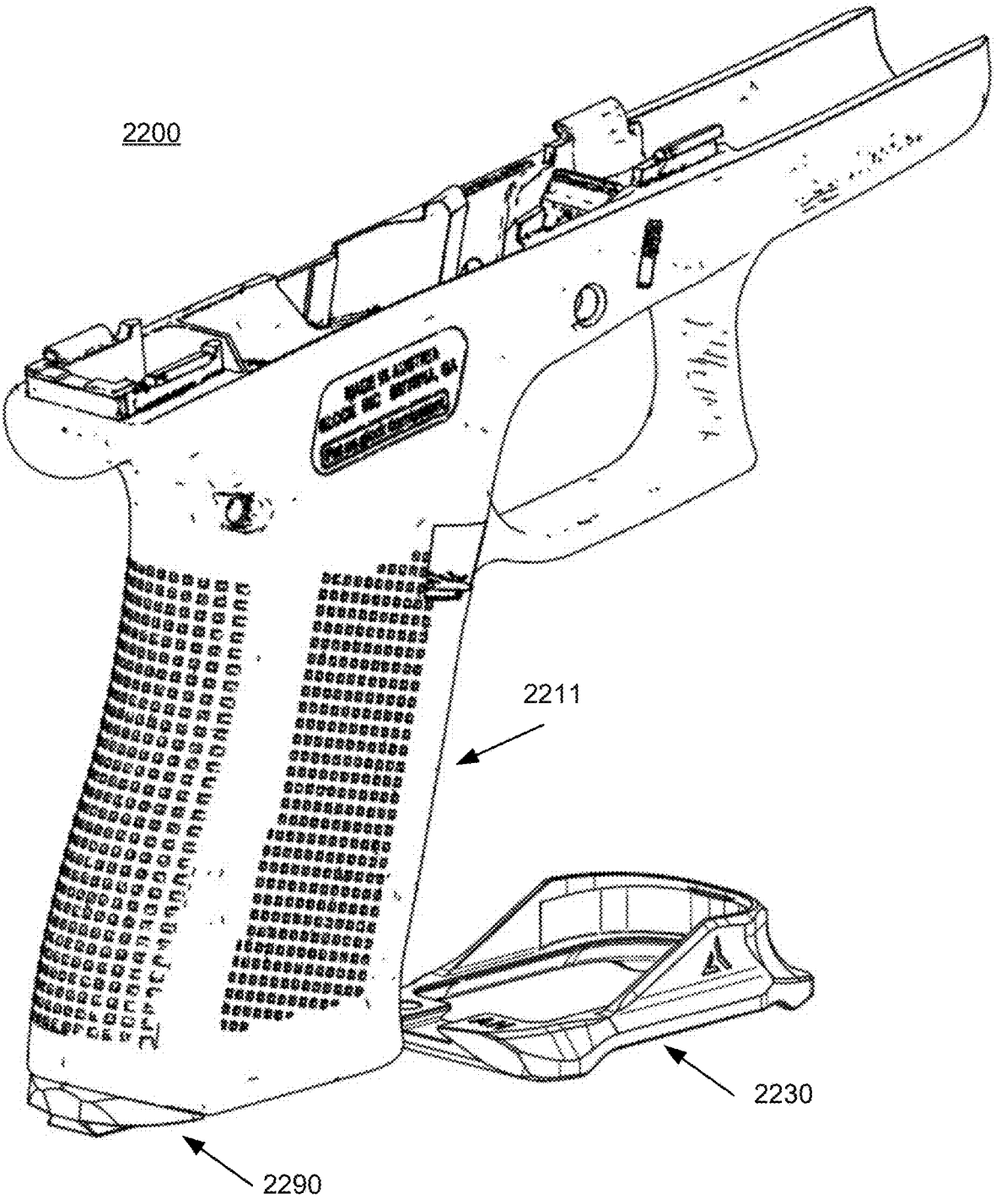
FIG. 22B illustrates an isometric view of the assembly of FIG. 22A, with the attachment separated therefrom.
Figure 22C:
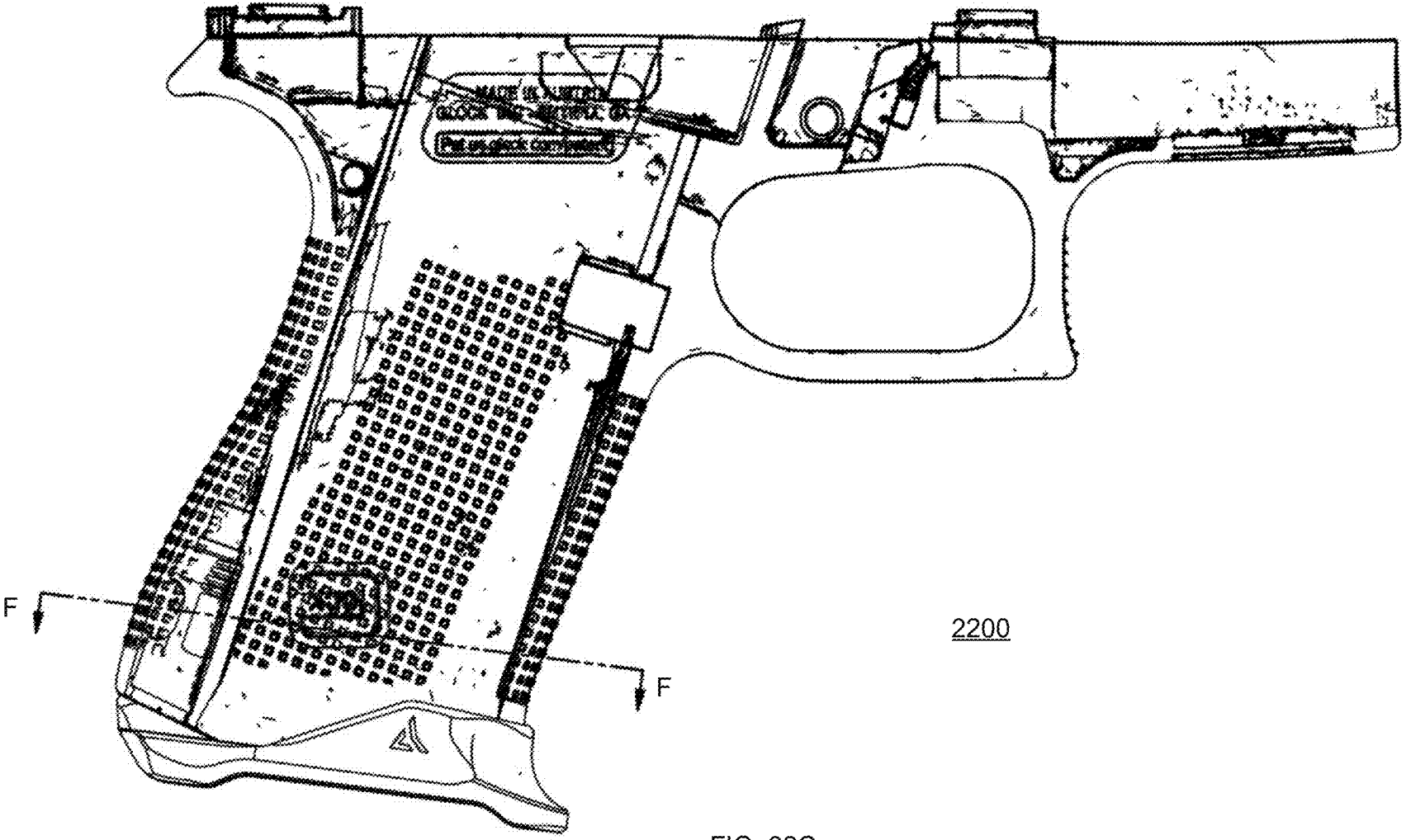
FIG. 22C illustrates a side view of the assembly of FIG. 22A in an assembly state.
Figure 22D:
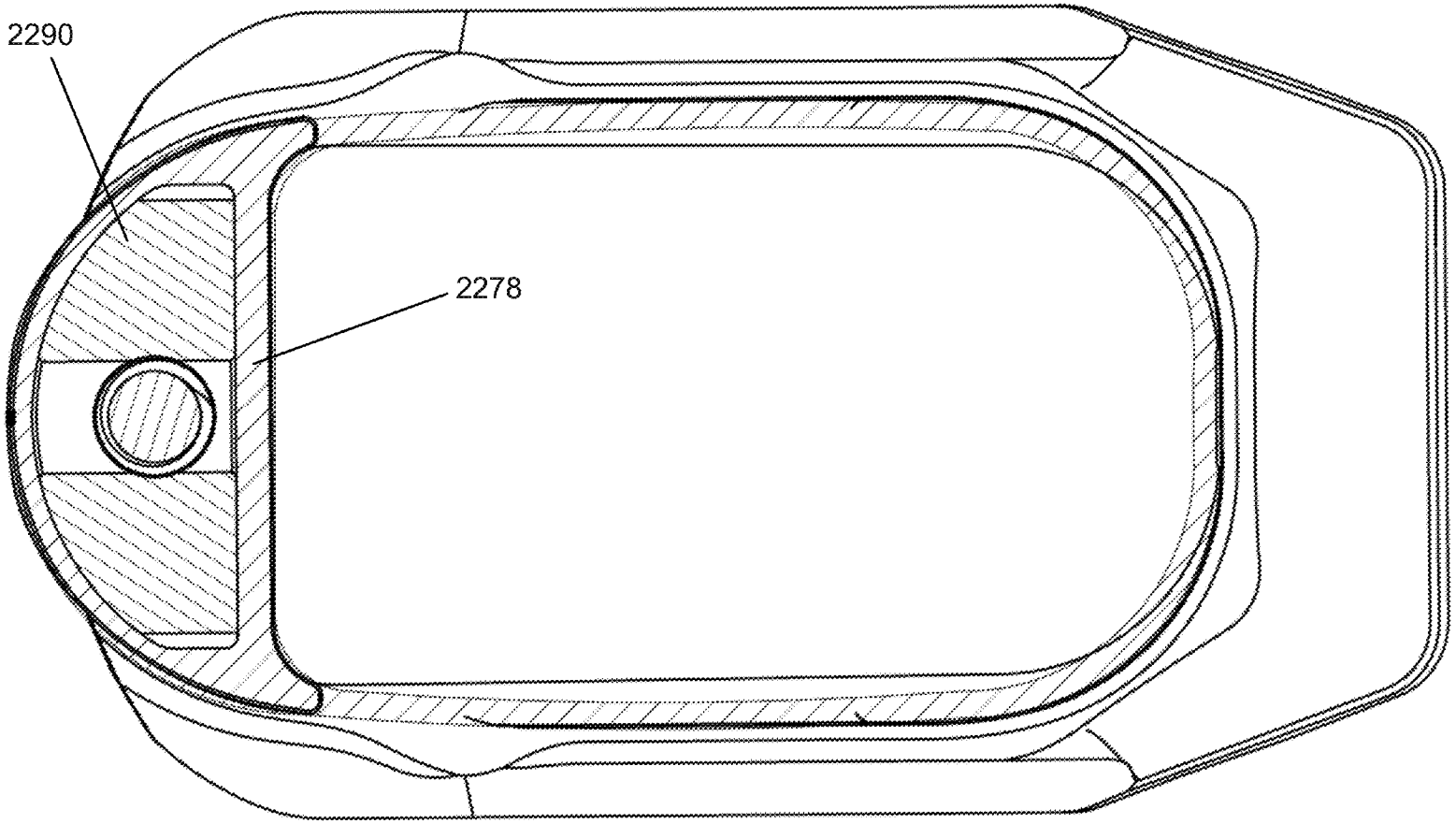
FIG. 22D illustrates a section view taken along section line F-F of FIG. 22C.
Figure 23:
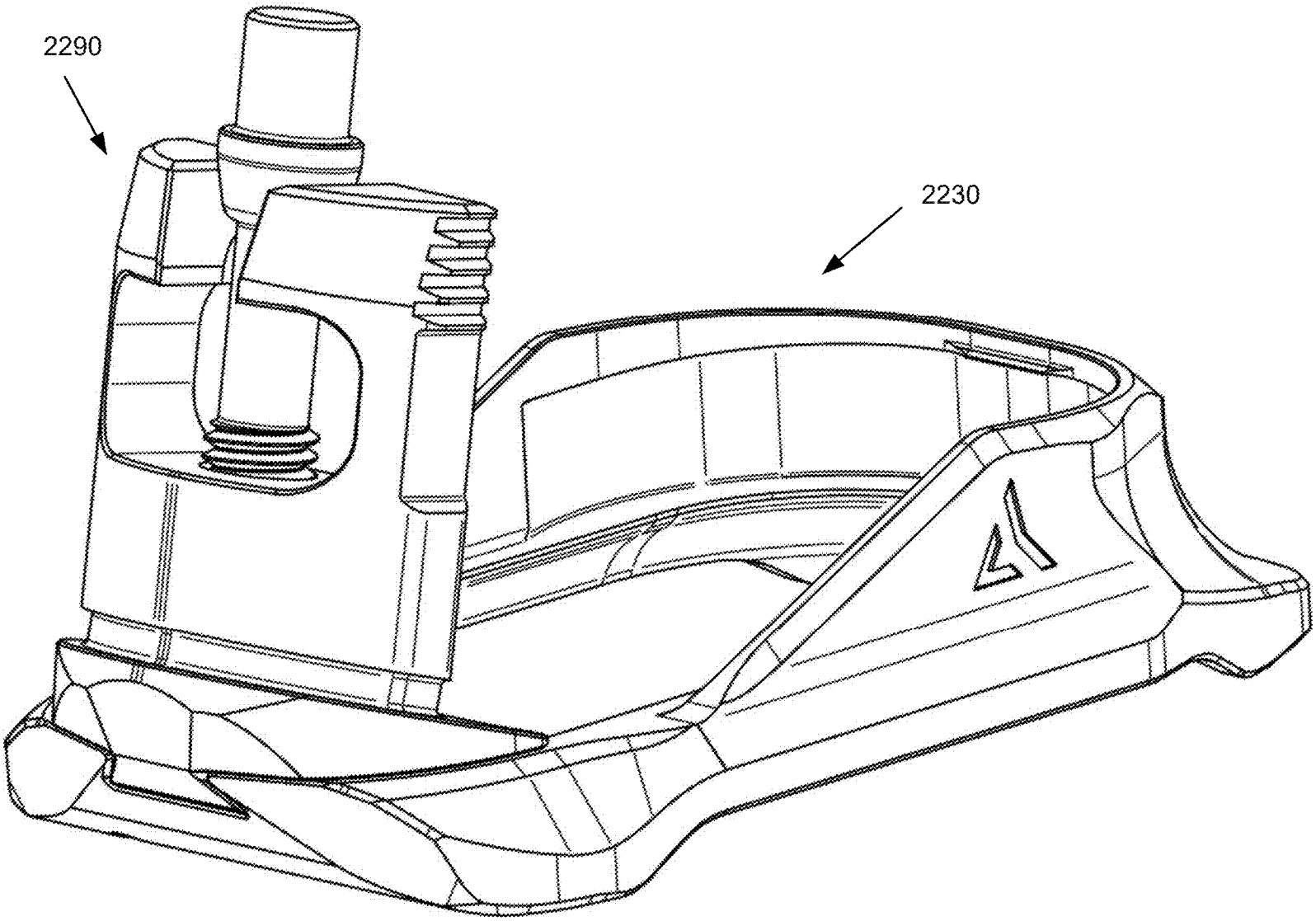
FIG. 23 illustrates an isometric view of FIG. 22 with the grip omitted.
Figure 24A:
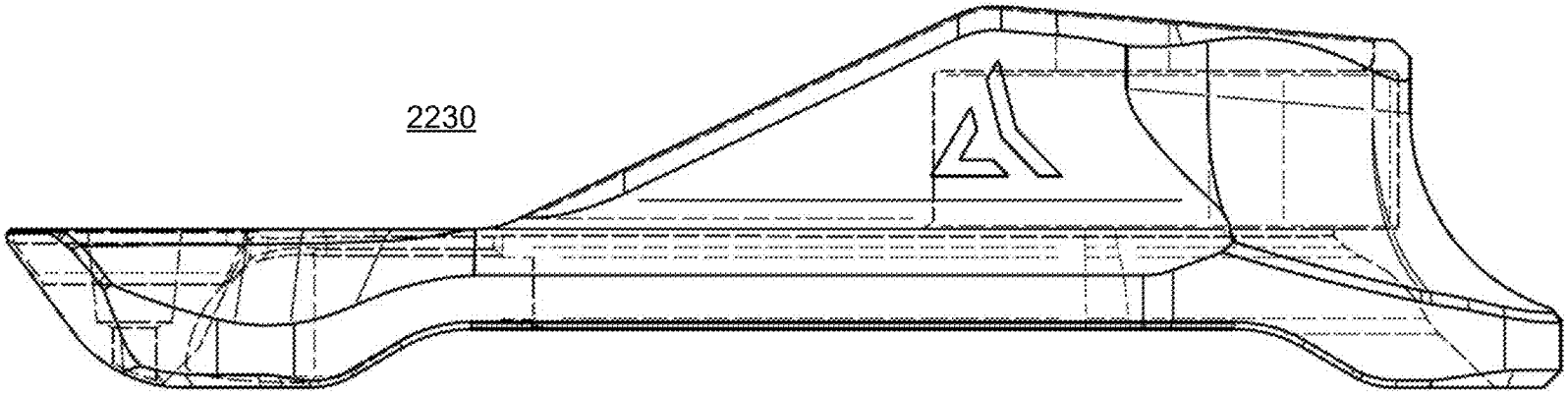
FIG. 24A illustrates a side view of the attachment of FIG. 22A.
Figure 24B:
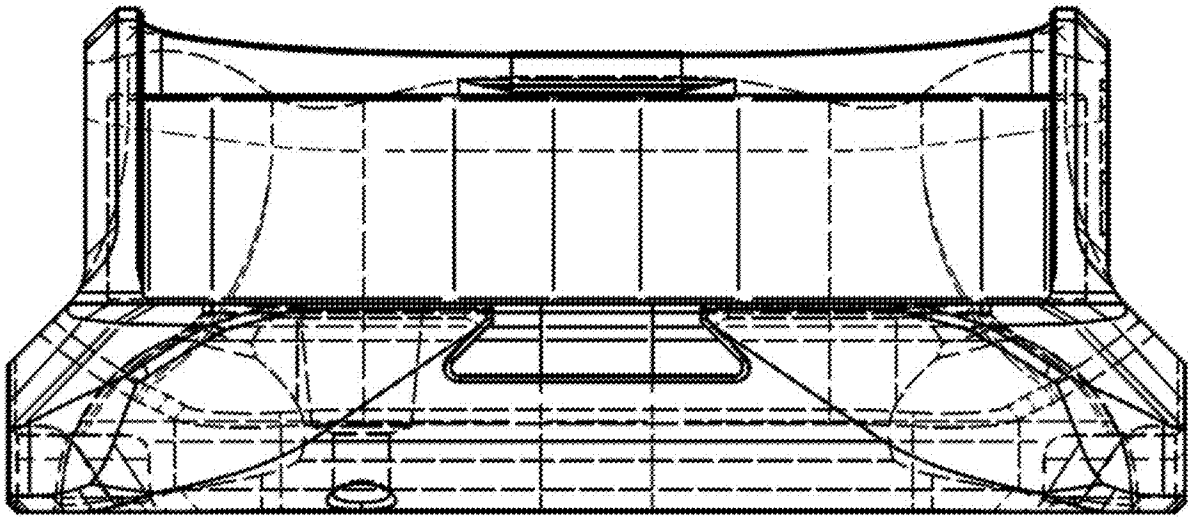
FIG. 24B illustrates a side view of the attachment of FIG. 22A.
Figure 25A:
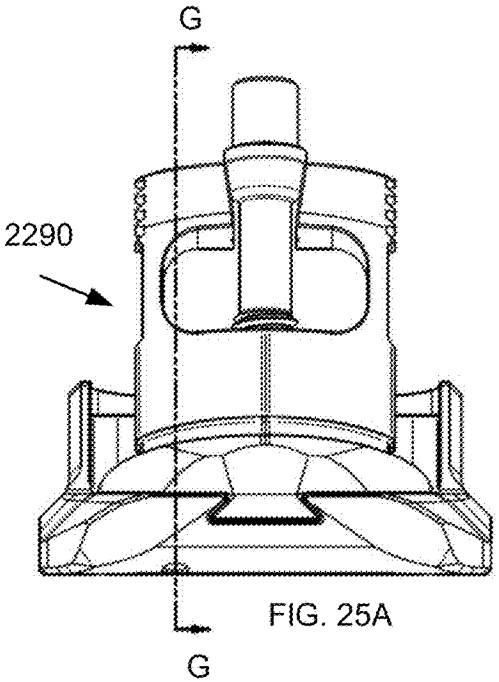
FIG. 25A illustrates a rear end view of the attachment illustrated in FIG. 24A, in which the retention system is coupled thereto.
Figure 25B:
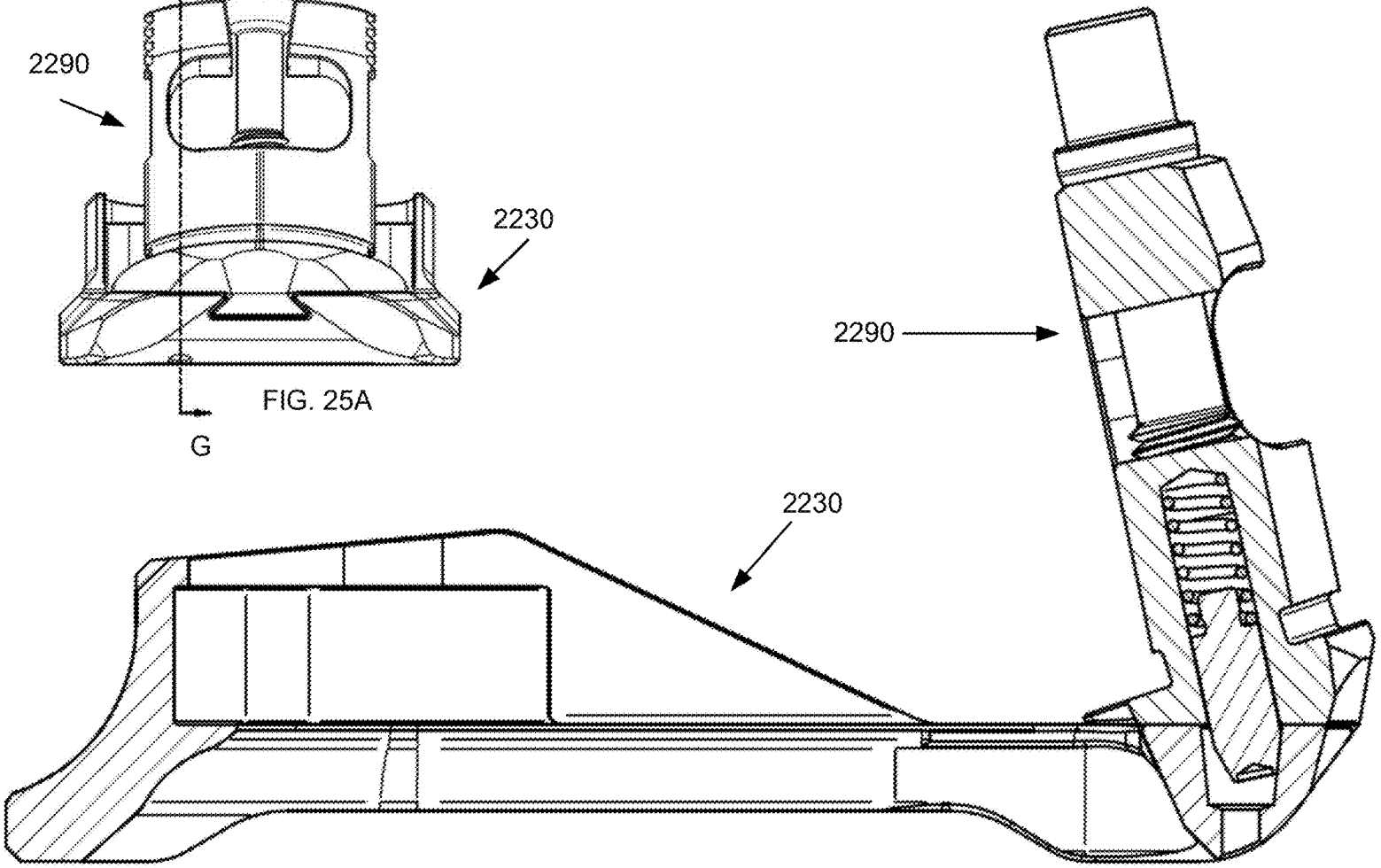
FIG. 25B illustrates a section view taken along section line G-G of FIG. 25A.
Figure 25C:
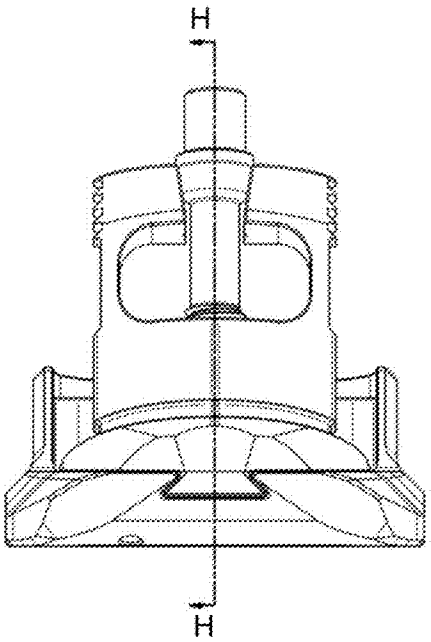
FIG. 25C illustrates a rear end view of the attachment illustrated in FIG. 24A, in which the retention system is coupled thereto.
Figure 25D:
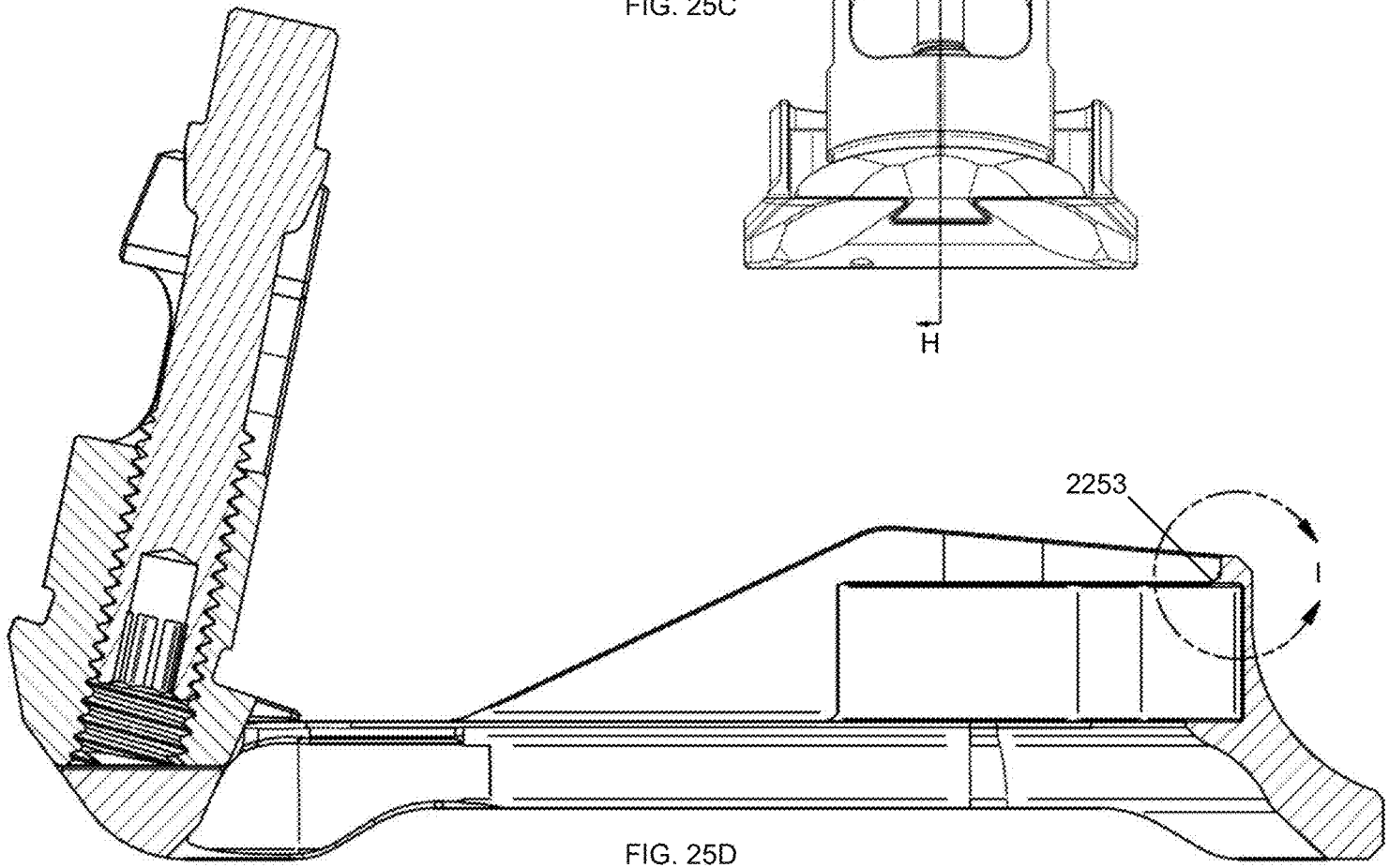
FIG. 25D illustrates a section view taken along section line H-H of FIG. 25C.
Figure 25E:
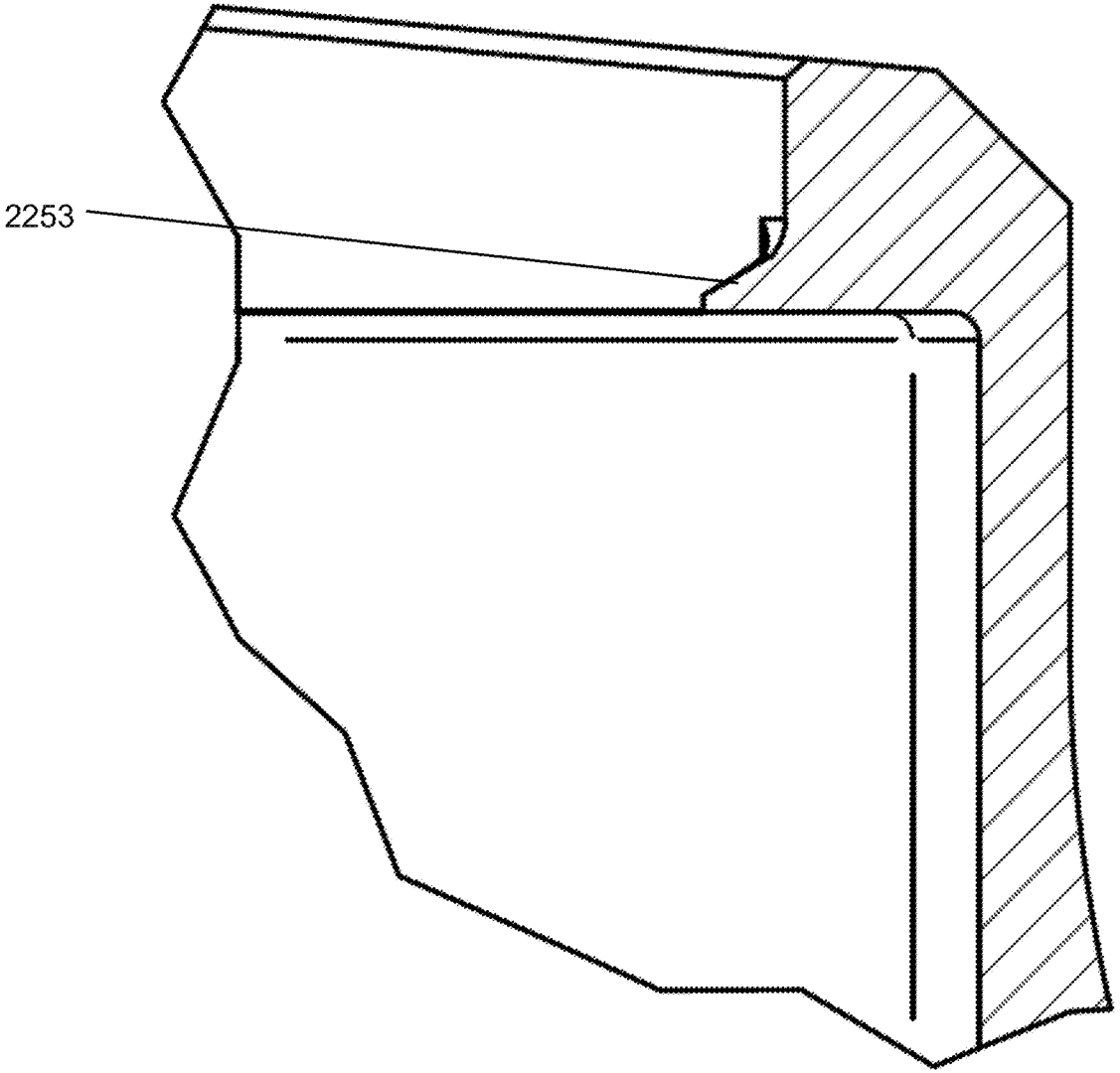
FIG. 25E illustrates a detail I of FIG. 25D.
Figure 26B:
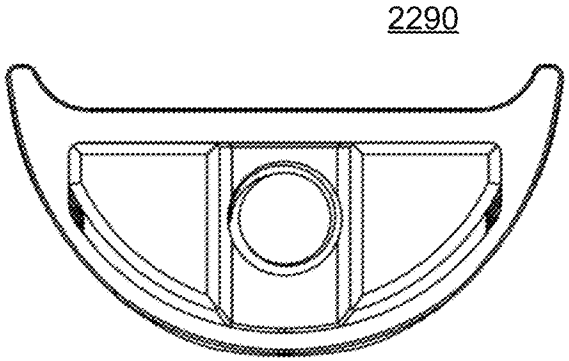
FIGS. 26B and 26C illustrate, respectively, top and bottom views the retention system of FIG. 26A in isolation.
Figure 26C:
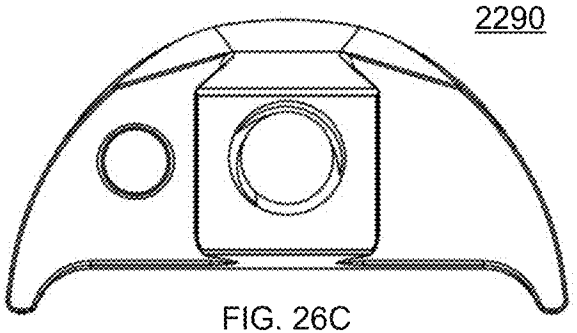
Figure 26A:
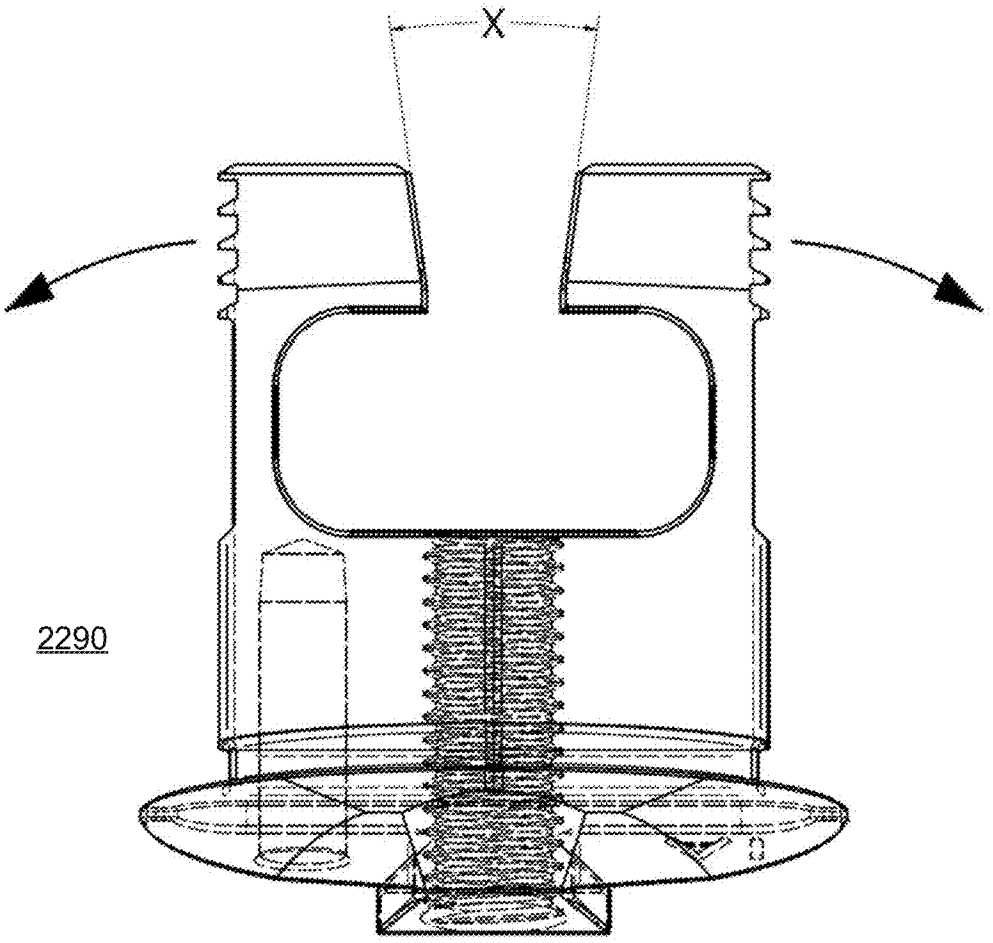
FIG. 26A illustrates a back side view of a body of the retention system of FIG. 22A.
Figure 27A:
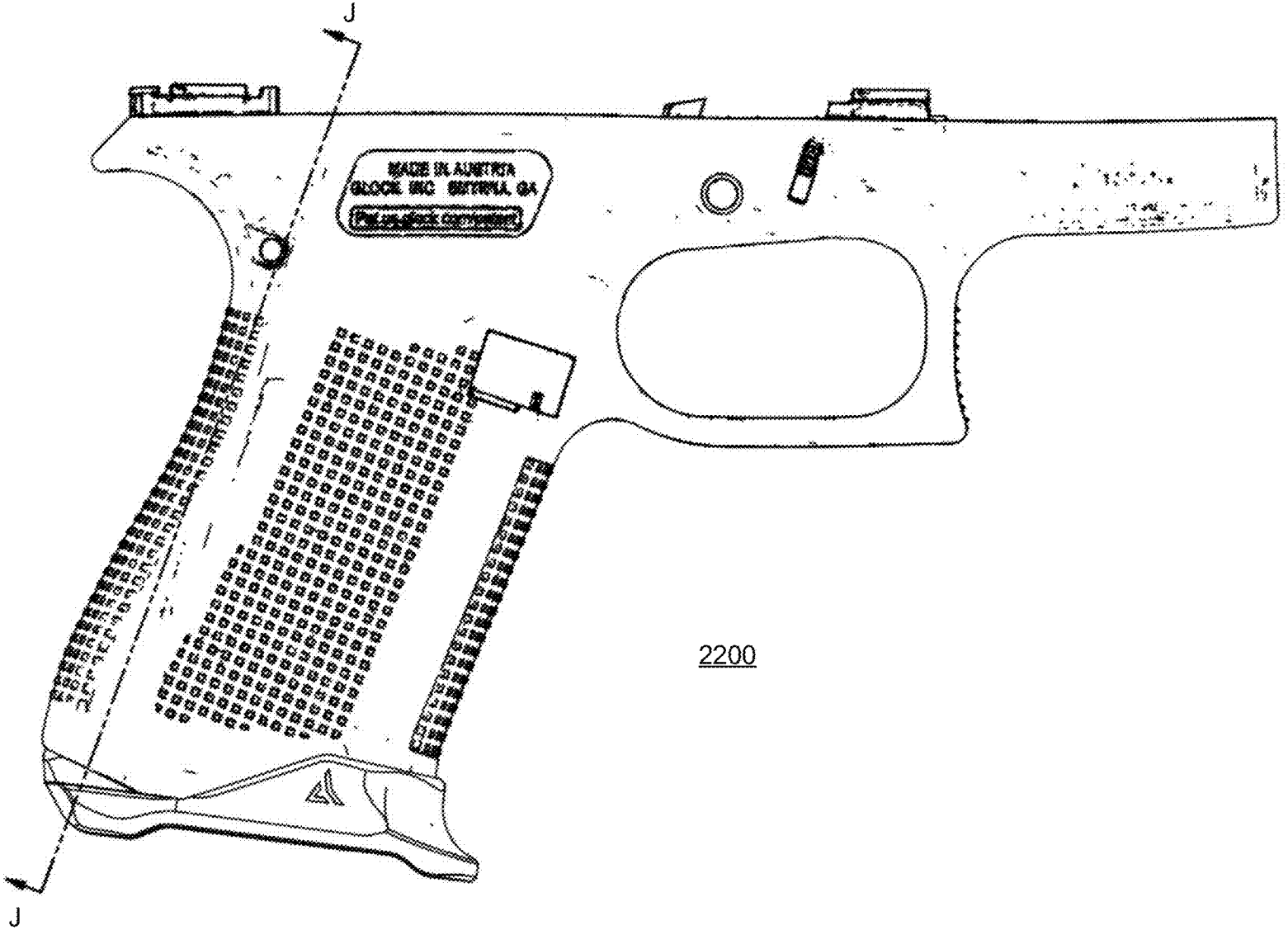
FIG. 27A illustrates a side view of the assembly of FIG. 22A in an assembled state.
Figure 27B:
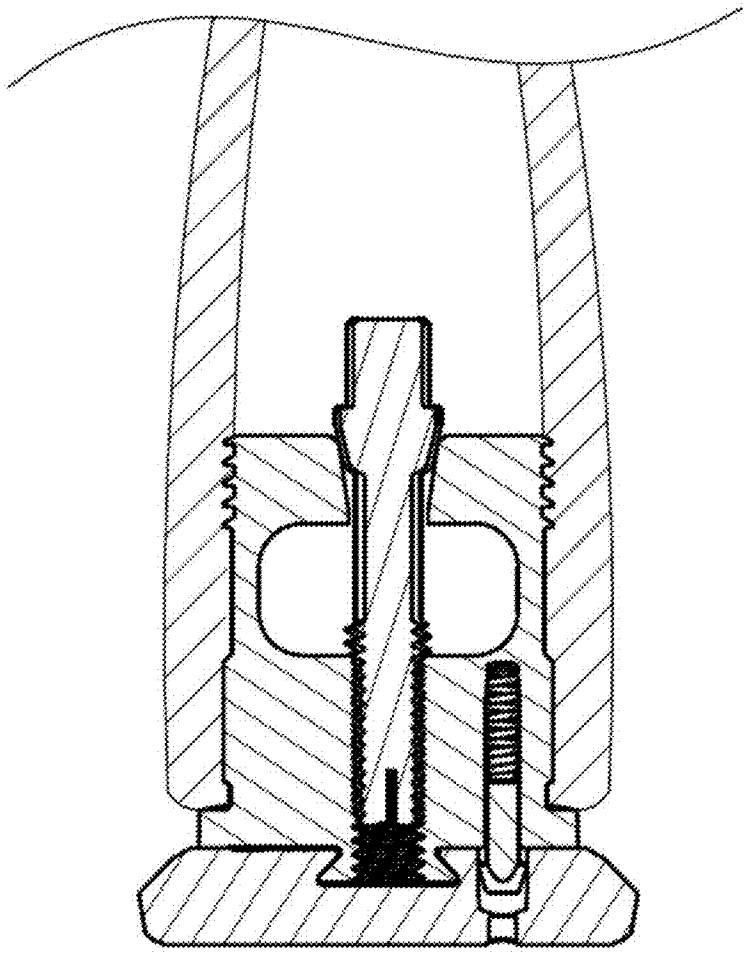
FIG. 27B illustrates a section view taken along section line J-J of FIG. 27A.
Figure 28B:
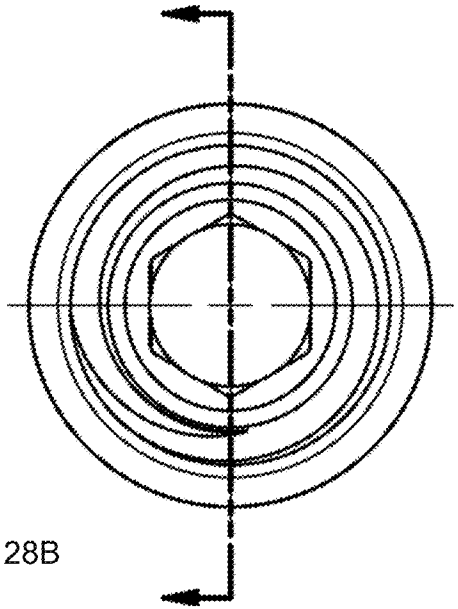
FIGS. 28A, 28B, and 28C illustrate, respectively, side, bottom, and section views of the retaining part of FIG. 22A.
Figure 28C:
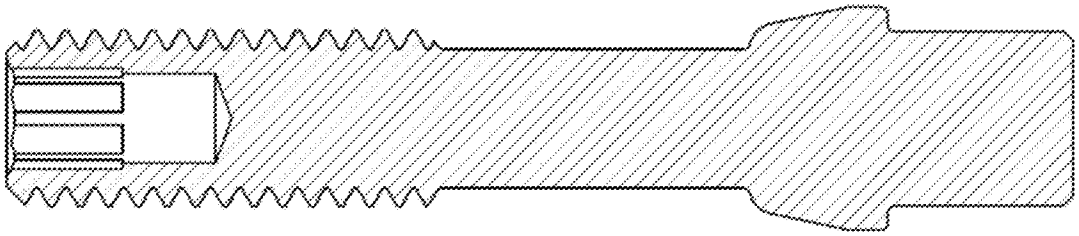
Figure 28A:
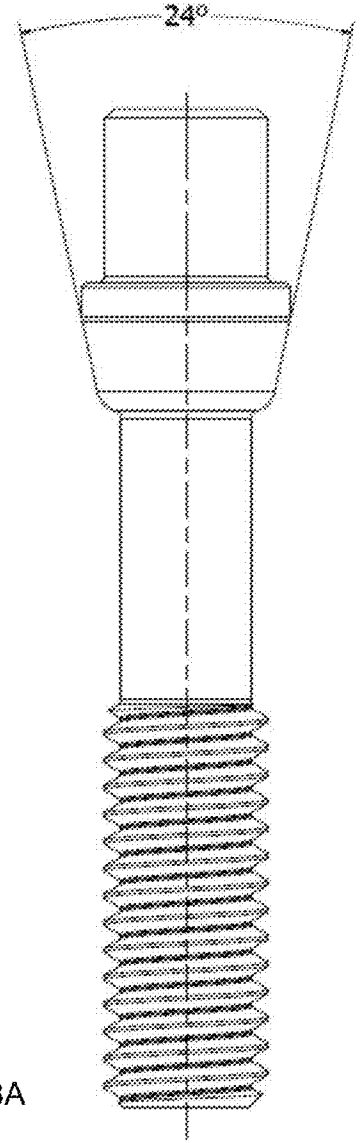

FIG. 22A illustrates an exploded isometric view of an assembly, including an attachment 2230 (e.g., a magwell) and a retention system 2290 utilizing an expandable body, according to various embodiments. FIG. 22B illustrates an isometric view of the assembly 2200 of FIG. 22A, with the attachment 2230 separated therefrom. FIG. 22C illustrates a side view of the assembly 2200 of FIG. 22A in an assembly state. FIG. 22D illustrates a section view taken along section line F-F of FIG. 22C. FIG. 23 illustrates an isometric view of FIG. 22 with the grip 2211 (FIG. 22A) omitted. FIG. 24A illustrates a side view of the attachment 2230 of FIG. 22A. FIG. 24B illustrates a side view of the attachment 2230 of FIG. 22A. FIG. 25A illustrates a rear end view of the attachment 2230 illustrated in FIG. 24A, in which the retention system 2290 is coupled thereto. FIG. 25B illustrates a section view taken along section line G-G of FIG. 25A. FIG. 25C illustrates a rear end view of the attachment 2230 illustrated in FIG. 24A, in which the retention system 2290 is coupled thereto. FIG. 25D illustrates a section view taken along section line H-H of FIG. 25C. FIG. 25E illustrates a detail I of FIG. 25D. FIG. 26A illustrates a back side view of a body of the retention system 2290 of FIG. 22A. FIGS. 26B and 26C illustrate, respectively, top and bottom views the retention system 2290 of FIG. 26A in isolation. FIG. 27A illustrates a side view of the assembly 2200 of FIG. 22A in an assembled state. FIG. 27B illustrates a section view taken along section line J-J of FIG. 27A. FIGS. 28A, 28B, and 28C illustrate, respectively, side, bottom, and section views of the retaining part 2829 of FIG. 22A.

Referring to FIG. 22A, a grip surface (e.g., a tooth 2253) is provided the attachment 2230. When the attachment 2230 is urged against a front of the grip 2211 by operation of the plunger (FIG. 25B), the tooth 2253 is driven against the attachment 2253. In some embodiments, the tooth 2253 is formed from a material at least as hard as a material of the grip 2211, which may case a "biting" of the tooth 2253 into the surface that it is urged against. However, in various embodiments the grip surface and the corresponding surface it is driven into may be any material. Also, instead of the grip tooth 2243 (or grip teeth in another example), the grip surface may be a textured surface or any other grip surface now known or later developed.

In this embodiment, the tooth 2253 is an asymmetrical tooth in which one side is different than the other side (e.g., an angled side and a non-angled side, as illustrated). In other examples, both sides may be angled with different angles (e.g., a barbed tooth). In embodiments in which a portion of a surface of an exterior of the firearm is covered by a portion of a surface (e.g., an interior surface) of the attachment, in which the toothed surface attachment surface is biased against the covered surface, an any embodiment, an angled side of a tooth may be 120 degrees or less, or 100 degrees or less, to optimize bite.

A tooth is one example of a projection of a grip surface—any projection may be used in various embodiments, and a terminal end of that projection may be driven into the covered surface by a biasing. In various examples, the grip surface may be a patterned surface such as a knurled surface or the like.

The grip surface may be spaced apart from part(s) that provide the biasing. For instance, referring again to FIG. 25D the tooth 2253 is longitudinally spaced apart from the interface that provides the biasing of the surface of the tooth 2253 against a covered portion of the firearm (not shown). For example, the interface that provides the biasing may be proximate to one of the front and rear of an attachment part and the tooth or other grip surface may be proximate to the other one of the front and rear of the attachment. Furthermore, any interface to accomplish the desired biasing of the grip surface into the covered surface of the firearm (e.g., any interface now known or later developed) may be used to provide the biasing of the grip surface. As one example, FIG. 7 illustrates a biasing interface in which a rotatably driven fastener is driven into a portion of a grip, to retain an attachment on the grip, in which the head of the rotatably driven fastener may bias a grip surface in a similar way in which the grip surface illustrated in FIG. 25D is biased.

Referring again to FIG. 22A, in this embodiment a grip surface (e.g., teeth 2254) may also be provided on an exterior of the expandable body of the retention system 2290 (e.g., on left and right sides of the expandable body). When the body expands (in response to tightening threaded parts of the retention system), the teeth 2250 may be driven into corresponding surface(s) of the grip 2211.

A remaining part of an exterior of a deformable section of the expanding body may include a relief cut 2257. This may provide clearance between the remaining part of the exterior of the deformable of the expanding body, which may isolate contact between the exterior of the deformable section to the teeth 2254, which may improve the bite.

To provide stability of the installed retention system (so that there is no "play" once it is installed), the relief cut may be substantially limited to the exterior of the deformable part of the expanding body. Another part of that body, which does not expand, e.g., surface 2259, stands proud relative to the relief cut 2257 in this embodiment. In other respects, the system 2200 may be similar in any regard to any other system described herein, such as the system 800 (FIG. 8A).

Figure 29A:
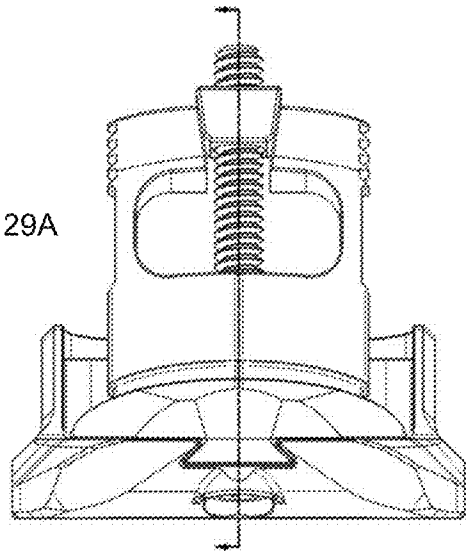
FIG. 29A illustrates a rear end view of another attachment including a grip surface (e.g., a tooth), according to various embodiments.
Figure 29B:
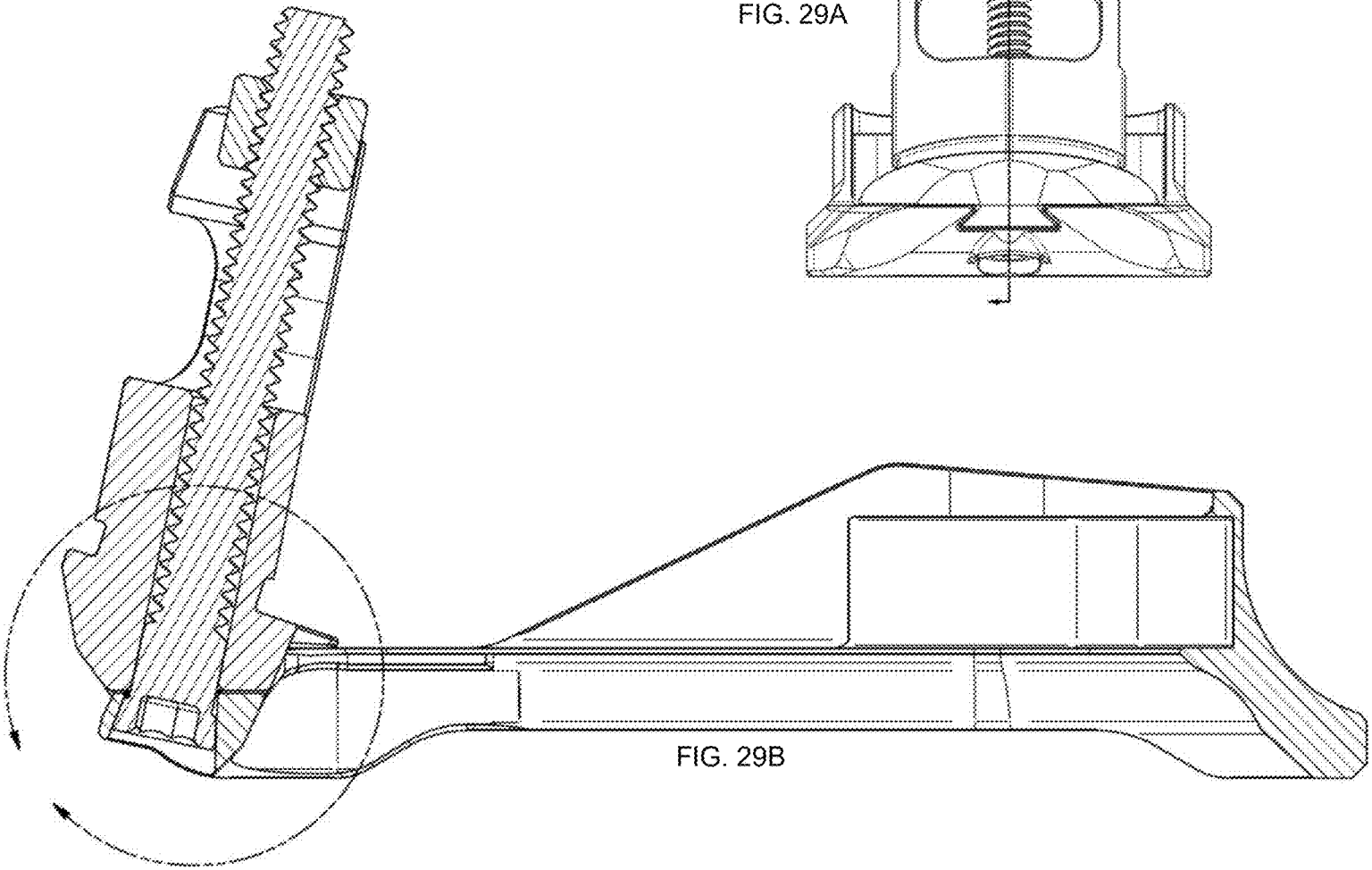
FIG. 29B illustrates a section view taken along the line of FIG. 29A.
Figure 29C:
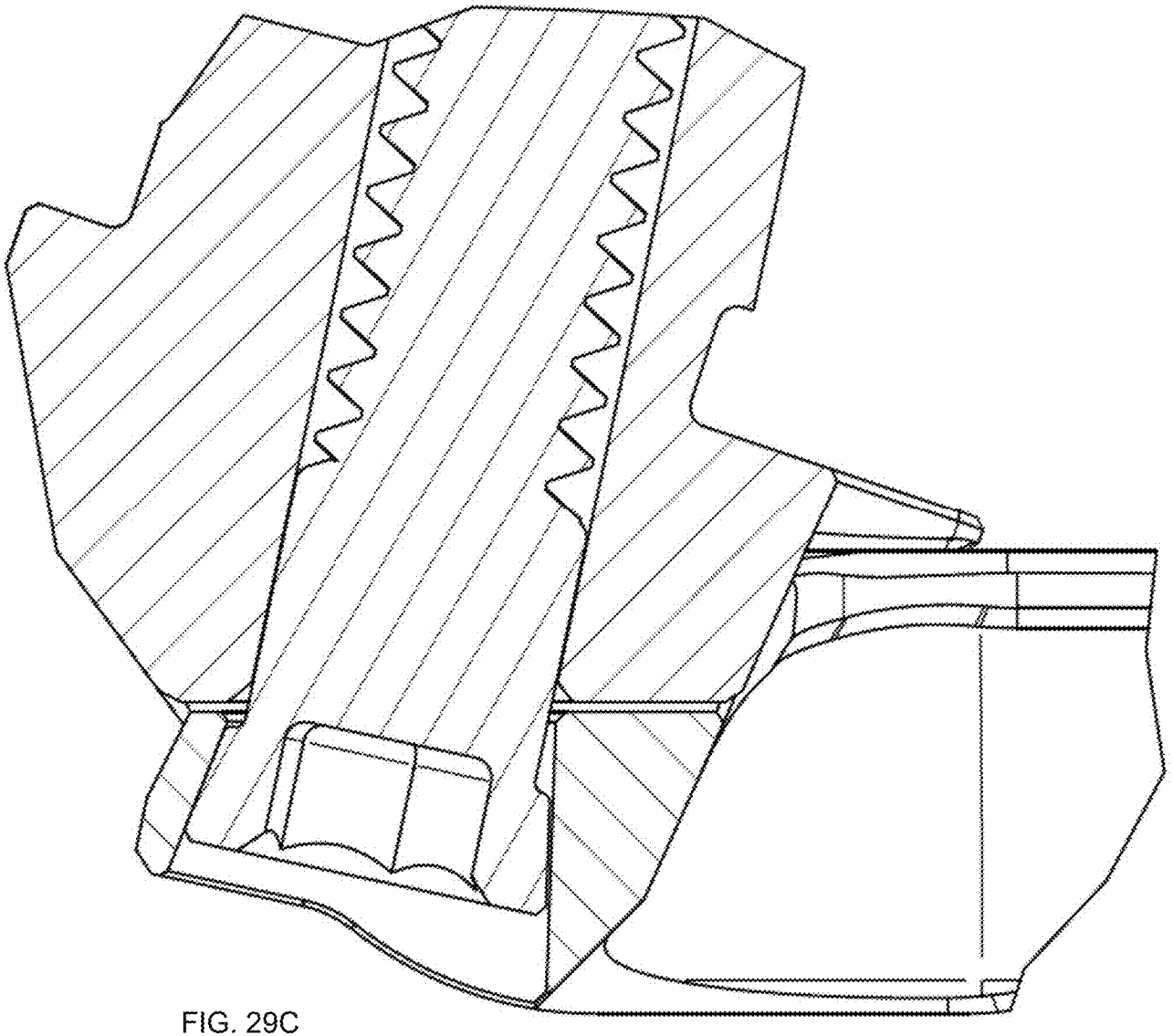
FIG. 29C illustrates a detail of FIG. 29B.

Also, of course, any grip surface described herein may be employed with 1) any other attachment described herein or 2) any other attachment now known or later developed. For instance, any grip surface described herein may be utilized with an attachment interface that biases an attachment against a firearm part using any mechanism now known, or later developed. The biasing, which may drive the attachment into the corresponding surface of the firearm part, may produce a similar biting of a tooth or other grip surface into a corresponding surface of the firearm part. FIG. 29A illustrates a rear end view of another attachment to bias a grip surface against a portion of an exterior of a firearm, including a grip surface (e.g., a tooth) to over that portion of the exterior of the firearm, according to various embodiments. FIG. 29A illustrates a section view taken along the line of FIG. 29B. FIG. 29C illustrates a detail of FIG. 29B.

Retention System to Direct Expansion of Expanding Body

As previously explained herein, a firearm part such as a grip may include two openings, including a magazine receptacle and an aftly-positioned additional opening. That additional opening may be referred to elsewhere herein as a process artifact, given that it was not designed to provide any function post-manufacturing.

Various known attachments may include a collet to expand within this aftly-positioned additional opening, in order to install known grip accessories such as magazine funnels (e.g., magwell). However, when the known collet expands it may produce deformation in the grip.

While this grip deformation may never be detectable by an operator of the firearm by sight and/or by touch, and it may be unknown to manufacturers of the collet and/or the grip, this small deformation may nevertheless impact operation of the firearm. By way of background, the magazine receptacle is precisely sized so that the weight of an empty standard magazine is sufficient to overcome resistance between an exterior of the magazine body and an interior of the magazine receptacle, which is what enables an empty magazine to fall away (due to gravity) when a user actuates a magazine release. An operator of the firearm, or the firearm manufacturer, may incorrectly conclude that the magazine has a fitment/reliability problem and/or that the firearm has a reliability problem.

In reality, the small grip deformation caused by the collet in known grip accessories is the culprit. It may produce a small increase in the friction between the exterior of the magazine and the interior of the magazine receptacle, which may no longer be overcome by the force of gravity.

A partial solution is to increase the weight of the magazine, so the increased friction may be overcome. Whether this partial solution eliminates the problem or not may depend on how tightly an installer tightens the threaded parts that cause the expansion of the collet, the state of the grip material at the time the collet is expanded (e.g., age, temperature, etc.), and other factors.

In various embodiments, a retention system with directed expansion of the expanding body—different than the known expansion (e.g., the uniform or "three-dimensional" expansion produced by the known collet). Referring to FIG. 22D, the magazine receptacle and the aftly-located opening containing the retention system 2290 are partitioned by a thin wall 2278 of material. The problematic deformation caused by known collets can be avoided by providing directed expansion that does not substantially increase force applied to this thin wall 2278 when the threaded parts of the retention system 2290 are tightened.

The directed expansion avoids (or minimizes) expansion in both fore and aft direction. Expansion in the fore direction may apply deformation-producing force to the thin wall 2278 as a first order effect. Expansion in the aft direction (e.g., in a direction 180 degrees away from the thin wall 2278) may apply deformation-producing force to the thin wall 2278 as a second order effect. Specifically, the application of force on the back of the aftly-located cavity produces an equal and opposite counter force on the known retention system. The application of this counter force, with known collets, in turn may cause the known retention system to apply deformation-producing force on the thin wall 2278—interfering with release of an empty magazine.

The directed expansion of some expandable bodies of various retention systems described herein may be referred to as a directed expansion, as opposed to uniform expansion of known collets. The directed expansion may be in lateral directions, in some embodiments. This is illustrated in FIG. 12A, in which the arrows Y illustrate the lateral expansion.

Referring now to FIG. 22A, in this embodiment the expandable portion of the expanding body includes arms. The arrangement of the retention system restricts expansion of this expandable portion, via movement of the arms, to direction(s) that are not toward the wall 2278 (FIG. 22D). For instance, expansion of the right arm to the right and the left arm to the left may apply force to the left and right sidewalls of the additional opening. Accordingly, tightening the retention system does not deform the magazine receptacle.

The retention system 2290 has various other advantages compared to some known retention systems for grip attachments. Expansion of known collets may be driven via conical contact between a threaded part and the collet. Manufacturing a collet to be driven by conical contact may be expensive, may result in a high degree of variability of the fitment of the collet and a threaded part, and/or may result in a high degree of variability of expansion of the collet during installation.

In contrast to the conical contact as in known retention systems that use collets, the expansion body illustrated in FIG. 22A includes a non-conical surface 2288 (e.g., a flat) to contact corresponding surfaces of the threaded parts. These non-conical surfaces 2288 may be manufactured less expensively and/or with less variability than the conical surface of the known collets.

In this embodiment, a slope of the corresponding surface of the separable parts (e.g., of a head or some other surface of threaded parts) may be conical. The engagement of the conical surface of the parts to drive the expansion with the non-conical surface of the expandable portion of the expandable body may be non-conical contact (e.g., line contact). This also may provide a predictable force driving the grip surfaces 2254 against the corresponding surfaces of the grip 2211.

Although the illustrated embodiment utilizes an expanding body with arms, instead of the known collets, it may be possible and practical to utilize a collet structure in various embodiments of a retention system. In these embodiments, a collet may include two or less expanding segments in which movement thereof is orthogonal to the partition/wall (e.g., movement in directions that do not intersect a cavity of the magazine receptacle. For example, the directions may be similar to the curved arrows Y in FIG. 12A. In various embodiments, directions of expansion of the expandable portion of the expanding body may be along a plane that is non-intersecting with a cavity of the magazine receptacle.

In the illustrated embodiment of FIG. 22A, the corresponding surface is part of a head of an externally threaded part (e.g., a threaded bolt). In other embodiments, a corresponding surface may be part of an internally threaded part (e.g., a threaded nut). In various embodiments a corresponding surface may be any surface of a set of parts, which may include threaded parts and optionally additional parts, usable with an expandable body, in which the expandable body is configured to restrict expansion to directions along a plane when the threaded parts are tightened. The plane may be non-intersecting with the magazine receptacle.

EXAMPLES

Example A1 is an apparatus to operate in a recoil environment, the apparatus including: an attachment configured to slidably couple to a firearm; wherein the attachment includes: a slideable attachment interface to restrict a coupling movement of the attachment relative to the at least one part, wherein the coupling movement is along a plane, wherein the slideable attachment interface comprises a male feature or a female feature of: a dovetail interface; a T-slot interface; or another undercut interface; and an additional interface associated with a separable part, the additional interface to further restrict movement of the attachment relative to the at least one part; wherein the separable part comprises a non-threaded part.

Example A2 includes the subject matter of example A1 or any other example herein, wherein the attachment comprises 1) a magazine funnel or other grip accessory to slideably couple to a grip of the firearm, or 2) another grip attachment to slideably couple to the grip of the firearm.

Example A3 includes the subject matter of any of examples A1-A2, or any other example herein, wherein a portion of a surface of the attachment, spaced apart from an opening to receive the non-threaded part, covers a portion of a surface of an exterior of the firearm; and wherein the portion of the surface of the attachment comprises at least one projection or a textured pattern, and the non-threaded part is configured to bias the at least one projection or textured pattern against the covered portion of the surface of the exterior of the firearm.

Example A4 includes the subject matter of example A3, or any of examples A1-A3, or any other example herein, wherein the at least one projection comprises a tapered structure.

Example A5 includes the subject matter of example A4, or any of examples A1-A4, or any other example herein, wherein the tapered structure comprises at least one angled surface, wherein an angle of an angled surface of the at least one angled surface is 120 degrees or less.

Example A6 includes the subject matter of example A5, or any of examples A1-A5, or any other example herein, wherein the angle is 100 degrees or less.

Example A7 includes the subject matter of example A3, or any of examples A1-A6, or any other example herein, wherein the at least one projection comprises a single tooth.

Example A8 includes the subject matter of example A3, or any of examples A1-A7, or any other example herein, wherein the grip surface is located on an interior surface of the attachment; wherein the attachment includes fore and aft regions, or other opposing regions; and wherein the attachment interface is located on one of the fore and aft regions, or on one of the other opposing regions, and the grip surface is located on the other one of the fore and aft regions, or the other one of the other opposing regions.

Example A9 includes the subject matter of example A1, or any of examples A1-A8, or any other example herein, wherein the attachment comprise an optic adapter.

Example A10 includes the subject matter of example A1, or any of examples A1-A9, or any other example herein, wherein the attachment comprises a direct mount optic sight.

Example A11 is an apparatus to operate in a recoil environment, the apparatus including: an attachment configured to slidably couple to a firearm, the attachment including a threadless region to couple to one or more corresponding threadless regions of at least one part: wherein the attachment includes: a slideable attachment interface to restrict a coupling movement of the attachment relative to the at least one part, to a fore/aft movement, wherein the coupling movement is along a plane, wherein the slideable attachment interface comprises a male feature or a female feature of: a dovetail interface; a T-slot interface; or another undercut interface; and an additional interface associated with a separable part, the additional interface to restrict a fore/aft position of the attachment relative to the at least one part; a portion of the length of the separable part to urge the attachment in a direction that is parallel with the plane; wherein the separable part includes terminal ends and a length, the attachment to apply, in an opposite direction, a counter force on the portion of the length of the separable part.

Example A12 includes the subject matter of example A11, or any other example herein, wherein the attachment comprises a grip attachment, an optic adapter, or an optic sight.

Example A13 includes the subject matter of example A11, or any of examples A11-A2, or any other example herein, wherein the separable part comprises a rotatably driven part including a threaded section and a non-threaded section; wherein the portion of the length comprises part of the non-threaded section.

Example A14 includes the subject matter of example A11, or any of examples A11-A13, or any other example herein, wherein the portion of the length is part of a tapered or sloped section of the separable part.

Example A15 includes the subject matter of example A11, or any of examples A11-A14, or any other example herein, wherein the direction is includes a forward component or a rearward component.

Example A16 includes the subject matter of example A11, or any of examples A11-A15, wherein the attachment comprises an optic adapter or an optic sight and the direction is parallel with a bore axis of a barrel of the firearm.

Example A17 includes the subject matter of example A15, or any of examples A11-A16, wherein the attachment comprises a grip attachment and the direction is perpendicular with a canted axis or a vertical non-canted axis.

Example A18 includes the subject matter of example A11, or any of examples A11-A17, wherein the slideable attachment interface comprises a first portion of an attachment interface and the additional interface comprises a second portion of the attachment interface that is different than the first and second portions; wherein the attachment interface includes a third portion that is different than the first and second portions.

Example A19 includes the subject matter of example A18, or any of examples A11-A18, wherein the third portion of the attachment interface includes a surface having a grip feature, wherein the urge the attachment drives the grip feature against a corresponding surface of the firearm; wherein the grip feature comprises a grip tooth or a textured surface.

Example A20 is an apparatus to operate in a recoil environment, the apparatus including: an attachment configured to slidably couple to a firearm; wherein the attachment includes: a slideable attachment interface to restrict a coupling movement of the attachment relative to the at least one part, wherein the coupling movement is along a plane, wherein the slideable attachment interface comprises a male feature or a female feature of: a dovetail interface; a T-slot interface; or another undercut interface; and an additional interface associated with a separable part, the additional interface to further restrict movement of the attachment relative to the at least one part; a portion of the length of the separable part to urge the attachment against a surface of the firearm, the urge the attachment to resist movement of the attachment, along the plane, away from the surface of the firearm, wherein the separable part includes terminal ends and a length, the attachment to apply a counter force on the portion of the length of the separable part.

Example B1 is an apparatus to operate in a recoil environment, the apparatus including: a slide including; a receiving surface on which an optic sight or an optic adapter is mountable; wherein a rear of the slide includes a rear cover opening; the receiving surface including a slide opening contiguous with the rear cover opening.

Example B2 is an attachment mountable on the slide of example B1, wherein the attachment comprises the optic sight or the optic adapter.

Example B3 includes the subject matter of example B2, or any of examples B1-B2, or any other example herein, wherein an underside of the attachment includes a portion of an internal slide structure corresponding to the slide opening.

Example B4 includes the subject matter of example B2, or any of examples B1-B3, or any other example herein, wherein an underside is configured to slottingly receive a portion of a rear cover when the rear cover encloses the rear cover opening.

Example B5 includes the subject matter of example B2, or any of examples B1-B4, or any other example herein, wherein a rear cover is installable or removable from the rear cover opening when the optic sight or optic adapter is mounted on the receiving surface.

Example B6 is an apparatus, comprising: an optic adapter for mounting onto a receiving surface of a slide, the optic adapter including: a first side comprising a footprint corresponding to an underside of an optic sight; a second side opposite to the first side, wherein the second side includes: one or more discontinuities, wherein the one or more discontinuities are part of attachment interface(s) to retain the optic adapter on the slide; and at least one additional discontinuity, wherein the at least one additional discontinuity is not part of the attachment interfaces; and a region rearward of the at least one additional discontinuity, wherein when the optic adapter, the slide, and a rear cover are assembled no portion of the slide is located between at least a portion of the rear cover and at least a portion of said region.

Example B7 includes the subject matter of example B6, or any other example herein, wherein the at least one additional discontinuity comprises forms an internal slide structure with a corresponding discontinuity on the receiving surface of the slide, when the optic adapter is mounted on the slide.

Example B8 includes the subject matter of example B7, or any of examples B6-B7, or any other example herein, wherein the one or more discontinuities comprises plural discontinuities surrounding or flanking the additional discontinuity.

Example B9 includes the subject matter of example B6, or any of examples B6-B8, or any other example herein, wherein the optic adapter is mounted on the receiving surface of the slide, at least part of the attachment is closer to a bore axis of a firearm than an uppermost part of an internal slide structure of the firearm.

Example B10 includes the subject matter of example B6, or any of examples B6-B9, or any other example herein, wherein the at least one discontinuity comprises: a first section to form an internal slide structure with a corresponding discontinuity on the receiving surface of the slide; and a second section combinable to form a rear cover opening when the optic adapter is mounted on the receiving surface of the slide, in which a rear cover is optionally 1) installable or 2) removable from the rear cover opening while the optic adapter is mounted on the receiving surface.

Example B11 is an apparatus, comprising: an optic adapter or an optic sight for mounting onto a receiving surface of a slide, the optic adapter or optic sight including: an underside including: one or more discontinuities, wherein the one or more discontinuities are part of attachment interface(s) to retain the optic adapter or the optic sight on the slide; and at least one additional discontinuity, wherein the at least one additional discontinuity is not part of the attachment interfaces; and a region rearward of the at least one additional discontinuity, wherein when the optic adapter or the optic sight, the slide, and a rear cover are assembled no portion of the slide is located between at least a portion of the rear cover and at least a portion of said region.

Example B12 includes the subject matter of example B11, or any other example herein, wherein the at least one additional discontinuity comprises forms an internal slide structure with a corresponding discontinuity on the receiving surface of the slide, when the optic adapter or optic sight is mounted on the slide.

Example B13 includes the subject matter of example B12, or any of examples B11-B12, or any other example herein, wherein the one or more discontinuities comprises plural discontinuities surrounding or flanking the additional discontinuity.

Example B14 includes the subject matter of example B12, or any of examples B11-B13, or any other example herein, wherein the optic adapter or optic sight is mounted on the receiving surface of the slide, at least part of the optic adapter or optic sight is closer to a bore axis of a firearm than an uppermost part of an internal slide structure of the firearm.

Example B15 includes the subject matter of example B11, or any of examples B11-B15, or any other example herein, wherein the at least one discontinuity comprises: a first section to form an internal slide structure with a corresponding discontinuity on the receiving surface of the slide; and a second section combinable to form a rear cover opening when the optic adapter is mounted on the receiving surface of the slide, in which a rear cover is optionally 1) installable or 2) removable from the rear cover opening while the optic adapter or optic sight is mounted on the receiving surface.

Example B16 includes the subject matter of example B1, or any of examples B1-B5, or any other example herein, wherein a striker assembly is viewable through the slide opening from a top view perspective when the optic adapter or optic sight is not mounted to the receiving surface.

Example B17 includes the subject matter of example B6, or any of examples B6-B10, or any other example herein, wherein a striker assembly is viewable through the slide opening from a top view perspective when the optic adapter or optic sight is not mounted to the receiving surface.

Example B18 is an operatively assembled firearm with an optic assembly comprising the apparatus of claim B6, or any of examples B6-B10, or any other example herein, wherein an internal assembly of the operatively assembled firearm can be exposed by removing only the optic assembly from the operatively assembled firearm.

Example B19 includes the subject matter of example B18, wherein the internal assembly comprises a striker assembly.

Example B20 is an operatively assembled firearm with an optic assembly comprising the apparatus of claim B11, or any of examples B11-B15, or any other example herein, wherein a striker assembly or another internal assembly of the operatively assembled firearm can be exposed by removing only the optic assembly from the operatively assembled firearm.

Example C1 is an apparatus to operate with a firearm grip, in which the firearm grip includes two openings, including a magazine receptacle and an aftly-positioned additional opening, the openings partitioned by a wall, the apparatus comprising: a retention system insertable into the aftly-positioned additional opening, the retention system including: a drive section; and an expansion section, driven by the drive section, and configured to restrict expansion to direction(s) that are not toward the wall.

Example C2 includes the subject matter of example C1, or any other example herein, wherein the retention system is integrated with an attachment or the attachment is configured to couple to the retention system.

Example C3 includes the subject matter of example C1, any of examples C1-C2, or any other example herein, wherein the expansion system comprises opposing arms, the expansion system to drive the opposing arms apart from each other.

Example C4 includes the subject matter of example C1, any of examples C1-C3, or any other example herein, wherein the retention system includes a slideable attachment interface to couple an attachment to the retention system, the slideable attachment interface to restrict a coupling movement of the attachment relative to the firearm grip, wherein the coupling movement is along a plane, wherein the slideable attachment interface comprises a male feature or a female feature of a dovetail interface, a T-slot interface, or another undercut interface.

Example C5 includes the subject matter of example C1, any of examples C1-C4, or any other example herein, wherein the retention system includes one or more flats to engage one or more corresponding surfaces of the drive section, respectively.

Example C6 is an apparatus, comprising: an attachment configured to couple to a firearm, the attachment including: a surface to cover a portion of a surface of an exterior of the firearm when the attachment is coupled to the firearm; and an attachment interface configured to bias said surface of the attachment against the covered portion of the surface of the exterior of the firearm, in which the surface of the attachment includes a grip feature.

Example C7 includes the subject matter of example C6, or any other example herein, wherein the grip feature comprises at least one projection or a textured pattern.

Example C8 includes the subject matter of example C7, or any of examples C6-C7, or any other example herein, wherein a terminal end of a projection of the at least one projection, and the terminal end to bite into the covered surface when the attachment interface is tightened.

Example C9 includes the subject matter of example C6, or any of examples C6-C8, or any other example herein, wherein the at least one projection comprises an asymmetrical tooth.

Example C10 includes the subject matter of example C9, or any of examples C6-C9, or any other example herein, wherein the asymmetrical tooth includes at least one angled side, wherein an angle of an angled side of the at least one angled side is 120 degrees or less.

Example C11 is an apparatus, comprising: an attachment configured to couple to a firearm, the attachment including: a retention system insertable into an opening positioned aftly of a magazine receptacle, the retention system including a drive section and an expansion section, driven by the drive section, and configured to restrict expansion to direction(s) that are not toward a wall that partitions the opening and the magazine receptacle, or an attachment interface and an associated surface to cover a portion of a surface of an exterior of the firearm when the attachment is coupled to the firearm, the attachment interface configured to bias said associated surface against the covered portion of the surface of the exterior of the firearm, in which the associated surface includes a grip feature.

Example C12 includes the subject matter of example C11, or any other example herein, wherein the attachment includes the attachment interface and the associated surface, and wherein the grip feature comprises at least one projection or a textured pattern.

Example C13 includes the subject matter of example C12, or any of examples C11-C12, wherein a terminal end of a projection of the at least one projection, and the terminal end to bite into the covered surface when the attachment interface is tightened.

Example C14 includes the subject matter of example C13, or any of examples C11-C13, or any other example herein, wherein the at least one projection comprises an asymmetrical tooth.

Example C15 includes the subject matter of example C14, or any of examples C11-C14, or any other example herein, wherein the asymmetrical tooth includes at least one angled side, wherein an angle of an angled side of the at least one angled side is 120 degrees or less.

Example C16 includes the subject matter of example C15, or any of examples C11-C15, or any other example herein, wherein the angled side is 100 degrees or less.

Example C17 includes the subject matter of example C11, or any of examples C11-C16, or any other example herein, wherein the attachment comprises magazine funnel or another grip attachment.

Example C18 includes the subject matter of example C11, or any of examples C11-C17, or any other example herein, wherein the attachment interface comprises a threaded part.

Example C19 includes the subject matter of example C11, or any of examples C11-C19, or any other example herein, wherein the attachment interface comprises a spring-biased non-threaded part.

Example C20 includes the subject matter of example C11, or any of examples C11-C19, or any other example herein, wherein the attachment interface comprises a retention system installable in an opening in a grip, the opening located aftly of a magazine receptacle.

We claim all modifications and variations coming within the spirt and scope of the following claims.

The invention claimed is:

1. An apparatus to operate with a firearm grip, in which the firearm grip includes two openings, including a magazine receptacle and an aftly-positioned additional opening, the openings partitioned by a wall, the apparatus comprising:

a retention system insertable into the aftly-positioned additional opening, the retention system including:

a drive section; and an expansion section including an exterior, the expansion section driven by the drive section;

wherein a portion of the exterior, operable to engage an interior of the aftly-positioned opening to retain a body of the retention system in the aftly-positioned additional opening, is drivable against a receiving portion of the interior, characterized in that said receiving portion is not part of said wall.

2. The apparatus of claim 1, wherein the retention system is integrated with an attachment or the retention system is usable to couple the attachment to the firearm grip.

3. The apparatus of claim 1, wherein the expansion section comprises opposing arms, the opposing arms drivable apart from each other by the drive section.

4. An apparatus to operate with a firearm grip, the apparatus comprising:

a retention system insertable into an opening in the firearm grip, the retention system including:

a drive section; and an expansion section driven by the drive section;

wherein the retention system includes a slideable attachment interface to couple an attachment, having a corresponding attachment interface, to the retention system, the slideable attachment interface to restrict a coupling movement of the attachment relative to the firearm grip, wherein the coupling movement is along a plane, wherein the slideable attachment interface comprises a male feature or a female feature of a dovetail interface, a T-slot interface, or another undercut interface.

5. The apparatus of claim 4, further comprising the attachment, the attachment including:

a surface to cover a portion of an exterior of the firearm grip when the attachment is coupled to the firearm grip, in which the surface is biased against the covered portion of the surface of the firearm grip, in which the surface includes a grip feature.

6. An apparatus, comprising:

an attachment; and a retention system to couple the attachment to a firearm, the retention system insertable into an opening positioned aftly of a magazine receptacle, the retention system including a drive section and an expansion section, driven by the drive section, wherein a portion of an exterior of the expansion section, operable to engage an interior of said opening to retain a body of the retention system in said opening, is drivable against a receiving portion of the interior, characterized in that said receiving portion is not part of a wall between the opening and the magazine receptacle.

7. The apparatus of claim 5, wherein the grip feature comprises at least one projection or a textured pattern.

8. The apparatus of claim 7, wherein a projection of the at least one projection includes a terminal end to bite into the covered portion of the exterior of the firearm grip.

9. The apparatus of claim 7, wherein the at least one projection comprises an asymmetrical tooth.

10. The apparatus of claim 9, wherein the asymmetrical tooth includes at least one angled side, wherein an angle of an angled side of the at least one angled side is 120 degrees or less.

11. The apparatus of claim 10, wherein the angle of the the angled side is 100 degrees or less.

12. The apparatus of claim 5, wherein the attachment comprises magazine funnel or another grip attachment.

13. The apparatus of claim 5, further comprising a plurality of attachment features, the plurality of attachment features including the male feature or the female feature, wherein at least one attachment feature of the plurality of attachment features comprises a threaded part.

14. The apparatus of claim 5, further comprising a plurality of attachment features, the plurality of attachment features including the male feature or the female feature, wherein at least one attachment feature of the plurality of attachment features comprises an opening to receive a portion of a spring-biased non-threaded part.

15. The apparatus of claim 5, wherein the opening is located aftly of a magazine receptacle, in which a wall is between the opening and the magazine receptacle;

wherein a portion of an exterior of the expansion section, operable to engage an interior of said opening to retain a body of the retention system in said opening, is drivable against a receiving portion of the interior, characterized in that said receiving portion is not part of the wall.

16. The apparatus of claim 6, wherein the drive section of the retention system comprises a rotatably driven part.

17. The apparatus of claim 16, wherein the body includes a threaded opening for the rotatably driven part and a non-threaded opening for a spring-biased part.

18. The apparatus of claim 6, wherein the expansion section comprises a threaded opening corresponding to the drive section and an additional opening, wherein the additional opening is non-threaded.

19. The apparatus of claim 18, further comprising a spring-biased part at least partially located in the additional opening when the retention system is installed in the aftly-positioned opening.

20. The apparatus of claim 19, the spring collapsible in a first collapsed state to install the attachment to the firearm, the spring in a second state when installation is complete;

wherein the second state is different than the first collapsed state.

21. The apparatus of claim 6, wherein the attachment includes an attachment interface and the retention system includes a slideable attachment interface corresponding thereto;

the slideable attachment interface to couple the attachment to the retention system, the slideable attachment interface to restrict a coupling movement of the attachment relative to the firearm, wherein the coupling movement is along a plane, wherein the slideable attachment interface comprises one of a male feature and a female feature of a dovetail interface, a T-slot interface, or another undercut interface and the attachment interface comprises the other of the male feature and the female feature.

22. The apparatus of claim 6, wherein the attachment comprises a magazine funnel or another grip attachment.

23. The apparatus of claim 6, further comprising a plurality of attachment features, the plurality of attachment features including a male feature and a female feature of a dovetail interface, a T-slot interface, or another undercut interface, wherein at least one attachment feature of the plurality of attachment features comprises a threaded part.

24. The apparatus of claim 6, further comprising a plurality of attachment features, the plurality of attachment features including a male feature and a female feature of a dovetail interface, a T-slot interface, or another undercut interface, wherein at least one attachment feature of the plurality of attachment features comprises an opening to receive a portion of a spring-biased non-threaded part.

25. A firearm assembly comprising the apparatus of claim 6, wherein the firearm comprises the firearm assembly.

* * * * *